US011594383B2

(12) United States Patent
Fukuda et al.

(10) Patent No.: US 11,594,383 B2
(45) Date of Patent: Feb. 28, 2023

(54) CIRCUIT INTERRUPTER

(71) Applicant: Panasonic Intellectual Property Management Co., Ltd., Osaka (JP)

(72) Inventors: Yoshihisa Fukuda, Osaka (JP); Shinya Kimoto, Osaka (JP); Kenji Kanematsu, Osaka (JP); Kazuhisa Kinoshita, Osaka (JP); Masato Nakamura, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 89 days.

(21) Appl. No.: 16/982,269

(22) PCT Filed: Mar. 5, 2019

(86) PCT No.: PCT/JP2019/008509
§ 371 (c)(1),
(2) Date: Sep. 18, 2020

(87) PCT Pub. No.: WO2019/181469
PCT Pub. Date: Sep. 26, 2019

(65) Prior Publication Data

US 2021/0057172 A1 Feb. 25, 2021

(30) Foreign Application Priority Data

Mar. 20, 2018 (JP) ..... JP2018-053550
Mar. 20, 2018 (JP) ..... JP2018-053551

(51) Int. Cl.
*H01H 1/54* (2006.01)
*H01H 9/44* (2006.01)
*H01H 33/18* (2006.01)

(52) U.S. Cl.
CPC ..... *H01H 1/54* (2013.01); *H01H 9/443* (2013.01); *H01H 33/182* (2013.01)

(58) Field of Classification Search
CPC ..... H01H 50/546; H01H 50/023; H01H 50/44
See application file for complete search history.

(56) References Cited

U.S. PATENT DOCUMENTS 3,264,438 A 8/1966 Gay
4,250,365 A 2/1981 McConnell
(Continued)

FOREIGN PATENT DOCUMENTS

DE 198 57 169 A1 6/2000
EP 0 548 390 A1 6/1993
(Continued)

OTHER PUBLICATIONS

Machine translation of Tsuchiya [JP 2010153371 A] (Year: 2010).*
(Continued)

*Primary Examiner* — Bernard Rojas
(74) *Attorney, Agent, or Firm* — Greenblum & Bernstein, P.L.C.

(57) ABSTRACT

A circuit interrupter includes: a first fixed terminal including a first fixed contact; a movable contactor which is formed as a separate part from the first fixed terminal and includes a first movable contact; a holding unit configured to hold the movable contactor so that the first movable contact is connected to the first fixed contact; and a squib configured to generate gas by combustion. In the circuit interrupter, pressure of the gas generated by the squib causes movement of the movable contactor in a direction away from the first fixed terminal so that the first movable contact is separated from the first fixed contact.

15 Claims, 42 Drawing Sheets

(56) References Cited

U.S. PATENT DOCUMENTS

| | | | | |
|---|---|---|---|---|
| 6,198,058 | B1 * | 3/2001 | Graninger | H01H 13/503 200/16 R |
| 8,816,803 | B2 * | 8/2014 | Naka | H01H 1/50 335/133 |
| 8,847,714 | B2 * | 9/2014 | Uchida | H01H 1/54 335/131 |
| 9,013,253 | B2 | 4/2015 | Uchida | |
| 11,081,303 | B2 * | 8/2021 | Volkmann | H01H 39/006 |
| 2005/0285704 | A1 * | 12/2005 | Imanishi | H01H 9/443 335/128 |
| 2008/0121504 | A1 | 5/2008 | Vogelsang et al. | |
| 2011/0241809 | A1 * | 10/2011 | Sugisawa | H01H 1/54 335/188 |
| 2013/0021121 | A1 | 1/2013 | Uchida | |
| 2014/0353136 | A1 | 12/2014 | Von Prondzinski et al. | |
| 2016/0343524 | A1 | 11/2016 | Gaudinat et al. | |
| 2016/0351363 | A1 | 12/2016 | Gaudinat et al. | |
| 2017/0279250 | A1 * | 9/2017 | Pal | H01H 1/226 |
| 2019/0355536 | A1 * | 11/2019 | Ozaki | H01H 50/645 |
| 2020/0251292 | A1 * | 8/2020 | Bobert | H05B 1/0213 |

FOREIGN PATENT DOCUMENTS

| | | | |
|---|---|---|---|
| JP | S48-8644 | U | 1/1973 |
| JP | S49-24742 | B1 | 6/1974 |
| JP | S53-135571 | U | 10/1978 |
| JP | H4-68334 | U | 6/1992 |
| JP | H8-138511 | A | 5/1996 |
| JP | 2004-288604 | A | 10/2004 |
| JP | 2005-302588 | A | 10/2005 |
| JP | 2010-153371 | A | 7/2010 |
| JP | 2013-41815 | A | 2/2013 |
| JP | 2015-72925 | A | 4/2015 |
| JP | 2017-507469 | A | 3/2017 |
| JP | 2017-117678 | A | 6/2017 |
| WO | WO 2010/061576 | A1 | 6/2010 |

OTHER PUBLICATIONS

Extended European Search Report, dated Apr. 16, 2021 by the European Patent Office (EPO), in the corresponding European Patent Application No. 19770503.1.

ISR for PCT/JP2019/008509, dated May 21, 2019 (w/ English translation).

* cited by examiner

CIRCUIT INTERRUPTER

This application is a U.S. National Stage Entry of PCT/JP2019/008509 filed Mar. 5, 2019, which claims priority under 35 U.S.C. § 119(a) to Japan Application No. 2018-053550 filed Mar. 20, 2018, and to Japan Application No. 2018-053551 filed Mar. 20, 2018. The disclosure of each of these applications is expressly incorporated by reference herein in its entirety.

TECHNICAL FIELD

The present disclosure generally relates to circuit interrupters and in particular to a circuit interrupter for interrupting a circuit in response to generation of gas by combustion.

BACKGROUND ART

Patent Literature 1 discloses a breaker including a pyrotechnic actuator which is intended to be mounted on an automobile, in particular, an electric vehicle.

The breaker of Patent Literature 1 includes a conductor, a housing, a matrix, a punch, and a pyrotechnic actuator.

The housing is partially intersected by the conductor. Opposite ends of the conductor serve as two connection terminals for the breaker. The matrix and the punch are placed on opposite sides (upper and lower sides) of the conductor.

The pyrotechnic actuator moves the punch from a first position to a second position when ignited. In movement of the punch from the first position to the second position, the punch, and the matrix break (chop) the conductor into three separate parts. The punch includes a groove. While the punch is in the second position, the groove of the punch is engaged with the matrix.

The breaker disclosed in Patent Literature 1 breaks the conductor by use of energy generated by the pyrotechnic actuator, thereby interrupting a circuit. Therefore, this breaker needs a time for interrupting the circuit. And, in the broken circuit, it is difficult to increase a gap between higher and lower voltage side circuits. Improvement of current interruption performance is limited.

CITATION LIST

Patent Literature

Patent Literature 1 JP 2017-507469 A

SUMMARY OF INVENTION

In view of the above insufficiency, an object of the present disclosure would be to propose a circuit interrupter capable of improving current interruption performance.

A circuit interrupter according to one aspect of the present disclosure includes: a fixed terminal, a movable contactor, a holding unit, and a squib. The fixed terminal includes a fixed contact. The movable contactor is formed as a separate part from the fixed terminal and includes a movable contact. The holding unit is configured to hold the movable contactor so that the movable contact is connected to the fixed contact. The squib is configured to generate gas by combustion. Pressure of the gas generated by the squib causes movement of the movable contactor in a direction away from the fixed terminal so that the movable contact is separated from the fixed contact.

A circuit interrupter according to another aspect of the present disclosure includes a fixed terminal, a movable contactor, a squib, and accommodation. The fixed terminal includes a fixed contact. The movable contactor is formed as a separate part from the fixed terminal and includes a movable contact connected to the fixed contact. The squib is configured to generate gas by combustion. The accommodation is for accommodating the fixed contact and the movable contactor. Pressure of the gas generated by the squib causes movement of the movable contactor in a direction away from the fixed terminal in the accommodation so that the movable contact is separated from the fixed contact.

DESCRIPTION OF EMBODIMENTS

Embodiments and variations described below are some of example of the present disclosure. Various modifications may be made to the above-described embodiment and variations depending on design and the like as long as the object of the present disclosure can be achieved. Figures referred to in the following embodiments and variations are schematic, and there is no guarantee that ratios regarding sizes and thicknesses of components shown in the figures reflect actual ratios.

(1) Embodiments

A circuit interrupter 100 according to an embodiment will be described with reference to FIGS. 1 to 7.

(1.1) Overview

Figure 1:
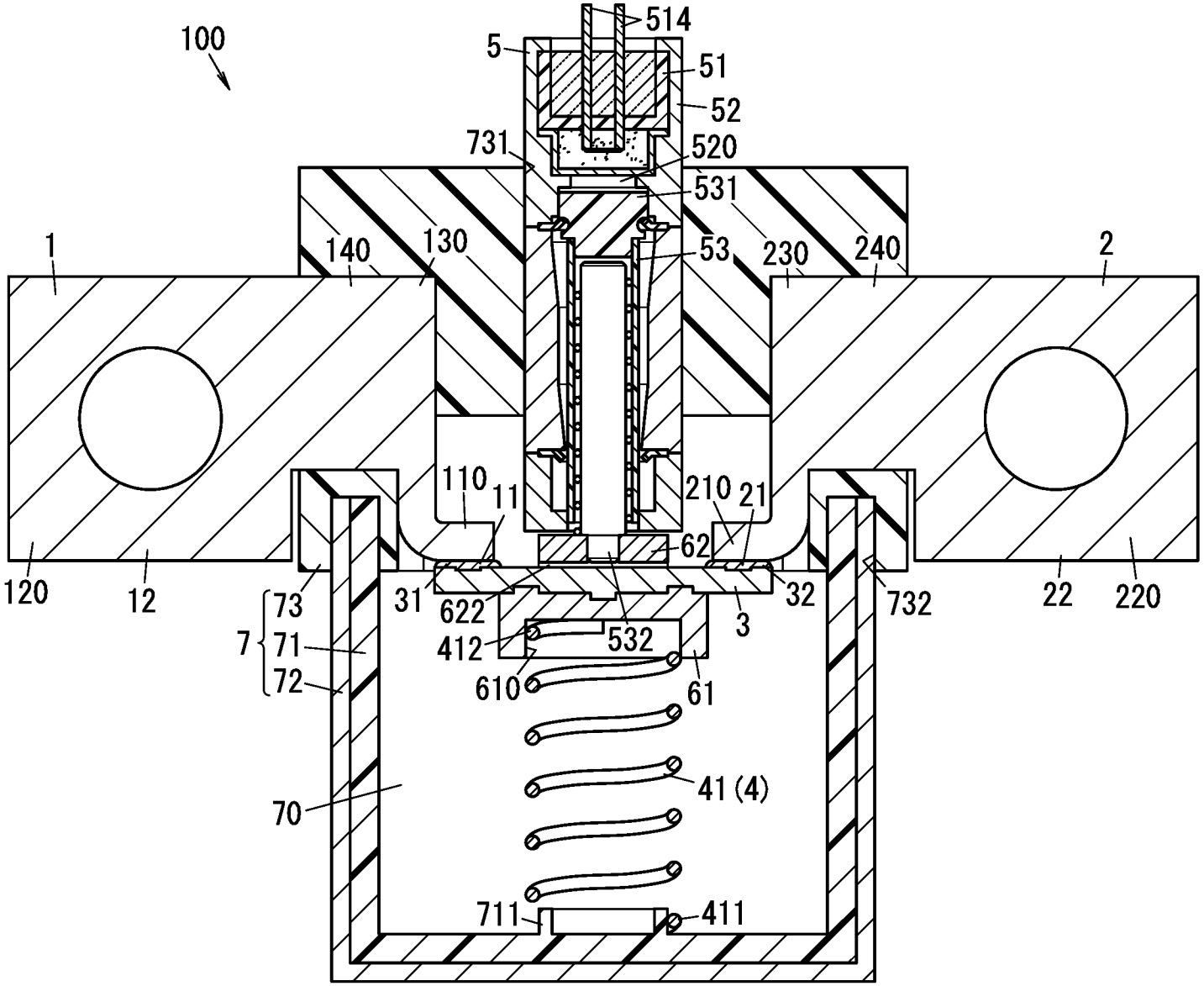
FIG. 1 is a cross-sectional view of a circuit interrupter according to one embodiment of the present disclosure.

The circuit interrupter 100 according to the embodiment includes, as shown in FIG. 1, a first fixed terminal (fixed terminal) 1, a second fixed terminal 2, a movable contactor (movable terminal) 3, a holding unit 4, a pyroactuator 5, and an accommodation 70.

The first fixed terminal 1 includes a first fixed contact (fixed contact) 11. The first fixed terminal 1 includes a first electrode 12 to be connected to a first end of electric circuitry.

The second fixed terminal 2 includes a second fixed contact 21. The second fixed terminal 2 is formed as a separate part from the first fixed terminal 1. The second fixed terminal 2 includes a second electrode 22 to be connected to a second end of the electric circuitry.

The movable contactor 3 includes a first movable contact (movable contact) 31. The first movable contact 31 is connected to the first fixed contact 11. The movable contactor 3 includes a second movable contact 32. The second movable contact 32 is connected to the second fixed contact 21. The movable contactor 3 is formed as a separate part from each of the first fixed terminal 1 and the second fixed terminal 2.

The first fixed contact 11, the second fixed contact 21, and the movable contactor 3 (the first movable contact 31 and the second movable contact 32) are accommodated in the accommodation 70.

The holding unit 4 holds the movable contactor 3 so that the first movable contact 31 is connected to the first fixed contact 11 and the second movable contact 32 is connected to the second fixed contact 21. In particular, the holding unit 4 holds the movable contactor 3 so that the first movable contact 31 and the second movable contact 32 are connected to the first fixed contact 11 and the second fixed contact 21, respectively, while no current flows through the movable contactor 3 (during a non-conduction state).

Figure 4:
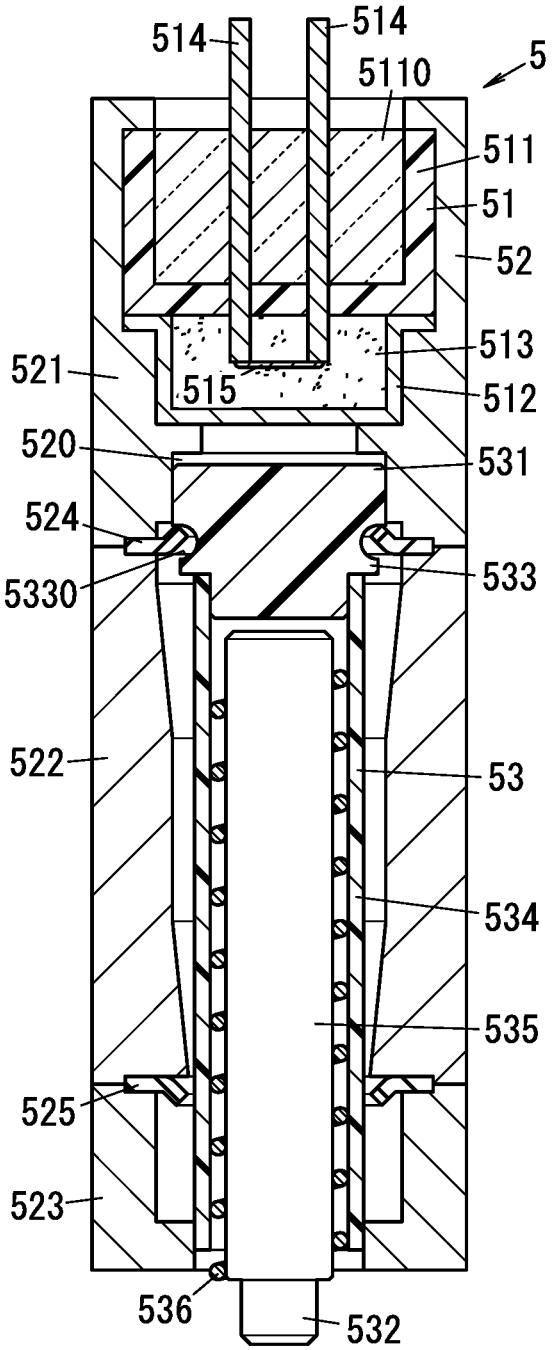
FIG. 4 is a cross-sectional view of a pyroactuator included in the above circuit interrupter.

As shown in FIG. 4, the pyroactuator 5 includes a squib 51, a pressurized chamber 520, and a piston 53.

The squib 51 is configured to generate gas by combustion. The squib 51 includes a heating element and an explosive (fuel). When the heating element is supplied with an electric signal, the heating element generates heat and then the explosive ignites. When the squib 51 is ignited, the explosive combusts to generate gas. The gas generated by the squib 51 is introduced into the pressurized chamber 520 to increase the pressure in the pressurized chamber 520.

The piston 53 receives pressure in the pressurized chamber 520 with its first end 531 and then is moved. The piston 53 applies a force in a direction away from the fixed terminal (the first fixed terminal) 1 to the movable contactor 3 (directly or indirectly) with its second end 532 to cause movement of the movable contactor 3. More specifically, the piston 53 receives the pressure of the pressurized chamber 520 with the first end 531 and is pressed by the increased pressure in the pressurized chamber 520 to press the movable contactor 3 with the second end 532. The piston 53 receives a large pressure in the pressurized chamber 520 to press the movable contactor 3 at a high speed.

Figure 6:
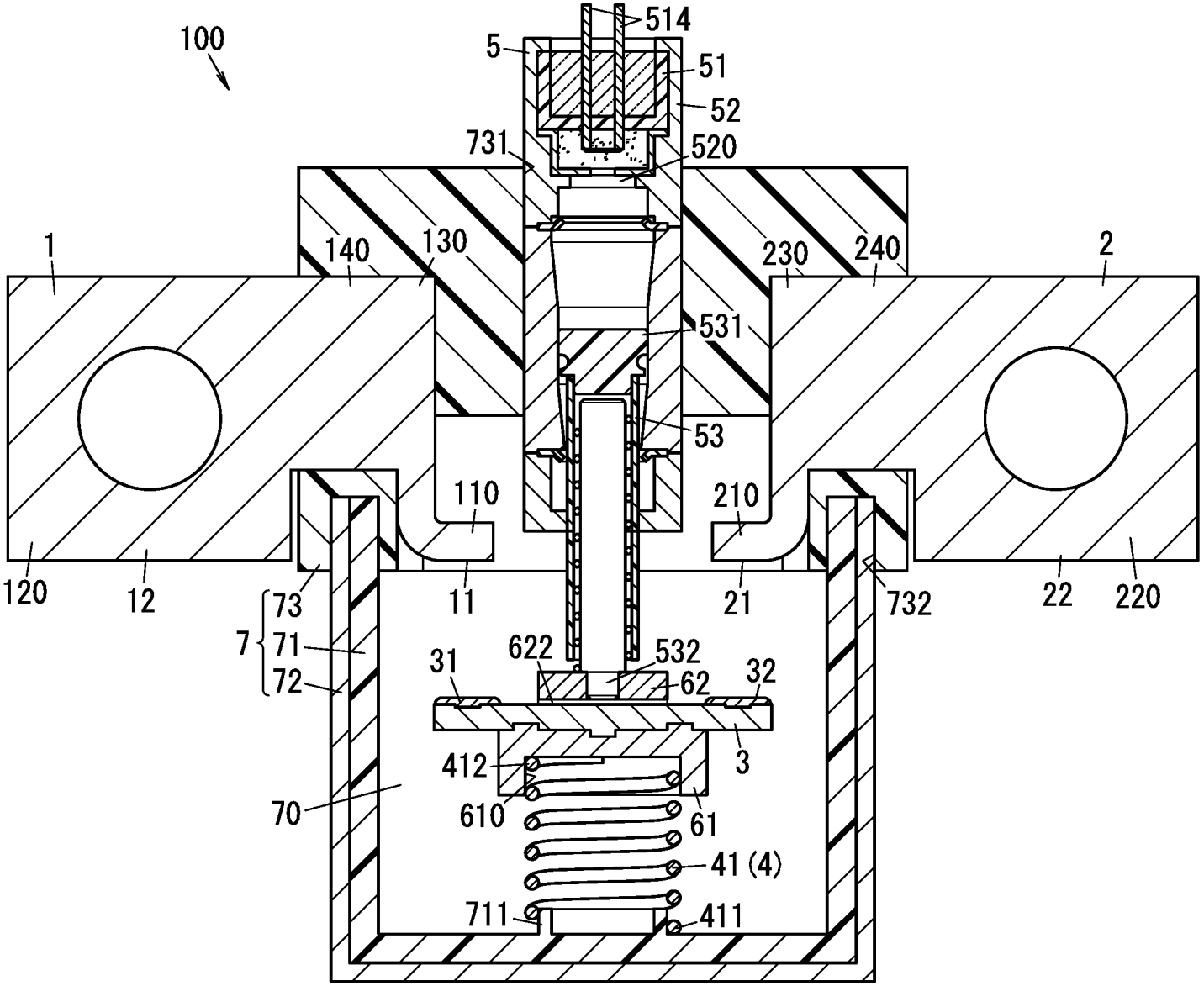
FIG. 6 is a cross-sectional view of the above circuit interrupter in operation.
Figure 7:
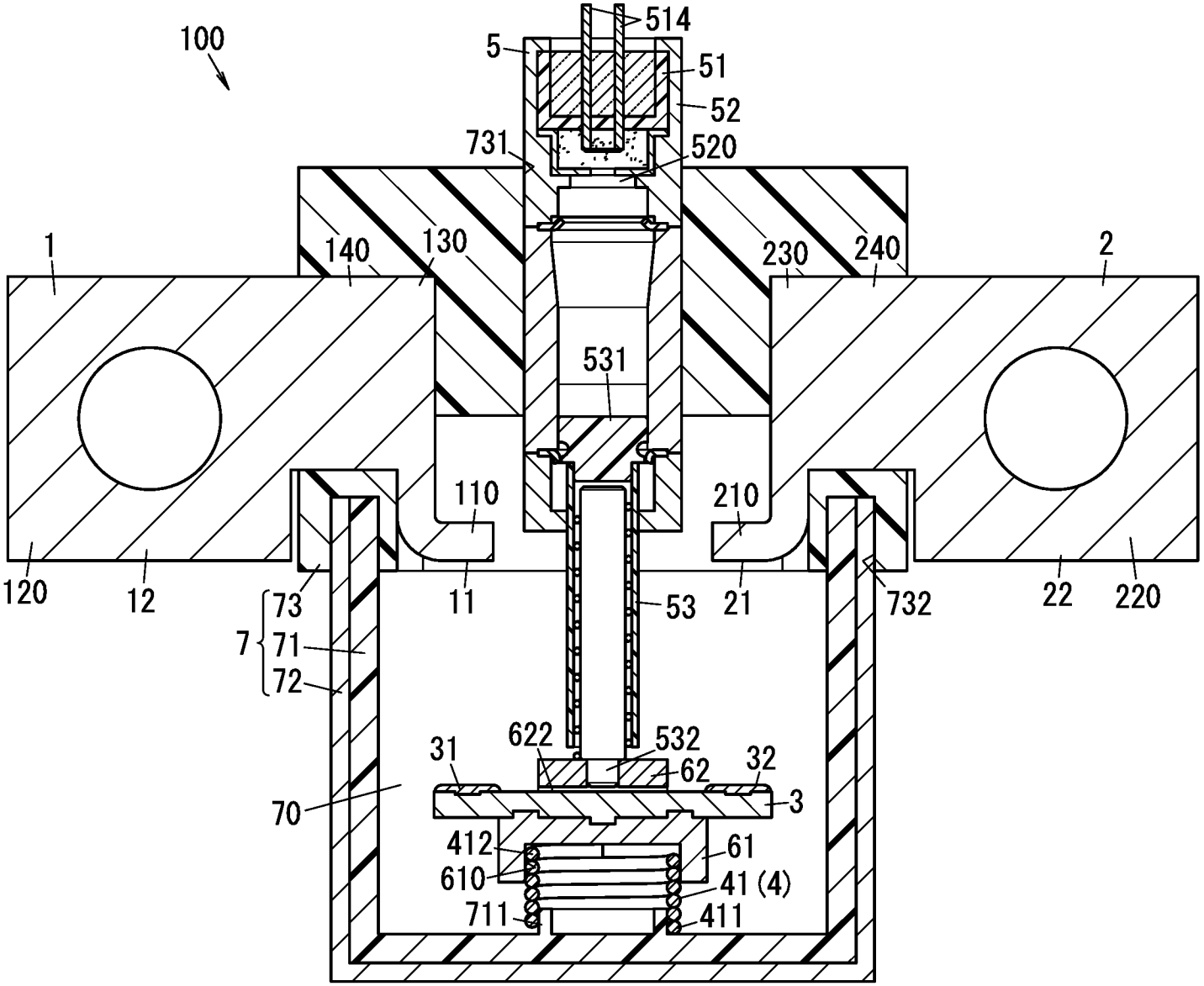
FIG. 7 is a cross-sectional view of the above circuit interrupter after operation.

The movable contactor 3 is pressed by the piston 53 and then moves within the accommodation 70. As shown in FIGS. 6-7, the movable contactor 3 is pressed by the piston 53 and therefore the first movable contact 31 is separated from the first fixed contact 11 and the second movable contact 32 is separated from the second fixed contact 21.

That is, in the circuit interrupter 100, pressure of the gas generated by the squib 51 causes movement of the movable contactor 3 in a direction away from the fixed terminal 1 so that the movable contact (first movable contact) 31 is separated from the fixed contact (first fixed contact) 11. Thus, an electric circuit between the first electrode 12 and the second electrode 22 is interrupted.

As described above, the circuit interrupter 100 moves the movable contactor 3 relative to the fixed terminal (first fixed terminal) 1 (i.e., separates the movable contactor 3 from the fixed terminal 1) at a high speed by using the energy of the gas generated by the squib 51 to interrupt (break) the circuit. Therefore, an arc developed between the contacts is rapidly stretched and extinguished by a distance as long as the movable contactor 3 moves. Thus, the circuit interrupter 100 can extinguish the arc in a short time and thus it is possible to improve the current interruption performance. Furthermore, the arc developed between the contacts is stretched by a distance of the movement of the movable contactor 3 in the accommodation 70 and thus extinguished. Thus, the circuit interrupter 100 can stretch and extinguish the arc and thus it is possible to improve the current interruption performance.

(1.2) Details Hereinafter, the circuit interrupter 100 according to the present embodiment will be described in detail with reference to FIGS. 1-7.

(1.2.1) Power Supply System

Figure 5:
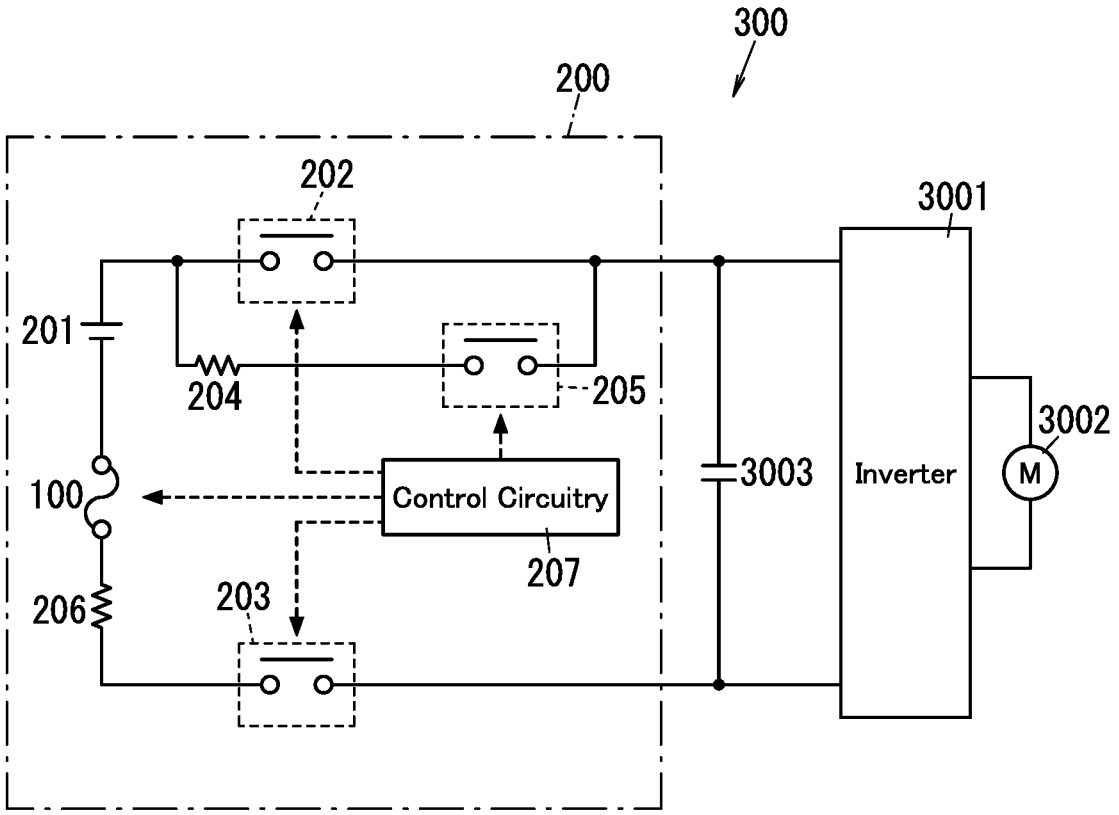
FIG. 5 is a circuit diagram for illustration of a power source system including the above circuit interrupter.

As shown in FIG. 5, the circuit interrupter 100 of the present embodiment is used, for example, as a fuse in the power supply system 200.

The power supply system 200, for example, is mounted on a vehicle 300 such as an electric vehicle and drives a motor 3002 connected via an inverter 3001 to allow the vehicle 300 to run. In the vehicle 300, as shown in FIG. 5, a precharge capacitor 3003 is connected in parallel with the inverter 3001.

In power transfer, the inverter 3001 converts DC power supplied from the power supply system 200 into AC power and supplies it to the motor 3002. In power regeneration, the inverter 3001 converts AC power supplied from the motor 3002 into DC power and supplies it to the power supply system 200. The motor 3002 is, for example, a three-phase AC synchronous motor.

The power supply system 200 includes a battery 201, a first main relay 202, a second main relay 203, a precharge resistor 204, a precharge relay 205, a current sensor (shunt resistor) 206, and control circuitry 207 in addition to the circuit interrupter 100.

The battery 201 includes a plurality of battery cells connected in series. Examples of the battery cells may include nickel metal hydride battery cells and lithium ion battery cells.

The first main relay 202 includes a first end connected to a positive electrode of the battery 201 and a second end connected to a first input terminal (high potential side input terminal) of the inverter 3001.

The second main relay 203 includes a first end connected to a negative electrode of the battery 201 through the current sensor 206 and the circuit interrupter 100 and a second end connected to a second input terminal (low potential side input terminal) of the inverter 3001.

A series circuit of the precharge resistor 204 and the precharge relay 205 is connected in parallel with the first main relay 202.

The control circuitry 207 controls operations of the first main relay 202, the second main relay 203, the precharge relay 205, and the circuit interrupter 100.

When power supply to the motor 3002 is started, the control circuitry 207 closes the precharge relay 205 and the second main relay 203 to charge the precharge capacitor 3003. Thus, inrush current to the motor 3002 is suppressed. After completion of charging of the precharge capacitor 3003, the control circuitry 207 opens the precharge relay 205 and closes the first main relay 202 to start power supply from the power supply system 200.

The control circuitry 207 also detects occurrence of an abnormality in circuitry including the power supply system 200 based on a current detected by the current sensor 206. When an abnormality occurs in the circuitry including the power supply system 200, the control circuitry 207 operates (activates) at least one of the first main relay 202, the second main relay 203, and the circuit interrupter 100 to interrupt the circuitry.

The control circuitry 207 opens at least one of the first main relay 202 and the second main relay 203 when, for example, time in which the magnitude of the current detected by the current sensor 206 exceeds a first threshold value continues for first time. Thereby the circuitry is interrupted. In this case, for example, when the opened relay (the first main relay 202 and/or the second main relay 203) is closed again by the control circuitry 207, the circuitry is made again and therefore the power supply from the power supply system 200 to the motor 3002 is resumed.

On the other hand, for example, when time in which the magnitude of the current detected by the current sensor 206 exceeds a second threshold value (>the first threshold value) continues for second time, the control circuitry 207 operates the circuit interrupter 100. Thereby, the circuitry is interrupted. The circuit interrupter 100 is a breaker for breaking an electrical circuit (path) of circuitry. The circuit interrupter 100 continues to break the electric circuit once operated (activated). After activation of the circuit interrupter 100, the power supply from the power supply system 200 to the motor 3002 is stopped. Therefore, in the event of an accident or the like of the vehicle 300, operation of the circuit interrupter 100 can separate the power supply system 200.

(1.2.2) Configuration

Next, the configuration of the circuit interrupter 100 will be described with reference to FIGS. 1-4.

As described above, the circuit interrupter 100 includes the first fixed terminal 1, the second fixed terminal 2, the movable contactor 3, the holding unit 4, and the pyroactuator 5. Further, as shown in FIG. 1, the circuit interrupter 100 includes a first yoke (lower yoke) 61, a second yoke (upper yoke) 62, and a housing 7 including the accommodation 70.

The movable contactor 3 of the present embodiment is a plate member made of a metallic material with electrical conductivity and is formed to have length in one direction. The movable contactor 3 includes the first movable contact 31 and the second movable contact 32 at respective first and second ends in its length direction. The first fixed terminal 1 and the second fixed terminal 2 are arranged side by side along the length direction of the movable contactor 3. The first fixed terminal 1 includes the first fixed contact 11 at a position facing the first movable contact 31 of the movable contactor 3 and the second fixed terminal 2 includes the second fixed contact 21 at a position facing the second movable contact 32 of the movable contactor 3.

Hereinafter, for convenience of explanation, an upward/downward direction defines a direction in which the first fixed contact 11 and the first movable contact 31 face each other (a direction in which the second fixed contact 21 and the second movable contact 32 face each other; an upward/downward direction in FIG. 1) and an upward direction defines a direction from the first movable contact 31 toward the first fixed contact 11. Further, a rightward/leftward direction defines a direction in which the first fixed terminal 1 and the second fixed terminal 2 are aligned side by side (a rightward/leftward direction in FIG. 1) and a rightward direction defines a direction from the first fixed terminal 1 toward the second fixed terminal 2. That is to say, in the following description, the upward, downward, rightward, and leftward directions are supposed to be defined on the basis of the directions shown in FIG. 1. Furthermore, in the following description, a direction perpendicular to both the upward/downward direction and the rightward/leftward direction (i.e., the direction coming out of the paper on which FIG. 1 is depicted) is defined herein to be a forward/backward direction. However, these directions are not intended to limit the usage of the circuit interrupter 100.

The first fixed terminal 1 and the second fixed terminal 2 are placed to be arranged side by side in the rightward/leftward direction (see FIG. 1). Each of the first fixed terminal 1 and the second fixed terminal 2 is made of a metallic material with electrical conductivity. The first fixed terminal 1 and the second fixed terminal 2 function as terminals for connecting the external electric circuitry (the circuitry constituting the power supply system 200) to the first fixed contact 11 and the second fixed contact 21. In the present embodiment, each of the first fixed terminal 1 and the second fixed terminal 2 is made of copper (Cu) as an example. However, not limited thereto, each of the first fixed terminal 1 and the second fixed terminal 2 may be made of an electrically conductive material other than copper.

Figure 2:
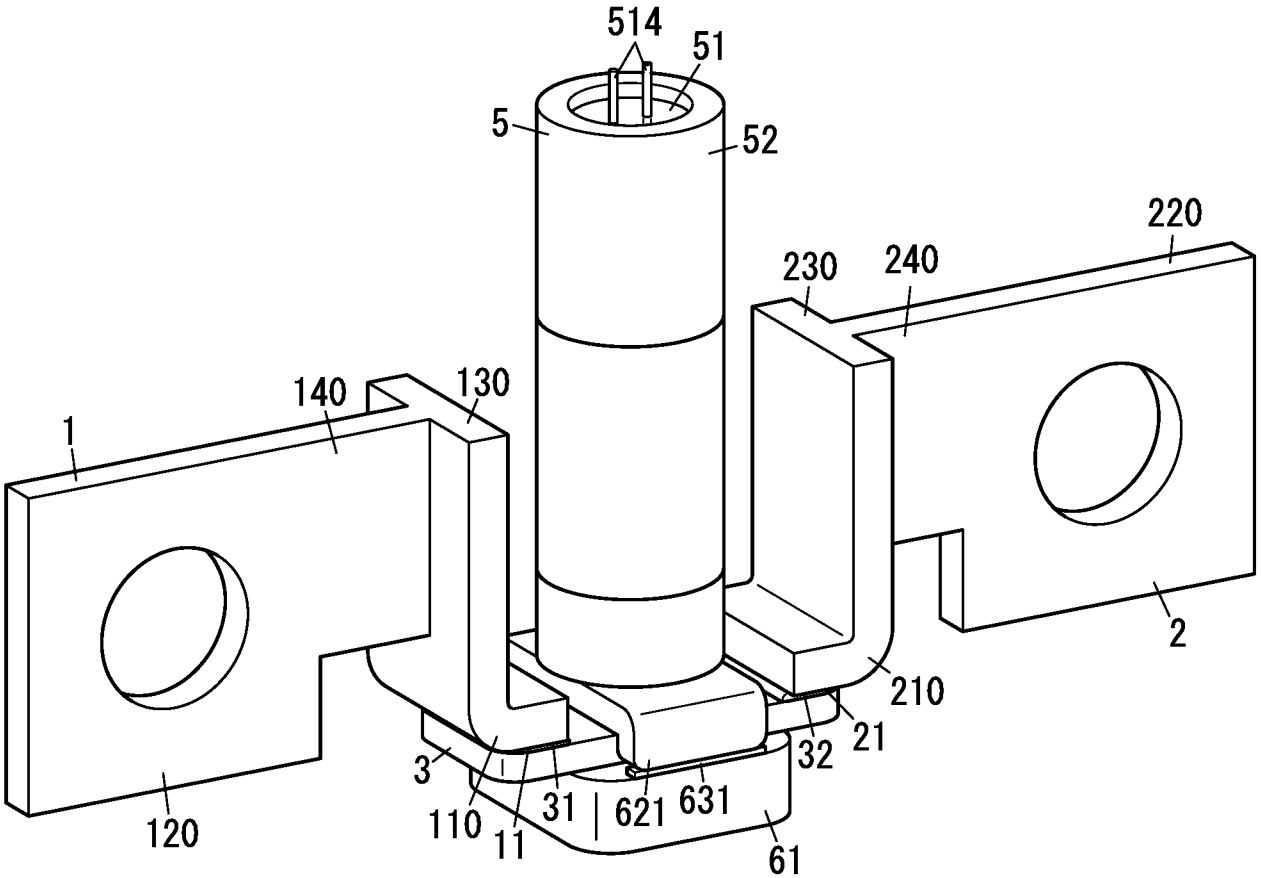
FIG. 2 is a perspective view of primary part of the above circuit interrupter.

As shown in FIG. 2, the first fixed terminal 1 includes a connection piece 110, an electrode piece 120, an interconnection piece 130, and a circuit piece 140 which are formed as an integral part.

The connection piece 110 has a rectangular plate shape with a thickness in the upward/downward direction and a length in the forward/backward direction. In the present embodiment, a lower surface of the connection piece 110 functions as the first fixed contact 11 but is not limited thereto. The first fixed contact 11, for example, may be made of a separate member from the connection piece 110 and fixed to the connection piece 110 by welding or the like.

The electrode piece 120 has a plate shape with a thickness in the forward/backward direction. The electrode piece 120 has a square shape and includes a through hole in its center. The electrode piece 120 is configured to be connected to the first end of the external electric circuitry. That is, the electrode piece 120 functions as the first electrode 12 to be connected to the first end of the external electric circuitry.

The interconnection piece 130 has a rectangular plate shape with a thickness in the rightward/leftward direction and a length in the upward/downward direction. A lower side of the interconnection piece 130 is connected to a left side of the connection piece 110.

The circuit piece 140 has a plate shape with a thickness in the forward/backward direction. The circuit piece 140 interconnects the electrode piece 120 and the interconnection piece 130. A left side of the circuit piece 140 is coupled to an upper portion of a right side of the electrode piece 120. The right side of the circuit piece 140 is coupled to a center of a left surface of the interconnection piece 130.

As shown in FIG. 2, the second fixed terminal 2 includes a connection piece 210, an electrode piece 220, an interconnection piece 210, and a circuit piece 240 which are formed as an integral part.

The connection piece 210 has a rectangular plate shape with a thickness in the upward/downward direction and a length in the forward/backward direction. In the present embodiment, a lower surface of the connection piece 210 functions as the second fixed contact 21 but is not limited thereto. The second fixed contact 21, for example, may be made of a separate member from the connection piece 210 and fixed to the connection piece 210 by welding or the like.

The electrode piece 220 has a plate shape with a thickness in the forward/backward direction. The electrode piece 220 has a square shape and includes a through hole in its center. The electrode piece 220 is configured to be connected to the second end of the external electric circuitry. That is, the electrode piece 220 functions as the second electrode 22 to be connected to the second end of the external electric circuitry.

The interconnection piece 230 has a rectangular plate shape with a thickness in the rightward/leftward direction and a length in the upward/downward direction. A lower side of the interconnection piece 230 is coupled to a right side of the connection piece 210.

The circuit piece 240 has a plate shape with a thickness in the forward/backward direction. The circuit piece 240 interconnects the electrode piece 220 and the interconnection piece 230. The right side of the circuit piece 240 is coupled to an upper portion of the left side of the electrode piece 220. The left side of the circuit piece 240 is coupled to a center of a right surface of the interconnection piece 230.

As shown in FIG. 1, the first fixed terminal 1 is fixed to the housing 7 so that the electrode piece 120 protrudes outside from a left wall of the housing 7 and a lower end of the interconnection piece 130 and the connection piece 110 are placed in an inside space of the housing 7 (the accommodation 70). The second fixed terminal 2 is fixed to the housing 7 so that the electrode piece 220 protrudes outside from a right wall of the housing 7 and a lower end of the interconnection piece 230 and the connection piece 210 are placed in the inside space of the housing 7 (the accommodation 70).

Figure 3:
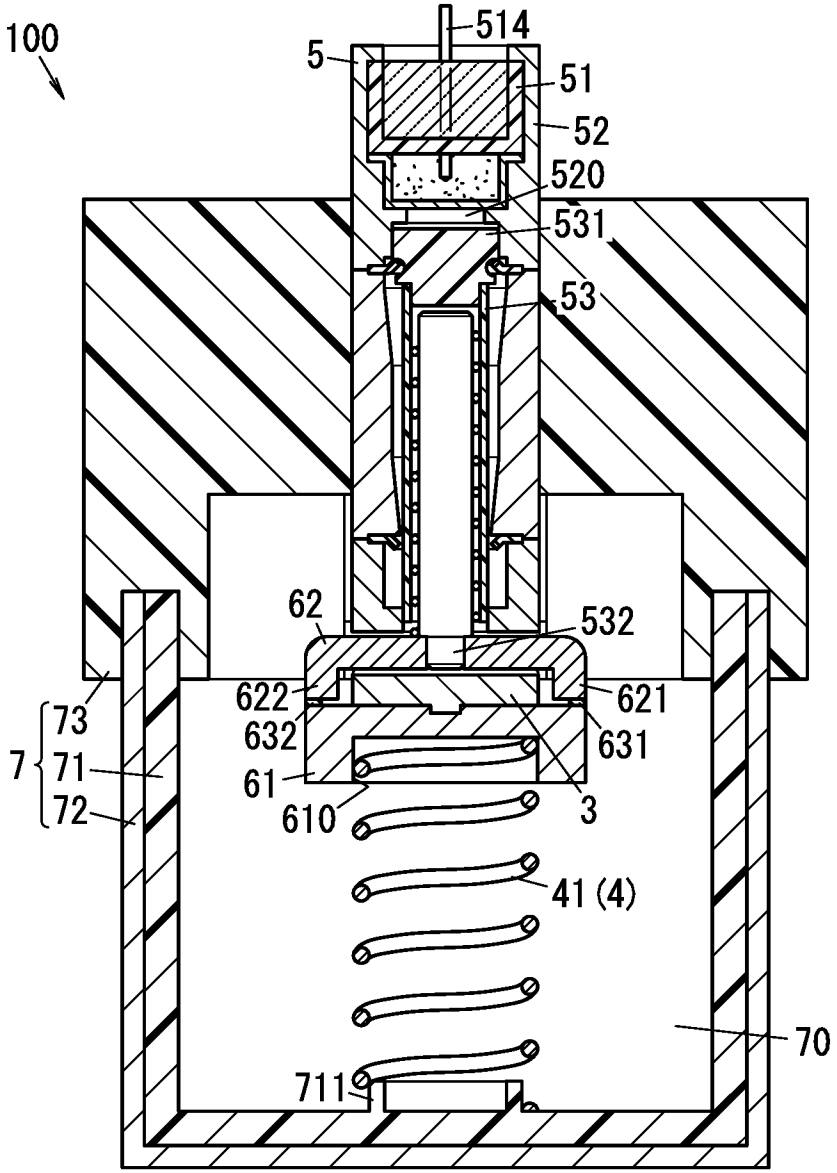
FIG. 3 is a cross-sectional view in a direction perpendicular to the sheet of FIG. 1, of the above circuit interrupter.

As shown in FIGS. 1-3, the movable contactor 3 has a plate shape which has a thickness in the upward/downward direction and is lager in the rightward/leftward direction than in the forward/backward direction. The movable contactor 3 is placed below the connection piece 110 and the connection piece 210 to allow its opposite ends in a length direction (the rightward/leftward direction) to face (be connected to) the first fixed contact 11 and the second fixed contact 21. The first movable contact 31 is provided to a part of the movable contactor 3 which faces the first fixed contact 11 and the second movable contact 32 is provided to a part of the movable contactor 3 which faces the second fixed contact 21 (see FIG. 1).

In the present embodiment, the first movable contact 31 is in contact with the first fixed contact 11. More particularly, the first movable contact 31 is in surface contact with the first fixed contact 11. The second movable contact 32 is in contact with the second fixed contact 21. More particularly, the second movable contact 32 is in surface contact with the second fixed contact 21.

In the present embodiment, the first movable contact 31 is a separate member from the movable contactor 3, is made of silver (Ag), and is fixed to the movable contactor 3 by welding or the like. Similarly, the second movable contact 32 is a separate member from the movable contactor 3, is made of silver (Ag) and is fixed to the movable contactor 3 by welding or the like. However, not limited thereto, each of the first movable contact 31 and the second movable contact 32 may be formed integrally with the movable contactor 3 by striking the movable contactor 3 partially.

As shown in FIG. 1, the movable contactor 3 is accommodated in the inside space of the housing 7 (the accommodation 70). The movable contactor 3 is held by the holding unit 4 so that the first movable contact 31 and the second movable contact 32 are connected to the first fixed contact 11 and the second fixed contact 21, respectively.

The first fixed terminal 1 and the second fixed terminal 2 are short-circuited through the movable contactor 3. That is, the first electrode 12 of the first fixed terminal 1 is electrically connected to the second electrode 22 of the second fixed terminal 2 through the first fixed contact 11, the first movable contact 31, the movable contactor 3, the second movable contact 32 and the second fixed contact 21 (see FIG. 2). Therefore, when the first electrode 12 and the second electrode 22 are electrically connected to the first end and the second end of the electric circuitry respectively, the circuit interrupter 100 forms an electric path between the first electrode 12 and the second electrode 22.

As shown in FIGS. 1, 3, the housing 7 includes an inner hollow cylinder 71, an outer hollow cylinder 72, and a cover member 73.

The inner hollow cylinder 71 is made of a material having electrically insulating properties, for example, a resin material. The inner hollow cylinder 71 has a bottomed hollow circular cylindrical shape with a closed lower surface and an open upper surface. A holding rib 711 which has a hollow circular cylindrical shape is provided to an upper surface of a lower wall of the inner hollow cylinder 71 (a bottom surface of the inner hollow cylinder 71). The holding rib 711 is formed concentrically with the inner hollow cylinder 71.

The outer hollow cylinder 72 is made of, for example, a metal material. The outer hollow cylinder 72 is preferably made of a non-magnetic metal material. Examples of the non-magnetic metallic material may include an austenitic stainless steel such as SUS304. However, the material of the outer hollow cylinder 72 may not be non-magnetic and may be, for example, an alloy containing iron as a main component, such as 42 alloy.

The outer hollow cylinder 72 is concentric with the inner hollow cylinder 71 and has a bottomed hollow circular cylindrical shape with a closed lower surface and an open upper surface. The outer hollow cylinder 72 is provided to surround a periphery of the inner hollow cylinder 71. In other words, the outer hollow cylinder 72 is a strength member for improving the strength of the housing 7 (the strength of an outer wall of the accommodation 70).

The inner hollow cylinder 71 may be integrally formed with the outer hollow cylinder 72 by, for example, insert molding or the like. The housing 7 may not include the outer hollow cylinder 72.

The cover member 73 is made of a material having electrically insulating properties, for example, a resin material. The cover member 73 has a bottomed hollow cylindrical shape with a closed upper surface and a lower surface having an opening. The cover member 73, for example, may be formed integrally with the first fixed terminal 1 and the second fixed terminal 2 by insert molding.

A thickness of an upper wall of the cover member 73 is larger than a thickness of a side wall of the cover member 73. A through hole 731 which is concentric with the cover member 73 is formed in a center of the upper wall of the cover member 73. The pyroactuator 5 is placed inside the through hole 731 of the cover member 73. A lower end of the pyroactuator 5 protrudes from a lower surface (inner surface) of the upper wall of the cover member 73. The through hole 731 is hermetically closed by the pyroactuator 5 (a case 52 thereof).

An annular recessed groove 732 is formed in a lower surface of the side wall of the cover member 73. By inserting upper edges of the inner hollow cylinder 71 and the outer hollow cylinder 72 into the recessed groove 732, the inner hollow cylinder 71 and the outer hollow cylinder 72 are coupled to the cover member 73. As a result, the housing 7 has the airtight inside space (the accommodation 70) surrounded by the inner hollow cylinder 71 and the cover member 73. The first fixed contact 11, the second fixed contact 21, and the movable contactor 3 are accommodated in the inside space (the accommodation 70) of the housing 7. An arc extinction gas such as hydrogen may be sealed in the accommodation 70.

In the present embodiment, the shape of the housing 7 is a substantially circular cylindrical shape having an inside space (the accommodation 70) but may not be limited thereto. It is sufficient that the housing 7 has any shape as long as it has an inside space (the accommodation 70) for accommodating the first fixed contact 11, the second fixed contact 21, and the movable contactor 3. The housing 7 may have another shape such as a hollow polygonal prism (for example, a hollow rectangular parallelepiped shape).

The first yoke 61 is a ferromagnetic body and may be made of a metallic material such as iron. The first yoke 61 is fixed to the lower surface of the movable contactor 3 and is integral with the movable contactor 3 (see FIGS. 1, 3). That is, the first yoke 61 is fixed to an opposite surface of the movable contactor 3 from a surface where the first movable contact 31 and the second movable contact 32 are placed.

When a current flows through the movable contactor 3, the first yoke 61 allows a magnetic field caused by the current to pass through the first yoke 61. That is, when the first yoke 61 is not provided, the (concentric) magnetic field around the current flowing through the movable contactor 3 is generated. When the first yoke 61 is provided, the magnetic field is changed so as to pass through the first yoke 61. Therefore, the center of the magnetic field acting on the current flowing through the movable contactor 3 is attracted toward the surface where the first movable contact 31 and the second movable contact 32 are placed (i.e., the upper surface). As a result, a relatively upward force is generated in the movable contactor 3. Therefore, the connection between the pair of the first movable contact 31 and the second movable contact 32 and the pair of the first fixed contact 11 and the second fixed contact 21 are more easily maintained in a case where the first yoke 61 is provided than in a case where the first yoke 61 is not provided.

An engagement recess 610 which is a circular cylindrical recess is formed in a lower surface of the first yoke 61.

The secondary yoke 62 is a ferromagnetic body and may be made of a metallic material such as iron. The second yoke 62 is fixed at a position facing the first yoke 61 with the movable contactor 3 in-between and is separated from the movable contactor 3. The second yoke 62 may be in contact with the second end 532 (lower end) of the piston 53 of the pyroactuator 5. In this embodiment, the second yoke 62 is fixed to the second end 532 (lower end) of the piston 53 of the pyroactuator 5. The second yoke 62 is placed to face the center of the movable contactor 3 (see FIG. 2) but not to be in contact with the movable contactor 3 by a gap (see FIG. 3). The second yoke 62 is electrically insulated from the movable contactor 3.

The second yoke 62 includes a pair of protrusion parts 621, 622 (see FIG. 3) protruding in the upward direction at its both ends in the forward/backward direction. In other words, formed on both ends in the forward/backward direction of the upper surface of the second yoke 62 are the protrusion parts 621,622 respectively facing the side surfaces in the forward/backward direction of the movable contactor 3. As shown in FIG. 3, a distal end surface (lower end surface) of the protrusion part 621 which is a front one of the pair of protrusion parts 621,622 faces a front end of the first yoke 61 and a distal end surface (lower end surface) of the protrusion part 622 which is a back one of the pair faces a back end of the first yoke 61. Therefore, when a current flows between the first fixed terminal 1 and the second fixed terminal 2 through the movable contactor 3, a magnetic flux passing through a magnetic path formed by the first yoke 61 and the second yoke 62 is developed. At this time, the front end of the first yoke 61 and the protrusion part 621 at the front end of the second yoke 62 are magnetized to have different polarities. The back end of the first yoke 61 and the protrusion part 622 at the back end of the second yoke 62 are magnetized to have different polarities. As a result, an attraction force acts between the first yoke 61 and the second yoke 62. The second yoke 62 is fixed to the second end 532 (lower end) of the piston 53 and therefore the attraction force moves the first yoke 61 in the upward direction. When the first yoke 61 is move in the upward direction, an upward force is applied to the movable contactor 3 by the first yoke 61.

While a current flows through the movable contactor 3, this current may cause an electromagnetic repulsive force separating the first movable contact 31 and the second movable contact 32 from the first fixed contact 11 and the second fixed contact 21. That is, when a current flows through the movable contactor 3, the Lorentz force may cause the electromagnetic repulsive force, which moves the movable contactor 3 downward, on the movable contactor 3.

In the present embodiment, as described above, the magnetic field is changed by the first yoke 61 to pass through the first yoke 61 and therefore an upward force is generated in contrast to a case where the first yoke 61 is not provided. The above-mentioned attraction force acts between the first yoke 61 and the second yoke 62. Consequently, the current flowing through the movable contactor 3 causes a force moving the movable contactor 3 upward, i.e. a force pressing the first movable contact 31 and the second movable contact 32 onto the first fixed contact 11 and the second fixed contact 21 respectively.

As described above, the first yoke 61 and the second yoke 62 serves as a connection maintenance mechanism which produces a force maintaining the connection between the pair of the first movable contact 31 and the second movable contact 32 and the pair of the first fixed contact 11 and the second fixed contact 21 by using a current flowing through the movable contactor 3.

Placed between the protrusion parts 621, 622 of the second yoke 62 and the both ends in the forward/backward direction of the upper surface of the first yoke 61 are spacers 631, 632 made of a material having electrically insulating properties, for example, a resin material (see FIG. 3). Thus, the electrically insulating properties between the second yoke 62 and the first yoke 61 are ensured.

As shown in FIGS. 1, 3, the holding unit 4 of the present embodiment includes a contact pressure spring 41. The contact pressure spring 41 is a coil spring. The contact pressure spring 41 is placed between the bottom surface (inner surface) of the inner hollow cylinder 71 and the lower surface of the first yoke 61. The contact pressure spring 41 has a coil axis extending along the upward/downward direction. The holding rib 711 of the inner hollow cylinder 71 is inserted into an inside of a first end 411 of the contact pressure spring 41. A second end 412 of the contact pressure spring 41 is inserted into the engagement recess 610 of the first yoke 61. The contact pressure spring 41 biases the movable contactor 3 in the upward direction via the first yoke 61. That is, the holding unit 4 includes an elastic part (the contact pressure spring 41) for biasing the movable contactor 3 in a direction in which the movable contact (first movable contact) 31 is connected to the fixed contact (first fixed contact) 11.

The contact pressure spring 41 biases the movable contactor 3 in the upward direction through the first yoke 61. The contact pressure spring 41 holds the movable contactor 3 so that the first movable contact 31 is connected to the first fixed contact 11 and the second movable contact 32 is connected to the second fixed contact 21.

FIG. 4 shows a cross-sectional view of the pyroactuator 5 of the present embodiment. The pyroactuator 5 of the present embodiment has a so-called pin pusher structure configured to push out the piston 53 (the pin 535) by use of gas generated in the squib 51.

As shown in FIG. 4, the pyroactuator 5 includes the squib 51, a case 52 having the pressurized chamber 520 therein, and the piston 53.

The squib 51 includes a body 511, a metal sleeve (metal CAN) 512, a combustion part 513, a pair of pin electrodes 514, and a heating element 515.

The body 511 is made of, for example, a resin material or the like having electrically insulating properties and has a bottomed hollow circular cylindrical shape with an open upper surface and a closed lower surface. The inside space 5110 of the body 511 is sealed with a sealing material having electrically insulating properties such as glass.

The metal sleeve 512 is made of metal such as stainless steel, for example, and includes a hollow circular cylindrical part having a bottomed hollow circular cylinder with an open upper surface and a closed lower surface and a flange part protruding laterally from an upper end of the hollow circular cylindrical part, which are formed integrally. Formed in a center of a lower wall of the metal sleeve 512 (the hollow circular cylindrical part thereof) is a cross groove with a depth not penetrating through the lower wall or the like. That is, a portion of the lower wall of the metal sleeve 512 serves as a lower strength portion which is lower in strength (more easily broken) than the other portion of the metal sleeve 512. The metal sleeve 512 is coupled to the body 511 at the flange with bond to cover the lower surface of the body 511.

The combustion part 513 includes an explosive such as nitrocellulose, for example. The combustion part 513 is placed in a space surrounded by the body 511 and the metal sleeve 512. The explosive contained in the combustion part 513 may be any material that generates a large amount of gas by combustion and is not limited to nitrocellulose.

Each of the pair of pin electrodes 514 has a first end positioned within the combustion part 513 (in the space surrounded by the body 511 and the metal sleeve 512) and a second end exposed outside the pyroactuator 5 through the body 511. The second ends of the pair of pin electrodes 514 are connected to the control circuitry 207.

The heating element 515 is an element that generates heat by energization. In the present embodiment, the heating element 515 is a nichrome wire. The heating element 515 is placed in the combustion part 513 (the space surrounded by the body 511 and the metal sleeve 512). The heating element 515 is connected between the first ends of the pair of pin electrodes 514.

In the squib 51, when a current from the control circuitry 207 flows between the pair of pin electrodes 514, the heating element 515 generates heat and this causes increase in the temperature of the combustion part 513. When the temperature of the combustion part 513 (a surrounding part of the heating element 515) exceeds an ignition temperature, the explosive combusts explosively to generate a large amount of gas (for example, carbon monoxide gas, carbon dioxide gas, nitrogen gas) instantaneously. When the pressure in the combustion part 513 exceeds a withstand pressure of the low strength portion of the metal sleeve 512 due to generation of gas, the low strength portion is broken and the gas generated by combustion is discharged to the outside (in this embodiment, the lower pressurized chamber 520) through the broken portion.

As shown in FIG. 4, the piston 53 includes a base 533, a cylinder 534, the pin (rod) 535, and a spring 536.

The base 533 is formed of an electrically insulating material such as, for example, resin, and is made of, for example, polycarbonate or polybutylene terephthalate. The base 533 includes a first columnar section, a second columnar section, and a third columnar section in this order from the top each of which has a circular cylindrical shape. The first columnar section, the second columnar section, and the third columnar section are connected (concentrically) in the upward/downward direction with their axes being aligned. An outer diameter of the first columnar section is larger than an outer diameter of the second columnar section and the outer diameter of the second columnar section is larger than an outer diameter of the third columnar section. An annular holding groove 5330 which is concentric with the first columnar section and the second columnar section is formed at a boundary between the first columnar section and the second columnar section on an outer side surface of the base 533.

In the present embodiment, a bottom surface (upper surface) of the first columnar section of the base 533 serves as the first end 531 of the piston 53.

The cylinder 534 is made of an electrically insulating material such as resin. The cylinder 534 is formed in a hollow circular cylindrical shape. An inner diameter of the cylinder 534 is approximately equal to the outer diameter of the third columnar section of the base 533 but is smaller than the outer diameter of the second columnar section of the base 533. The outer diameter of the cylinder 534 is smaller than the outer diameter of the second columnar section of the base 533. The third columnar section of the base 533 is fitted into an opening in the upper surface of the cylinder 534 and thus the cylinder 534 and the base 533 are coupled to each other.

The pin 535 is made of an electrically insulating material such as, for example, resin, and is made of, for example, polycarbonate or polybutylene terephthalate. The pin 535 includes a large diameter portion and a small diameter portion in this order from the top each of which has a circular cylindrical shape. The large diameter portion and the small diameter portion are (concentrically) connected in the upward/downward direction with their axes being aligned. A length in an axial direction (the upward/downward direction) of the large diameter portion of the pin 535 is comparable to the length of the cylinder 534. Specifically, the length of the pin 535 is slightly greater than the distance between the bottom surface (lower surface) of the base 533 coupled to the cylinder 534 and the lower end of the cylinder 534. As shown in FIG. 1, the small diameter portion of the pin 535 is fixed in the through hole of the second yoke 62. In the present embodiment, part including the small diameter portion of the pin 535 serves as the second end 532 of the piston 53.

As shown in FIG. 4, the spring 536 is a coil spring. The spring 536 defines a relative position between the cylinder 534 and the pin 535. Specifically, the spring 536 is sandwiched between an inner side surface of the cylinder 534 and an outer side surface of the pin 535 to hold the pin 535 inside the cylinder 534.

The case 52 includes a holder 521, a sleeve 522, a cap 523, a first holding spring 524, and a second holding spring 525. The case 52 is formed in a substantially hollow circular cylindrical shape as a whole.

The holder 521 of the case 52 is made of metal, for example, aluminum or an aluminum alloy. The holder 521 has a substantially hollow circular cylindrical shape with open upper and lower surfaces and has an inner side surface which is a circumferential surface with multiple steps. The holder 521 holds the squib 51 and the piston 53.

The squib 51 is fitted into a space at an upper part of the holder 521 of the case 52. An inner surface of the upper part of the holder 521 has a shape in substantially close contact with the outer surface of the squib 51 (the outer side surface of the body 511, the outer surface of the flange part of the metal sleeve 512, the outer side surface of the hollow circular cylindrical part of the metal sleeve 512). The opening on the upper side of the holder 521 (the inner space thereof) is closed by the squib 51.

The base 533 of the piston 53 is fitted into a space of a lower part of the holder 521 of the case 52. An inner surface of the lower part of the holder 521 has a shape in substantially close contact with the outer side surface of the first columnar section of the base 533. An opening on a lower side of the holder 521 (the inner space thereof) is closed by the piston 53 (the base 533 thereof).

By attaching the squib 51 and the piston 53 to the case 52, a closed airtight space is formed between the lower surface of the squib 51 (the metal sleeve 512 thereof), the upper surface of the piston 53 (the base 533 thereof) and the inner surface of the case 52 (the holder 521 thereof). The gas generated by the squib 51 is introduced into the airtight space through the broken portion of the lower wall of the metal sleeve 512. That is, the airtight space functions as the pressurized chamber 520 that receives the pressure of the gas generated by the squib 51.

The sleeve 522 of the case 52 is made of metal, for example, steel. The sleeve 522 is formed in a substantially cylindrical shape having open upper and lower surfaces. The sleeve 522 includes a first cylindrical portion, a second cylindrical portion and a third cylindrical portion which have a hollow circular cylindrical shape and are arranged in this order from above. The first cylindrical portion, the second cylindrical portion and the third cylindrical portion are connected in the upward/downward direction with these axes aligned (concentrically). The inner surface of the first cylindrical portion is formed in a tapered shape with a smaller diameter toward the lower side. The inner side surface of the second cylindrical portion is formed in a hollow circular cylindrical shape having a constant diameter. The inner diameter of the second cylindrical portion is substantially equal to the outer diameter of the first columnar section (the largest diameter portion) of the base 533 of the piston 53. The inner side surface of the third cylindrical portion is formed in a tapered shape with a smaller diameter toward the lower side. The diameter of the inner side surface of the third cylindrical portion is substantially equal to the outer diameter of the first columnar section of the base 533 (the largest diameter portion in the base 533) at its upper end and becomes smaller toward the lower end. In other words, the third cylindrical portion of the sleeve 522 has a shape not allowing the base 533 of the piston 53 to pass therethrough.

The cap 523 of the case 52 is made of metal, for example, steel. The cap 523 has a hollow circular cylindrical shape with both upper and lower surfaces open. A projecting portion (flange) projecting inward is formed at the lower surface of the cap 523. An inner diameter of the projecting portion (flange) is approximately equal to the outer diameter of the cylinder 534 of the piston 53. The piston 53 is an operating pin which moves in one direction in response to reception of the pressure of the gas generated by the squib 51.

In the present embodiment, the outer diameters of the holder 521, the sleeve 522, and the cap 523 are equal to each other.

The first holding spring 524 includes a clamping portion having a hollow disk shape and a holding portion having a hollow frustoconical shape protruding obliquely upward from an inner side surface of the clamping portion. The clamping portion of the first holding spring 524 is sandwiched between the holder 521 and the sleeve 522 of the case 52. Thereby, the first holding spring 524 is sandwiched between the holder 521 and the sleeve 522. The first holding spring 524 seals a gap at a boundary between the holder 521 and the sleeve 522. The holding portion is in contact with the holding groove 5330 of the base 533 of the piston 53 and applies an upward force to the base 533 to hold the base 533 (prevent downward movement of the base 533).

The second holding spring 525 includes a clamping portion having a hollow disk shape and a holding portion having a hollow frustoconical shape protruding obliquely downward from an inner side surface of the clamping portion. The clamping portion of the second holding spring 525 is sandwiched between the sleeve 522 and the cap 523 of the case 52. Thereby, the second holding spring 524 is sandwiched between the sleeve 522 and the cap 523. The second holding spring 525 seals a gap at a boundary between the sleeve 522 and the cap 523. A protruding tip of the holding portion is away from the outer side surface of the cylinder 534 of the piston 53. A diameter of the protruding tip of the holding portion is approximately equal to the outer diameter of the second columnar section of the base 533 of the piston 53.

As shown in FIG. 4, in a state where the squib 51 and the piston 53 is attached to the case 52, the pin electrode 514 of the squib 51 protrudes from the upper surface of the case 52. Further, the small diameter portion of the pin 535 protrudes downward from the lower surface of the case 52.

As shown in FIG. 1, the pyroactuator 5 is attached to the housing 7 so that the case 52 closes the through hole 731 of the cover member 73. In this state, the second end of the piston 53 (the lower end of the pin 535) faces the center of the movable contactor 3 (the center in the length direction and the width direction).

(1.2.3) Operation

Next, the operation of the circuit interrupter 100 having the above-described configuration will be described with reference to FIGS. 1, 6, 7.

As to the circuit interrupter 100, the first electrode 12 is connected to the first end of the electric circuitry (e.g., the circuitry constituting the power supply system 200) and the second electrode 22 is connected to the second end of the electric circuitry. Here, the first end of the electric circuitry is given a higher potential than the second end.

In a normal state of the electric circuitry, the movable contactor 3 is held by the spring force of the pressure spring 41 and the like so that the first movable contact 31 is connected to the first fixed contact 11 and the second movable contact 32 is connected to the second fixed contact 21 (see FIG. 1). At this time, a current flows from the first electrode 12 to the second electrode 22 by passing through the first fixed contact 11, the first movable contact 31, the movable contactor 3, the second movable contact 32, and the second fixed contact 21 in this order.

At this time, the contact between the first movable contact 31 and the first fixed contact 11 and the contact between the second movable contact 32 and the second fixed contact 21 are maintained by the spring force of the contact pressure spring 41, the attraction force between the first yoke 61 and the second yoke 62, and the like. Incidentally, even if an overcurrent or the like flows in the circuit interrupter 100, contact between the contacts is maintained due to the attraction force between the first yoke 61 and the second yoke 62 and the like as long as the magnitude of the overcurrent is relatively small.

In an abnormal state of the electric circuitry, the control circuitry 207 detects occurrence of abnormality in the electric circuitry. Upon detecting the occurrence of the abnormality, the control circuitry 207 operates (activates) the circuit interrupter 100 to break the electric circuitry.

Specifically, the control circuitry 207 allows a current to flow between the pair of pin electrodes 514 to energize the heating element 515. When energized, the heating element 515 generates heat and increases the temperature of the combustion part 513. When the temperature of the combustion part 513 exceeds the ignition temperature of the explosive, the explosive is combusted to generate a large amount of gas and the low strength portion of the lower wall of the metal sleeve 512 is broken by the pressure of the gas and the gas is discharged to the pressurized chamber 520 through the broken portion. Since the combustion part 513 explosively combusts to generate a large amount of gas, the pressure in the pressurized chamber 520 rapidly increases in a short time.

The piston 53 receives the pressure in the pressurized chamber 520 with the first end 531 (the upper surface of the base 533) and then is pressed downward to press the movable contactor 3 downward with the second end 532 (the pin 535). The piston 53 applies a force to part of the movable contactor 3 between the first movable contact 31 and the second movable contact 32 to move the movable contactor 3 downward.

Specifically, in the piston 53, the bottom surface (upper surface) of the base 533 receives the pressure in the pressurized chamber 520 and the base 533 starts to move downward together with the cylinder 534 against the spring force of the first holding spring 524. An initial speed of the base 533 (the piston 53) at this time becomes very large because of the large pressure in the pressurized chamber 520. The pin 535 receives a downward force from the cylinder 534 via the spring 536 and starts to move downward slightly later from the start of downward movement of the cylinder 534. The pin 535, the second yoke 62, the first yoke 61 and the movable contactor 3 is provided as an integral part. Due to downward movement of the pin 535, the movable contactor 3 is pressed downward and then moves downward. Here, after start of downward movement of the base 533, an elastic force stored in the spring 536 acts on the pin 535 and therefore a very large downward force is applied on the pin 535 and thus the initial speed also increases.

A force pressing the movable contactor 3 downward exceeds a force supporting the movable contactor 3 upward (the spring force of the contact pressure spring 41, the attraction force between the first yoke 61 and the second yoke 62, and the like), the movable contactor 3 moves downward while compressing the contact pressure spring 41 through the first yoke 61. Thus, the first movable contact 31 is separated from the first fixed contact 11 and the second movable contact 32 is separated from the second fixed contact 21 (see FIG. 6). As a result, the electric path between the first fixed terminal 1 and the second fixed terminal 2 is interrupted and the current flowing through the electric path between the first fixed terminal 1 and the second fixed terminal 2 is interrupted.

The piston 53, the first yoke 61, the movable contactor 3, and the second yoke 62 is integrally moved downward (hereinafter, for convenience of explanation, a set of the piston 53, the first yoke 61, the movable contactor 3, and the second yoke 62 is referred to as a movable body). A direction in which the piston 53 moves and a direction in which the movable contactor 3 moves by the piston 53 are the same direction. Typically, the movable body moves to a position where the contact pressure spring 41 is most compressed (see FIG. 7). At this time, the base 533 of the piston 53 moves inside the third cylindrical portion while pressing and expanding (modifying) the inner surface of the third cylindrical portion of the sleeve 522 of the case 52. Incidentally, kinetic energy of the movable body is converted into elastic energy of the contact pressure spring 41, thermal energy generated when the movable body strikes the bottom surface of the inner hollow cylinder 71, and the like.

The movable body receives an upward force from the compressed contact pressure spring 41 at a position where the contact pressure spring 41 is compressed. However, the upward movement of the movable body is blocked by a frictional force between the base 533 and the third cylindrical portion of the sleeve 522 of the case 52 and the pressure of the gas filling the case 52 (the pressurized chamber 520). As a result, the movable body stops at a position shown in FIG. 7. In other words, the third cylindrical portion functions as a detent mechanism that mechanically holds the piston 53 after movement of the movable contactor 3 to prevent the piston 53 from returning to its original position. In the present embodiment, the detent mechanism is not necessarily required. If the pressure of the gas filling the case 52 is large enough to prevent upward movement of the movable body against the spring force of the contact pressure spring 41 (at a position where the movable contacts 31, 32 are separated from the fixed contacts 11, 21), the detent mechanism can be omitted. In this case, the inner side surface of the third cylindrical portion may have, for example, a hollow circular cylindrical surface shape with a constant diameter similarly to the second cylindrical portion.

Here, when the first movable contact 31 is pulled away from the first fixed contact 11 while a current flows in the movable contactor 3, there is a possibility that an arc is generated between the first movable contact 31 and the first fixed contact 11. Similarly, when the second movable contact 32 is pulled away from the second fixed contact 21 while a current flows in the movable contactor 3, there is a possibility that an arc is generated between the second movable contact 32 and the second fixed contact 21.

In contrast, the circuit interrupter 100 of the present embodiment rapidly pulls the movable contacts 31, 32 away from the fixed contacts 11, 21 using energy of the gas generated by the pyroactuator 5, thereby rapidly stretching and extinguishing an arc.

A force (pressure) applied to the piston 53 from the gas generated by the squib 51 is very large. Therefore, the movable contactor 3 is pushed by the piston 53 and thus is pulled away from the first fixed terminal 1 and the second fixed terminal 2 at a high speed. An arc generated between the contacts is rapidly stretched and extinguished.

In particular, in the present embodiment, since the movable contactor 3 and the fixed terminal (first fixed terminal) 1 are separate parts, energy necessary for just interrupting the circuit is small compared with the breaker of Patent Literature 1 which cuts off the circuit by breaking a conductor. In other words, most of energy generated in the squib 51 can be used for movement of the movable contactor 3 (kinetic energy of the movable contactor 3). Thus, in the circuit interrupter 100, the moving speed of the movable contactor 3 is increased and therefore the arc stretching performance and arc extinction performance can be improved.

Further, in the breaker described in Patent Literature 1, the circuit is interrupted by breaking the conductor and bending the end of the broken portion by use of energy generated by the pyrotechnic actuator. Therefore, in this breaker, there is a possibility that the portions of the broken conductor are not sufficiently separated from each other. As to the broken circuit, a gap between a high voltage side circuit and a low voltage side circuit electric path is not large enough and thus improvement of the current interruption performance is limited.

In the present embodiment, in the accommodation 70, the movable contactor 3 is moved in a direction away from the fixed terminal (first fixed terminal) 1 and the movable contact (first movable contact) 31 is separated from the fixed contact (first fixed contact) 11. Therefore, as compared with the breaker of Patent Literature 1 which interrupts the circuit by breaking and bending the conductor, it is possible to increase a distance between the contacts after the circuit interruption. Thus, the circuit interrupter 100 can increase a length of stretch of the arc and therefore the arc extinction performance is improved.

Further, the movable contactor 3 moves in the accommodation 70. Therefore, arcs developed between the first movable contact 31 and the first fixed contact 11 and between the second movable contact 32 and the second fixed contact 21 are confined in the accommodation 70. Therefore, the arc is less likely to leak to the outside of the circuit 100. That is, the accommodation 70 functions as an arc extinction chamber for confining therein arcs developed between the first movable contact 31 and the first fixed contact 11 and between the second movable contact 32 and the second fixed contact 21 to extinguish such arcs.

In one example, moving time of the movable contactor 3 (time necessary for the movable contactor 3 to move from a position shown in FIG. 1 to a position shown in FIG. 7) is within 1 ms. A moving distance of the movable contactor 3 in the accommodation 70 (a distance between the position shown in FIG. 1 and the position shown in FIG. 7) is about 20 to 30 mm. However, the properties of the circuit interrupter 100 are not limited to these numerical values and they can be appropriately designed, as necessary.

(2) Variations

The above described embodiment is merely one of various embodiments of the present disclosure. Further, as long as the object of the present disclosure can be achieved, the above embodiment can be modified in various ways depending on design and the like. Several variations of the above embodiment are listed below. The above-described embodiment and the following variations can be appropriately combined.

(2.1) Variation 1

Figure 8:
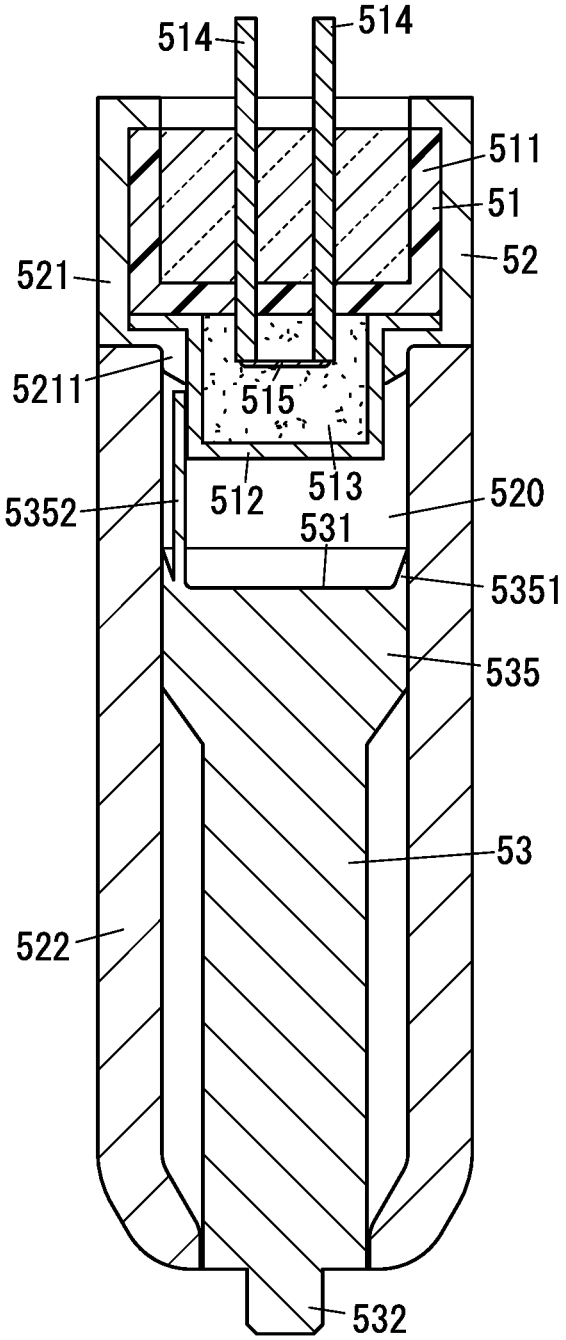
FIG. 8 is a cross-sectional view of a pyroactuator included in a circuit interrupter of variation 1.

The structure of the pin-pusher type pyroactuator 5 is not limited to the structure shown in FIG. 4. FIG. 8 shows a cross-sectional view of a pyroactuator 5 of a circuit interrupter 100 of variation 1 (a pyroactuator 5 having a structure different from that of the embodiment).

The pyroactuator 5 of the variation is mainly different from the pyroactuator 5 of the circuit interrupter 100 of the embodiment in the structures of the case 52 and the piston 53. The configurations common to the circuit interrupter 100 (the pyroactuator 5) of the present variation and the embodiment are designated by the same reference signs and explanations thereof are omitted appropriately.

As shown in FIG. 8, the case 52 includes the holder 521 and the sleeve 522. The case 52 is formed in a substantially hollow circular cylindrical shape as a whole.

The holder 521 of the case 52 is made of metal, for example, aluminum or an aluminum alloy. The holder 521 has a substantially hollow circular cylindrical shape with open upper and lower surfaces. The squib 51 is fitted into the inside space of the holder 521. An inner surface of the holder 521 has a shape in substantially close contact with the outer surface of the squib 51 (the outer side surface of the body 511, the outer surface of the flange part of the metal sleeve 512, the outer side surface of the upper part of the hollow circular cylindrical part of the metal sleeve 512). The holder 521 holds the squib 51 to allow a lower part of the metal sleeve 512 to protrude from a lower opening of the holder 521. The holder 521 includes at its lower end a restriction part 5211 having a hollow cylindrical shape. The restriction part 5211 extends along the outer side surface of the upper part of the hollow circular cylindrical part of the metal sleeve 512.

The sleeve 522 of the case 52 is made of metal, for example, steel. The sleeve 522 is formed in a substantially cylindrical shape having open upper and lower surfaces. The sleeve 522 of the present variation includes a first cylindrical portion, a second cylindrical portion and a third cylindrical portion which have a hollow circular cylindrical shape and are arranged in this order from above. The first cylindrical portion, the second cylindrical portion and the third cylindrical portion are connected in the upward/downward direction with these axes aligned (concentrically).

The inner side surface of the first cylindrical portion is formed in a hollow circular cylindrical shape having a constant diameter. The inner diameter of the first cylindrical portion is substantially equal to the outer diameter of the restriction part 5211 of the holder 521. Further, the inner diameter of the first cylindrical portion is substantially equal to the outer diameter of the large diameter portion of the pin 535 of the piston 53 (described later). The second cylindrical portion is formed in a hollow tapered cylindrical shape with a smaller diameter toward the lower side. The inner side surface of the third cylindrical portion is formed in a hollow circular cylindrical shape having a constant diameter. The inner diameter of the third cylindrical portion is slightly larger than the outer diameter of the small diameter portion of the pin 535 of the piston 53 (described later). Further, the inner diameter of the third cylindrical portion is smaller than the outer diameter of the large diameter portion of the pin 535 of the piston 53. In other words, the third cylindrical portion of the sleeve 522 has a shape not allowing the pin 535 (the large diameter portion thereof) of the piston 53 to pass therethrough.

The sleeve 522 is coupled to the holder 521 by engaging an upper end of the large diameter portion with a periphery of the restriction part 5211 of the holder 521.

As shown in FIG. 8, in the present variation, the piston 53 includes the pin 535 only.

The pin 535 is made of an electrically insulating material such as, for example, resin, and is made of, for example, polycarbonate or polybutylene terephthalate. The pin 535 includes a large diameter portion, a middle diameter portion, a small diameter portion and a protruding portion which have a circular cylindrical shape and are arranged in this order from the above. The large diameter portion, the middle diameter portion, the small diameter portion and the protruding portion are placed with their axes aligned (concentrically). The outer diameter of the large diameter portion is larger than the outer diameter of the middle diameter portion. The outer diameter of the middle diameter portion is larger than the outer diameter of the small diameter portion. The outer shape of the small diameter portion is larger than the outer shape of the protruding portion. The large diameter portion and the medium diameter portion are connected by a first connecting portion which has a columnar shape and a diameter decreasing from the large diameter portion to the middle diameter portion. The middle diameter portion and the small diameter portion are connected by a second connecting portion which has a columnar shape and a diameter decreasing from the middle diameter portion to the small diameter portion. The protruding portion protrudes downward from the bottom surface (lower surface) of the small diameter portion. That is, the pin 535 has a columnar shape with a smaller diameter toward the lower side (toward a side away from the squib 51). In the present variation, the bottom surface (upper surface) of the large diameter portion of the pin 535 serves as the first end 531 of the piston 53. Further, part including the protruding portion of the pin 535 serves as the second end 532 of the piston 53.

An elastic rib 5351 is provided integrally with a periphery of the upper surface of the large diameter portion of the pin 535. The elastic rib 5351 has elasticity. The elastic rib 5351 is formed to have a tapered hollow cylindrical shape which has an inner diameter and an outer diameter gradually increasing toward its upper end and a thickness decreasing toward its upper end. A positioning stopper 5352 which protrudes upward is provided to part (in the example of FIG. 8, left end part) of an upper surface of the large diameter portion of the pin 535.

The pin 535 (the piston 53) is held in the sleeve 522. The pin 535 is placed inside the sleeve 522 such that the protruding portion protrudes from a lower opening of the sleeve 522. The pin 535 is held by the sleeve 522 by elastic contact between the outer side surface of the elastic rib 5351 and the inner surface of the first cylindrical portion of the sleeve 522. A gap between the outer side surface of the pin 535 and the inner surface of the sleeve 522 is closed tightly by the elastic rib 5351.

As shown in FIG. 8, by attaching the squib 51 and the piston 53 to the case 52, a closed airtight space (the pressurized chamber 520) is formed between the squib 51 (the outer side surface of the metal sleeve 512), the inner surface of the case 52, and the upper surface of the piston 53.

Incidentally, in a state where the squib 51 and the piston 53 are attached to the case 52, excess pressing of the piston 53 (the pin 535) into the case 52 can be suppressed. That is, even if the protruding portion of the pin 535 is pushed upward, the positioning stopper 5352 of the pin 535 comes into contact with the restriction part 5211 of the holder 521. Thereby, upward movement of the pin 535 is prevented. As a result, the pin 535 can be positioned within a predetermined area in the case 52.

In the present variation, when gas is generated in the squib 51, the piston 53 (the pin 535) receives pressure in the pressurized chamber 520 by the first end 531 and then is moved downward due to the increased pressure in the pressurized chamber 520, thereby pressing the movable contactor 3 by the second end 532. Thus, this causes downward movement of the movable contactor 3. Thereby, it is possible to separate the first movable contact 31 from the first fixed contact 11 and separate the second movable contact 32 from the second fixed contact 21.

Further, when pressed downward by the pressure in the pressurized chamber 520, the piston 53 moves downward with the middle diameter portion of the pin 535 pressing and expanding the third cylindrical portion of the sleeve 522 and stops at a position where the first connecting portion of the pin 535 is in contact with the second cylindrical portion of the sleeve 522. At this time, a frictional force acts between the middle diameter portion of the pin 535 and third cylindrical portion of the sleeve 522 and thus movement (upward and downward movement) of the pin 535 is prevented. In other words, the third cylindrical portion of the present variation functions as a detent mechanism that mechanically holds the piston 53 after movement of the movable contactor 3 to prevent the piston 53 from returning to its original position.

Needless to say, the pin pusher type pyroelectric actuator 5 is not limited to the structure of the above embodiment and variation 1 and may have another structure.

(2.2) Variation 2

The pyroactuator 5 may have a so-called pin puller structure which pulls the piston 53 (the pin 535) by gas generated in the squib 51.

Figure 9A:
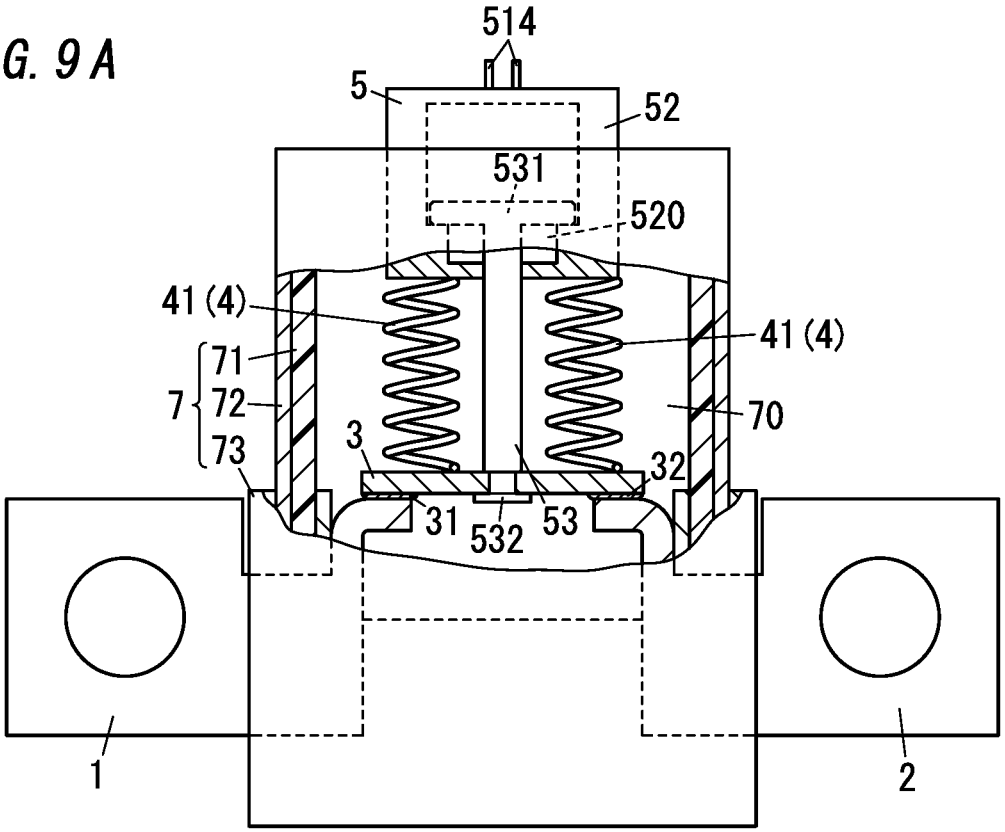
FIG. 9A is a partially cutaway side view of a circuit interrupter of variation 2 before operation.
Figure 9B:
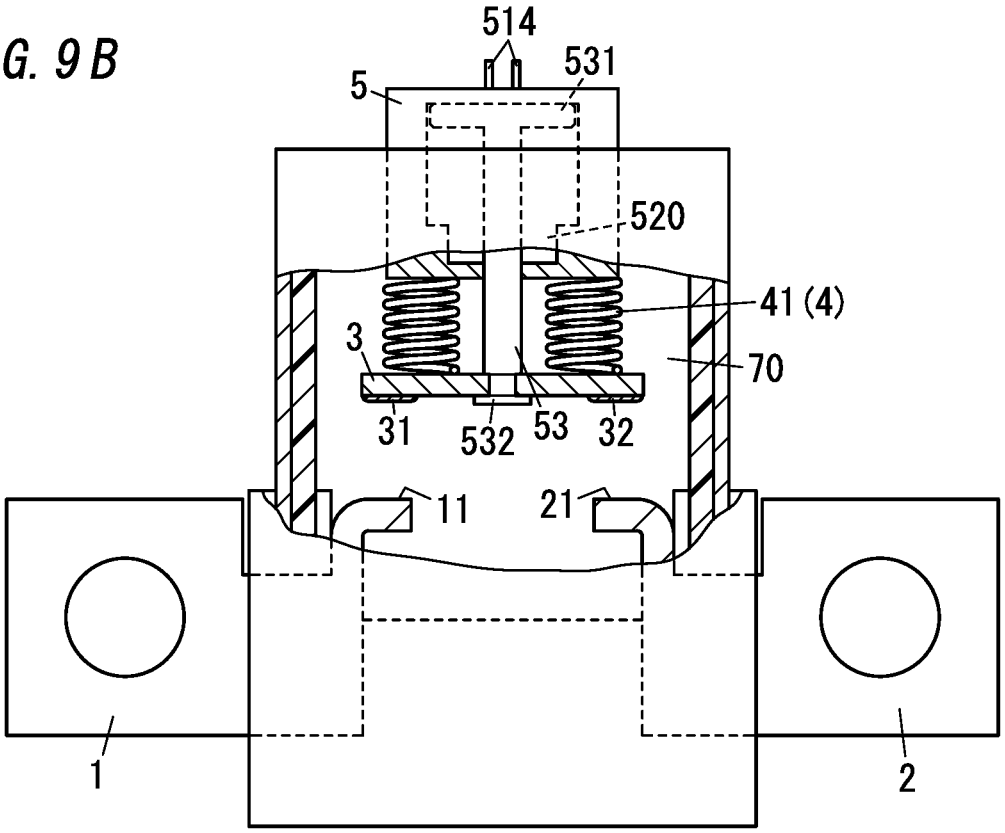
FIG. 9B is a partially cutaway side view of the circuit interrupter of variation 1 after operation.

FIGS. 9A, 9B show a circuit interrupter 100 according to variation 2 which includes the pyroactuator 5 having the pin puller structure. The configurations common to the circuit interrupter 100 of variation 2 and the embodiment are designated by the same reference signs and explanations thereof are omitted appropriately.

The circuit interrupter 100 of the present variation does not include the first yoke 61 and the second yoke 62. Then, the second end 532 of the piston 53 is coupled to the movable contactor 3. Further, the case 52 of the pyroactuator 5 is placed in the through hole formed in the inner hollow cylinder 71 and the outer hollow cylinder 72 and closes the through hole airtightly. The contact pressure spring 41 is placed between the case 52 of the pyroactuator 5 and the movable contactor 3 and biases the movable contactor 3 in a direction in which the movable contactor 3 moves toward the first fixed terminal 1 and the second fixed terminal 2 (the downward direction in FIG. 9A). The upper surface of the movable contactor 3 and the lower surface of the case 52 each include a recess (not shown) for receiving an end of the contact pressure spring 41 at a position corresponding to the contact pressure spring 41.

In the present variation, the piston 53 of the pyroactuator 5 is formed to have a shape with a T-shaped cross section including a columnar portion which has a circular cylindrical shape and extending in the upward/downward direction in FIG. 9A, and a flange portion extending laterally from an end (upper end in FIG. 9A) of the columnar portion. The case 52 includes the pressurized chamber 520 which faces a side surface of the columnar portion of the piston 53. A tip end of the columnar portion (the second end 532 of the piston 53) is coupled to the movable contactor 3.

When a current is made to flow between the pair of pin electrodes 514 and the squib 51 is ignited, gas is generated from the squib 51 to increase the pressure in the pressurized chamber 520 and then the piston 53 moves upward in FIG. 9A. The movable contactor 3 is pulled by the second end 532 of the piston 53 and therefore moves in a direction away from the first fixed terminal 1 and the second fixed terminal 2 (in the upward direction in FIG. 9A) together with the piston 53. Thus, the first movable contact 31 and the second movable contact 32 are separated from the first fixed contact 11 and the second fixed contact 21, respectively (see FIG. 9B). As a result, the circuit between the first fixed terminal 1 and the second fixed terminal 2 is interrupted and a current flowing through the circuit between the first fixed terminal 1 and the second fixed terminal 2 is interrupted.

(2.3) Variation 3 to Variation 5

The holding unit 4 is not limited to the contact pressure spring 41.

Figure 10:
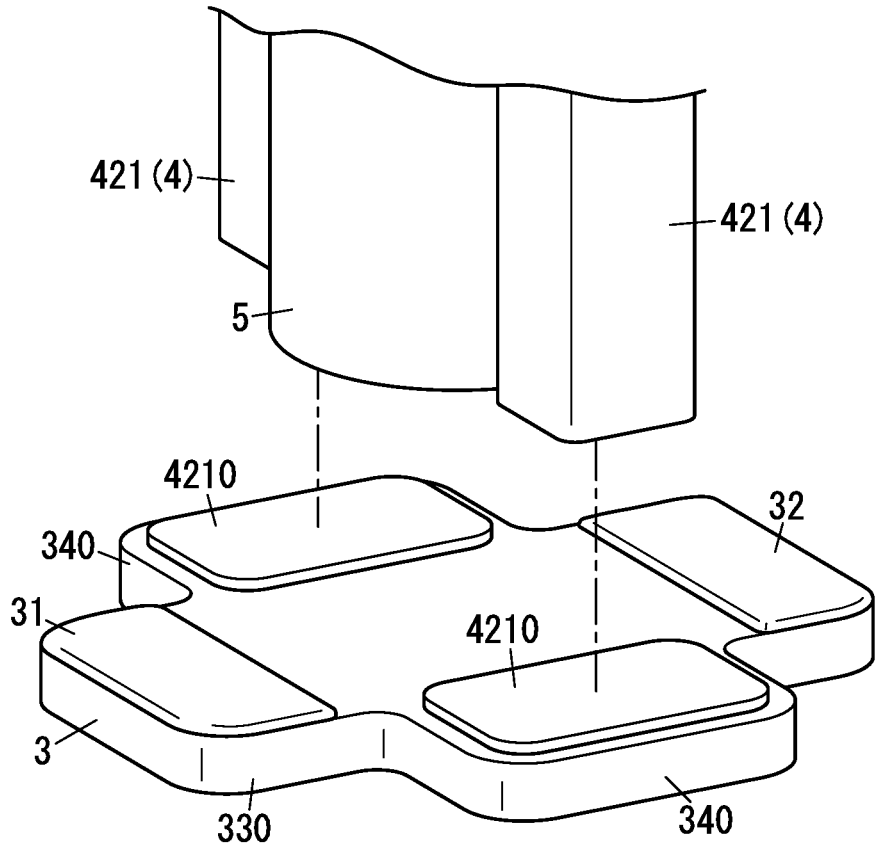
FIG. 10 is a cross-sectional view of primary part of a circuit interrupter of variation 3.
Figure 11:
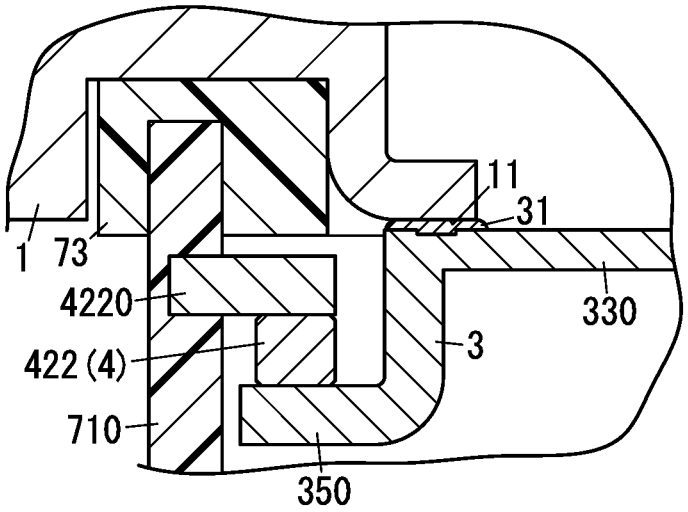
FIG. 11 is a cross-sectional view of primary part of a circuit interrupter of variation 4.

For example, like variation 3 shown in FIG. 10 and variation 4 shown in FIG. 11, the holding units 4 may include permanent magnets 421, 422, respectively.

In variation 3 shown in FIG. 10, the movable contactor 3 is formed to have a cross shape in a top view and includes a body part 330 and a pair of protrusion parts 340. The body part 330 has a length in the rightward/leftward direction and includes the first movable contact 31 and the second movable contact 32 at both ends in the length direction. The pair of protrusion parts 340 protrude in the forward/backward direction from a side surface of the body part 330. Each of the protruding parts 340 of the movable contactor 3 is provided with a plate-shaped magnetic member made of a magnetic material, in particular an iron piece 4210. The movable contactor 3 has its center facing the tip end of the pin 535 of the pyroactuator 5. Further, a pair of permanent magnets 421 are provided to the lower surface of the cover member 73 of the housing 7 to be in front and back of the pyroactuator 5 (positions facing the iron pieces 4210). Further, the circuit interrupter 100 of variation 3 does not include the first yoke 61 and the second yoke 62. It should be noted that other configurations of variation 3 are same as those of the circuit interrupter 100 of the embodiment, and therefore illustration and detailed explanations thereof are omitted.

In variation 3, the first movable contact 31 and the second movable contact 32 are connected to the first fixed contact 11 and the second fixed contact 21 respectively while the permanent magnets 421 are in direct contact with the iron pieces 4210. Accordingly, the movable contactor 3 is held by the holding unit 4 (the permanent magnets 421) so that the first movable contact 31 and the second movable contact 32 are connected to the first fixed contact 11 and the second fixed contact 21 respectively. Incidentally, the permanent magnets 421 may hold the movable contactor 3 so that the first movable contact 31 and the second movable contact 32 are connected to the first fixed contact 11 and the second fixed contact 21 respectively while gaps are formed between the permanent magnets 421 and the iron pieces 4210. Further, spacers may be provided between the permanent magnets 421 and the iron pieces 4210. Further, the permanent magnets 421 may be provided to the movable contactor 3 and the iron pieces 4210 may be provided to the housing 7. The number of permanent magnets 42 is not limited to two but may be one or three or more.

In variation 4 shown in FIG. 11, the movable contactor 3 includes a body part 330 and a pair of extension parts 350

(only one thereof is shown in FIG. 11). The body part 330 has a length in the rightward/leftward direction and includes the first movable contact 31 and the second movable contact 32 at both ends in the length direction. Each of pair of extension parts 350 has an L-shape in a side view. The pair of extension parts 350 extend downward from both ends in the rightward/leftward direction of the body part 330 to go away from the body part 330 and are formed to have symmetrical shapes. A permanent magnet 422 is provided to an upper surface of a protruding tip of the extension part 350. Further, the housing body 710 including the inner hollow cylinder 71 and the outer hollow cylinder 72 of the housing 7 is provided with a plate-shaped magnetic member which is made of a magnetic material and protrudes inwardly, in particular iron pieces 4220. The first movable contact 31 and the second movable contact 32 are connected to the first fixed contact 11 and the second fixed contact 21 respectively while the permanent magnets 422 are in direct contact with the iron pieces 4220. It should be noted that other configurations of variation 4 are same as those of the circuit interrupter 100 of the embodiment, and therefore illustration and detailed explanations thereof are omitted.

Also in variation 4, the movable contactor 3 is held by the permanent magnets 422 (holding unit 4) so that the first movable contact 31 and the second movable contact 32 are connected to the first fixed contact 11 and the second fixed contact 21 respectively.

Figure 12:
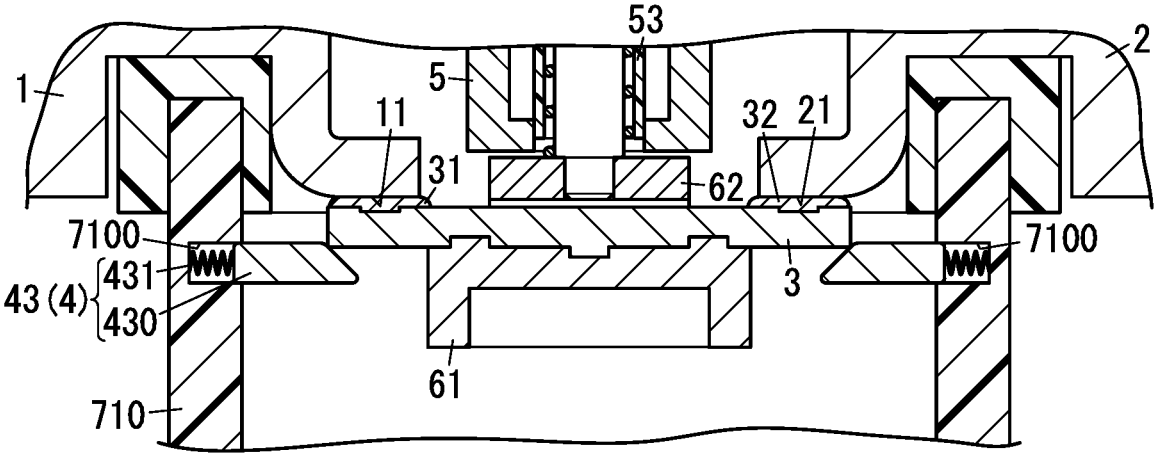
FIG. 12 is a cross-sectional view of primary part of a circuit interrupter of variation 5.

Like variation 5 shown in FIG. 12, the holding unit 4 may include a latch mechanism 43 that mechanically holds the movable contactor 3.

In variation 5 shown in FIG. 12, the latch mechanism 43 includes a pair of support members 430 having plate shapes and a pair of coil springs 431 which are elastic members. The housing body 710 includes at its side surface recesses 7100 with a shape allowing the support member 430 to be fitted thereinto. The coil spring 431 includes one end fixed to a bottom surface of the recess 7100 and another end where a bottom surface of a base portion of the support member 430 is fixed. The support member 430 has its tip end protrude from the recess 7100. An upper surface of the tip end of the support member 430 is an inclined surface. Bottom surfaces of both ends in the length direction (the rightward/leftward direction) of the movable contactor 3 are supported by the pair of support members 430 so that the first movable contact 31 and the second movable contact 32 are connected to the first fixed contact 11 and the second fixed contact 21 respectively.

When the movable contactor 3 is pressed downward by the piston 53 of the pyroactuator 5, the pair of support members 430 are pressed by the movable contactor 3. The support members 430 are pressed by the movable contactor 3 and pressed into the recesses 7100 while compressing the coil springs 431. As a result, the movable contactor 3 moves downward.

Also in variation 5, the movable contactor 3 is held by the holding unit 4 (the latch mechanism 43) so that the first movable contact 31 and the second movable contact 32 are connected to the first fixed contact 11 and the second fixed contact 21 respectively. Incidentally, the latch mechanism 43 may not include the coil springs 431 but the support members 430 may have shapes protruding from the side surface of the housing body 710. In this case, the strength of the support member 430 may be as strong as is bent by the movable contactor 3 pressed by the pyroactuator 5.

Incidentally, the holding unit 4 may have one or more of other holding structure other than the contact pressure spring 41, the permanent magnet 42, and the latch mechanism 43. Further, the holding unit 4 may have two or more of the contact pressure spring 41, the permanent magnet 42, the latch mechanism 43 and the other holding structures (e.g., a set of the contact pressure spring 41 and the permanent magnet 42).

The contact pressure spring 41 is a compression spring in the embodiment but may be a pull spring. The contact pressure spring 41 being a pull spring, for example, may be placed between the cover member 73 and the movable contactor 3 in the circuit interrupter 100 of the embodiment. The number of contact pressure springs 41 is not limited to one but may be two or more.

(2.4) Variation 6 to Variation 18

In the circuit interrupter 100, as described above, in the conduction state where a current flows through the movable contactor 3, the electromagnetic repulsive force separating the movable contact (first movable contact) 31 from the fixed contact (first fixed contact) 11 may occur. In the circuit interrupter 100, it is preferable that the movable contact (first movable contact) 31 and the fixed contact (first fixed contact) 11 are connected to each other stably except for the abnormal state of the electric circuitry (in a case where the pyroactuator 5 moves the movable contactor 3). Hereinafter, variations including configurations for stabilizing the connection state between the movable contact (first movable contact) 31 and the fixed contact (first fixed contact) 11 against the electromagnetic repulsion force are listed.

(2.4.1)

Figure 13:
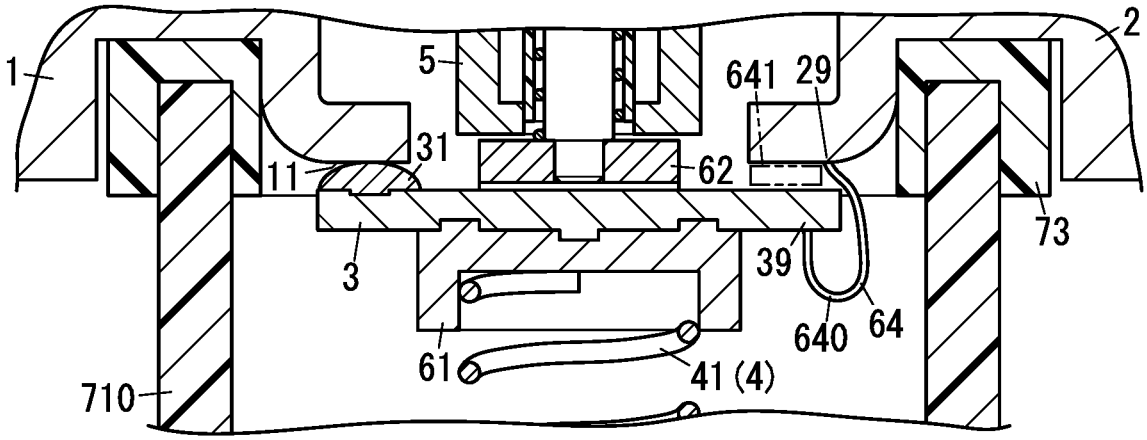
FIG. 13 is a cross-sectional view of primary part of a circuit interrupter of variation 6.

A circuit interrupter 100 of variation 6 shown in FIG. 13 includes only one set of the movable contact 31 and the fixed contact 11 in the circuit interconnecting the first electrode 12 and the second electrode 22. Specifically, in variation 6, the movable contactor 3 and the second fixed terminal 2 are not interconnected by a contact set including a set of a movable contact and a fixed contact but is interconnected by a braided wire 64 made by braiding copper wires. The braided wire 64 is a flexible conductive wire that can be bent and deformed. The second fixed terminal 2 includes a first fixed part 29 where a first end of the braided wire 64 is fixed. The movable contactor 3 includes a second fixed part 39 where a second end of the braided wire 64 is fixed. That is, the movable contactor 3 includes a contact device which is configured to come into contact with or is separated from the fixed contact 11 of the first fixed terminal 1 and is connected to the second fixed terminal 2 via the flexible wire. The braided wire 64 is longer than a linear distance interconnecting the first fixed part 29 and the second fixed part 39 and includes a curved part 640 between the first and second ends of the braided wire 64. The braided wire 64 extends from the first fixed part 29 to be below the movable contactor 3 and the curved part 640 is positioned below the movable contactor 3. However the curved part 640 may be placed above the movable contactor 3. The curved part 640 is changed in shape in accordance with the relative movement between the movable contactor 3 and the second fixed terminal 2. The circuit interrupter 100 includes an elastic part (the contact pressure spring 41) for biasing the movable contactor 3 in a direction in which the movable contact (first movable contact) 31 is connected to the fixed contact (first fixed contact) 11. The piston 53 applies a force to part of the movable contactor 3 between the first movable contact 31 and the second fixed part 39 to move the movable contactor 3 downward. When the movable contactor 3 moves downward, the first movable contact 31 is separated from the first fixed contact 11 and the second fixed part 39 of the movable contactor 3 is separated from the first fixed part 29 of the second fixed terminal. The elastic part biases the movable contactor 3 between the first movable contact 31 and the second fixed part 39. Incidentally, the length of the braided wire 64 (the length between the first end and the second end thereof) may be longer than, shorter than, or same as the moving distance of the movable contactor 3 in the accommodation 70. In the case where the length of the braided wire 64 is shorter than the moving distance of the moving contact 3, the braided wire 64 is broken by being pulled by the movable contactor 3 when the movable contactor 3 is pressed by the piston 53 and is moved. Thus, two insulation space gaps are formed. One insulation space gap is formed between the movable contactor 3 and the first fixed terminal 1, and the other insulation space gap is formed between the movable contactor 3 and the second fixed terminal 2. Formation of such two insulation space gaps can improve the interruption performance. Other configurations of variation 6 are same as those of the circuit interrupter 100 of the embodiment, and therefore detailed explanations thereof are omitted.

As in the embodiment, if the number of contact sets each of which is a set of a movable contact and a fixed contact is two before gas generation of the squib 51 of the circuit interrupter 100, there are two places where the connection may become unstable due to the electromagnetic repulsive force. In contrast, if the number of contact sets is one as in variation 6, there is one place where the connection may become unstable due to the electromagnetic repulsive force. Thus, it is possible to stabilize the connection state between the movable contact and the fixed contact (conduction state between the first electrode 12 and the second electrode 22).

Incidentally, as shown by a two-dot chain line in FIG. 13, a spacer 641 may be provided between the movable contactor 3 and the second fixed terminal 2. The spacer 641 is made of a material having electrically insulating properties such as a resin material and suppresses contact between the movable contactor 3 and the second fixed terminal 2.

(2.4.2)

The circuit interrupter 100 may include a yoke having a different shape from the embodiment, and the number of yokes may be different from that of the embodiment.

Figure 14:
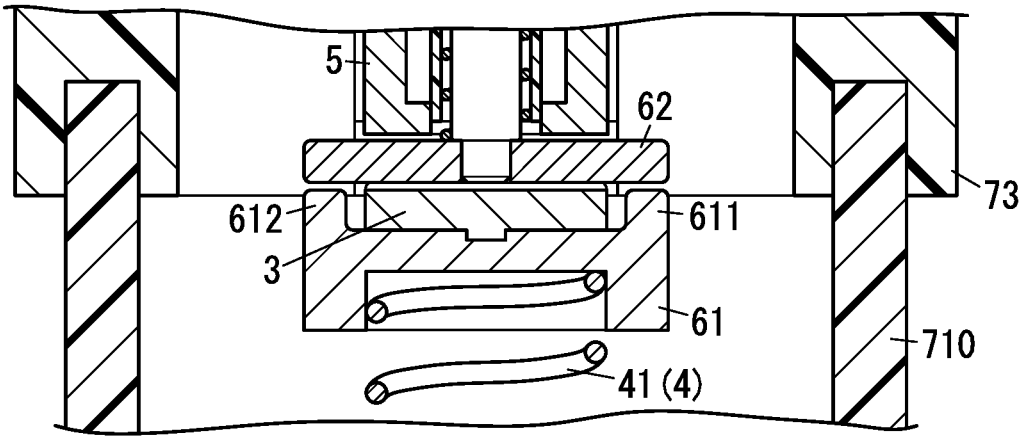
FIG. 14 is a cross-sectional view of primary part of a circuit interrupter of variation 7.

In the circuit interrupter 100 of variation 7 shown in FIG. 14, the second yoke 62 includes no protrusion part and thus is formed into a rectangular plate shape. On the other hand, the first yoke 61 includes a pair of protrusion parts 611, 612 protruding upward (toward the second yoke 62). Specifically, the protrusion parts 611, 612 are formed at both ends in the forward/backward direction (the rightward/leftward direction in FIG. 14) of the upper surface of the first yoke 61 and face the side surface in the forward/backward direction of the movable contactor 3. Other configurations of variation 7 are same as those of the circuit interrupter 100 of the embodiment, and therefore illustration and detailed explanations thereof are omitted.

Even in the configuration of variation 7, similarly to the embodiment, the first yoke 61 and the second yoke 62 produce a force (upward force) for maintaining connection of the first movable contact 31 and the second movable contact 32 to the first fixed contact 11 and the second fixed contact 21. Thus, the connection state between the first movable contact 31 and the first fixed contact 11 and the connection state between the second movable contact 32 and the second fixed contact 21 can be stabilized.

Figure 15A:
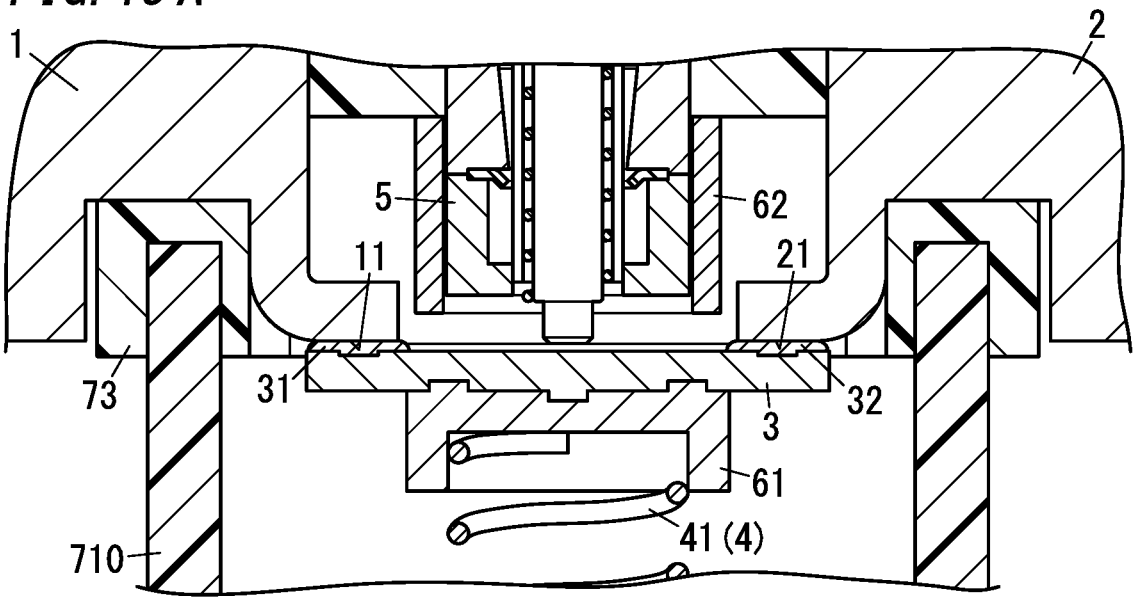
FIG. 15A is a cross-sectional view of primary part of a circuit interrupter of variation 8.
Figure 15B:
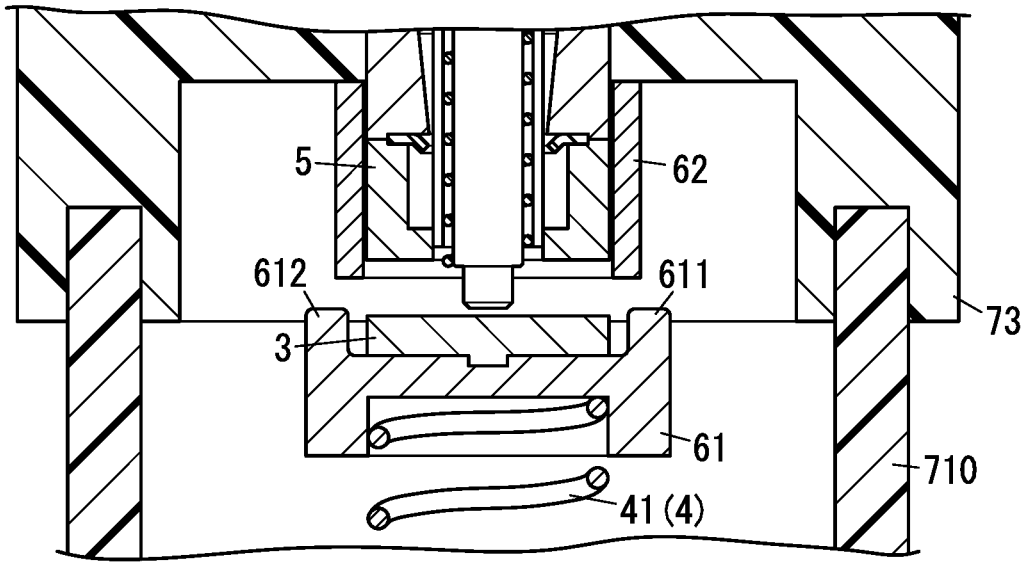
FIG. 15B is a cross-sectional view in a direction perpendicular to the sheet of FIG. 15A, of the primary part of the circuit interrupter of variation 8.

The circuit interrupter 100 of variation 8 shown in FIGS. 15A, 15B is different from the circuit interrupter 100 of variation 7 in that the second yoke 62 is fixed to the housing 7.

Specifically, the second yoke 62 in variation 8 has a hollow circular cylindrical shape having an axis in the upward/downward direction and is fixed to the cover member 73 to surround part of the pyroactuator 5 which protrudes from the cover member 73. Parts in the forward/backward direction of the lower surface of the second yoke 62 face the pair of protrusion parts 611, 612 of the first yoke 61 (see FIG. 15B). Other configurations of variation 8 are same as those of the circuit interrupter 100 of variation 7, and therefore illustration and detailed explanations thereof are omitted.

Even in the configuration of variation 8, similarly to variation 7, the first yoke 61 and the second yoke 62 produce a force for maintaining connection of the first movable contact 31 and the second movable contact 32 to the first fixed contact 11 and the second fixed contact 21. Thus, it is possible to stabilize the connection state between the movable contact 31 and the fixed contact 11. In variation 8, the second yoke 62 may be fixed to the case 52 of the pyroactuator 5.

Figure 16:
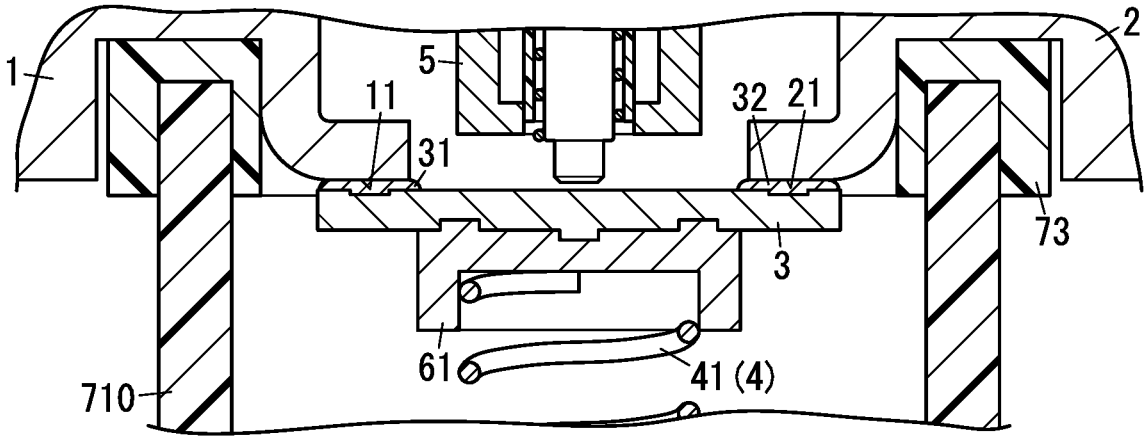
FIG. 16 is a cross-sectional view of primary part of a circuit interrupter of variation 9.

Incidentally, as in variation 9 shown in FIG. 16, the circuit interrupter 100 may not include the second yoke 62 but include only the first yoke 61. Further, as long as the holding unit 4 or the like can achieve stable connection between the movable contactor 31 and the fixed contact 11 against the electromagnetic repulsion force, the circuit interrupter 100 may not include the first yoke 61 and the second yoke 62 both.

(2.4.3)

In the circuit interrupter 100, stabilization of the connection state between the movable contact 31 and the fixed contact 11 can be achieved by appropriately designing a flow route of a current before or after it flows through the movable contactor 3. The circuit interrupters 100 of variations 10, 11 having this structure will be described.

Figure 17A:
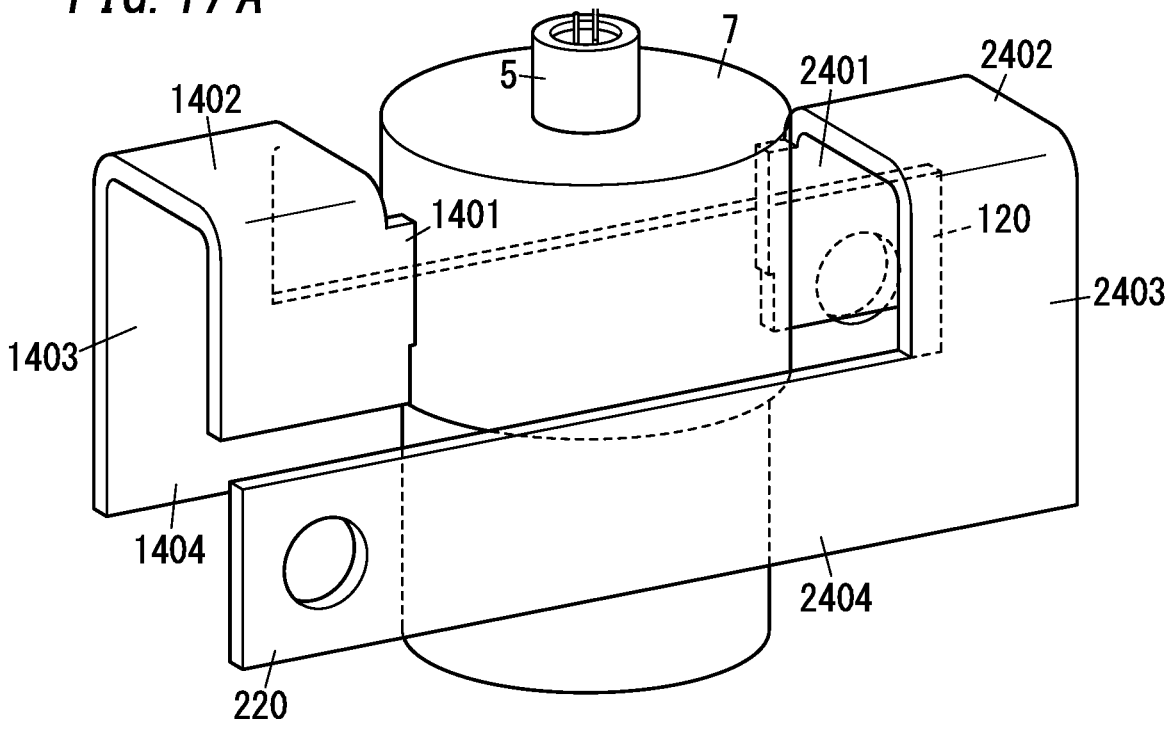
FIG. 17A is a perspective view of a circuit interrupter of variation 10.
Figure 17B:
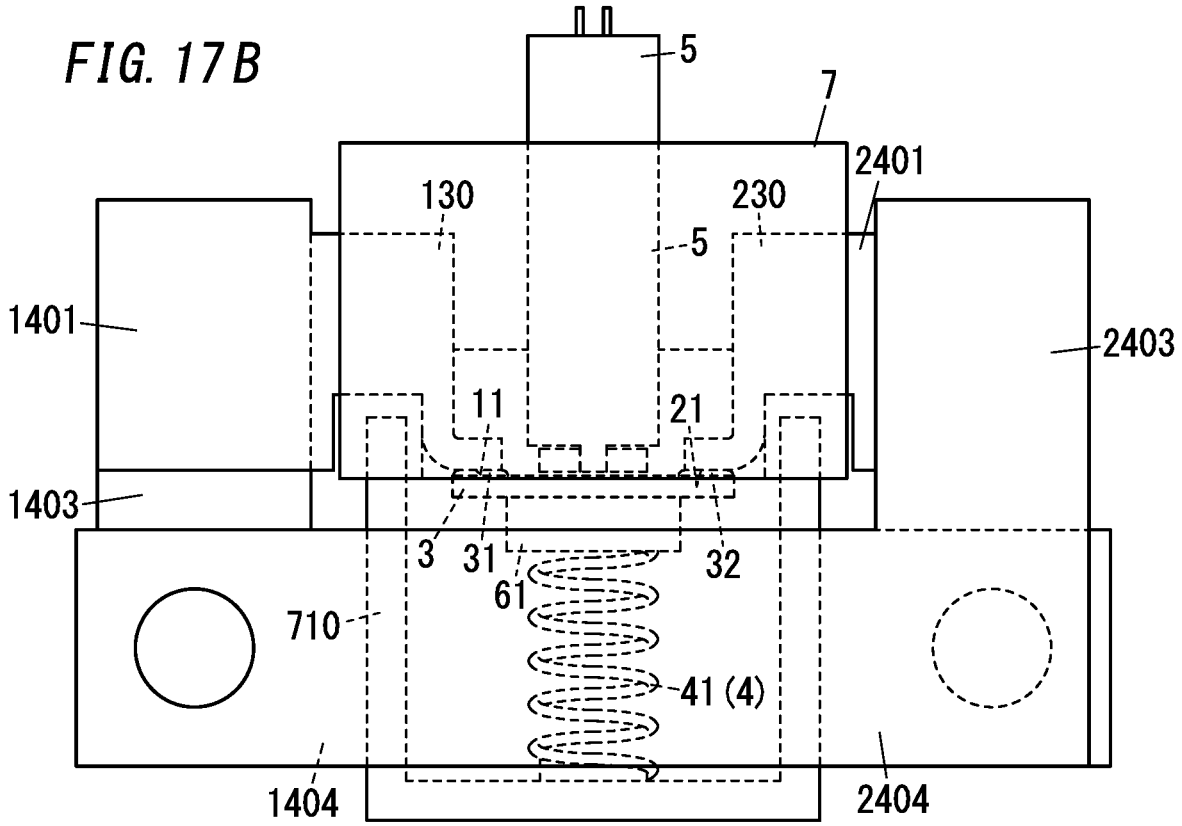
FIG. 17B is a front view of the circuit interrupter of variation 10.

As shown in FIGS. 17A, 17B, in the circuit interrupter 100 of variation 10, the circuit piece 140 of the first fixed terminal 1 includes a first circuit piece 1401, a second circuit piece 1402, a third circuit piece 1403, and a fourth circuit piece 1404. Further, the circuit piece 240 of the second fixed terminal 2 includes a first circuit piece 2401, a second circuit piece 2402, a third circuit piece 2403 and a fourth circuit piece 2404.

As shown in FIG. 17A, the first circuit piece 1401 of the first fixed terminal 1 has a plate shape which has a thickness in the forward/backward direction and extends leftward from the left surface of the interconnection piece 130. The second circuit piece 1402 is connected to the first circuit piece 1401, has a thickness in the upward/downward direction, and is placed on the left of the housing 7 to extend backward from a left end of the first circuit piece 1401. The third circuit piece 1403 is connected to the second circuit piece 1402, has a thickness in the forward/backward direction, and is placed in back of the housing 7 to extend downward from a back end of the second circuit piece 1402. The fourth circuit piece 1404 is connected to the third circuit piece 1403, has a thickness in the forward/backward direction, and is placed in back of the housing 7 to extend rightward from a lower end of the third circuit piece 1403. That is, the fourth circuit piece 1404 is electrically connected to the fixed contact (first fixed contact) 11 and extends along a direction of a current flowing through the movable contactor 3 (the rightward/leftward direction). The thickness direction of the fourth circuit piece 1404 (the forward/backward direction) is perpendicular to a direction in which the movable contact 31 and the fixed contact 11 faces each other (the upward/downward direction).

The first circuit piece 2401 of the second fixed terminal 2 has a plate shape which has a thickness in the forward/backward direction and extends rightward from the right surface of the interconnection piece 230. The second circuit piece 2402 is connected to the first circuit piece 2401, has a thickness in the upward/downward direction, and is placed on the right of the housing 7 to extend forward from a right end of the first circuit piece 2401. The third circuit piece 2403 is connected to the second circuit piece 2402, has a thickness in the forward/backward direction, and is placed in front of the housing 7 to extend downward from a front end of the second circuit piece 2402. The fourth circuit piece 2404 is connected to the third circuit piece 2403, has a thickness in the forward/backward direction, and is placed in front of the housing 7 to extend leftward from a lower end of the third circuit piece 2403. That is, the fourth circuit piece 2404 is electrically connected to the fixed contact (first fixed contact) 11 and extends along a direction of a current flowing through the movable contactor 3 (the rightward/leftward direction). The thickness direction of the fourth circuit piece 2404 (the forward/backward direction) is perpendicular to a direction in which the movable contact 31 and the fixed contact 11 face each other (the upward/downward direction).

As shown in FIG. 17B, the movable contactor 3 is positioned between the fixed contact (first fixed contact) 11 and the fourth circuit piece 1404 when viewed in the forward/backward direction. Further, the movable contactor 3 is positioned between the fixed contact (first fixed contact) 11 and the fourth circuit piece 2404 when viewed in the forward/backward direction. The fourth circuit piece 1404 of the first fixed terminal 1 and the fourth circuit piece 2404 of the second fixed terminal 2 face each other in the forward/backward direction.

That is, in the circuit interrupter 100 of variation 10, the movable contactor 3 is located between the fourth circuit piece 1404 and the first fixed contact 11 in a direction in which the first movable contact 31 and the first fixed contact 11 face each other. A direction of a current flowing through the fourth circuit piece 1404 is opposite to a direction of a current flowing through the movable contactor 3. Further, the movable contactor 3 is located between the fourth circuit piece 2404 and the first fixed contact 11 in a direction in which the first movable contact 31 and the first fixed contact 11 face each other. A direction of a current flowing through the fourth circuit piece 2404 is opposite to a direction of a current flowing through the movable contactor 3.

Therefore, repulsive forces are developed between the movable contactor 3 and the fourth circuit piece 1404 and between the movable contactor 3 and the fourth circuit piece 2404. The repulsive forces are forces which a current flowing through the movable contactor 3 and the fourth circuit pieces 1404, 2404 receives due to the Lorentz force. The fourth circuit pieces 1404, 2404 are fixed to the housing 7. Therefore, the movable contactor 3 receives forces in the directions away from the fourth circuit pieces 1404, 2404 (upward forces in FIG. 17B). Thus, it is possible to stabilize the connection state between the movable contact 31 and the fixed contact 11.

Figure 18:
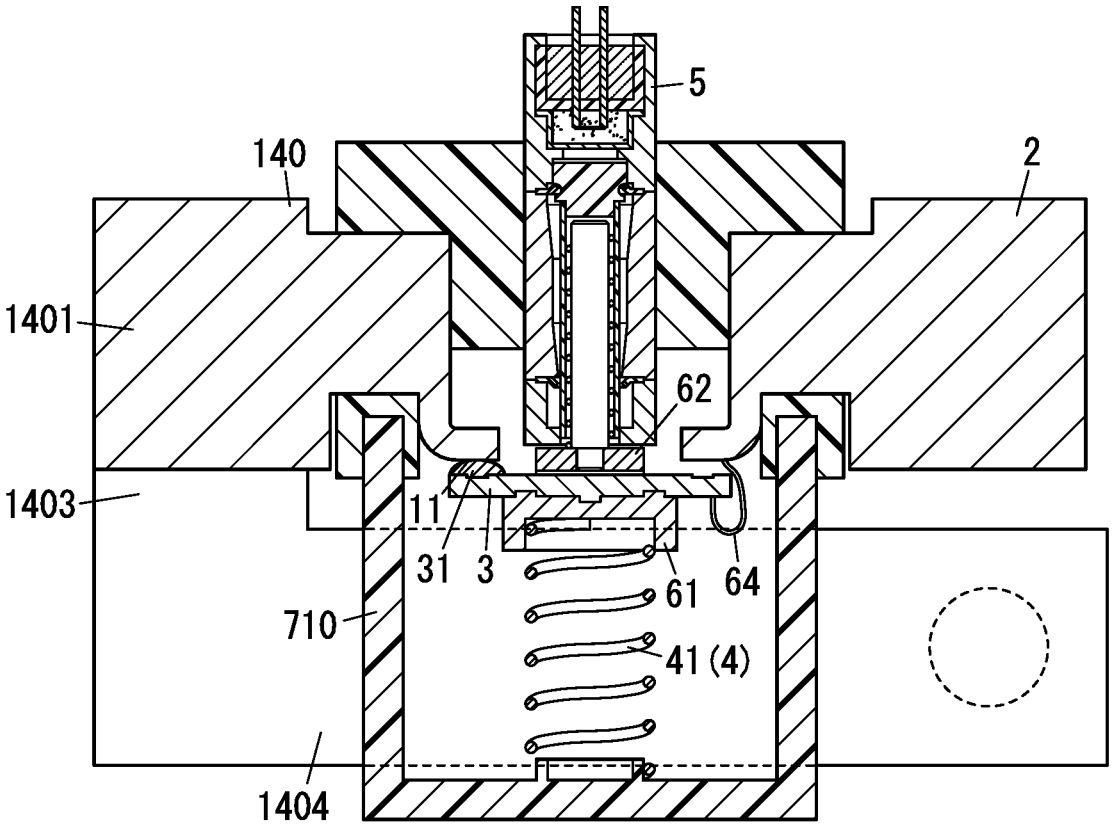
FIG. 18 is a cross-sectional view of primary part of a circuit interrupter of variation 11.

As in variation 11 shown in FIG. 18, as to the configuration including only one set of the movable contact 31 and the fixed contact 11 in the circuit interconnecting the first electrode 12 and the second electrode 22, the first fixed terminal 1 may include the fourth circuit piece 1404. Further, the second fixed terminal 2 may include the fourth circuit piece 2404.

Further, the illustrated example does not limit the flow route defined by the circuit piece. For example, the circuit piece 140 may have its flow route inside the housing 7 (the circuit piece (fourth circuit piece) 1404 in which the current flows in the opposite direction from the current flowing through the movable contactor 3 may be placed inside the housing 7).

(2.4.4)

Figure 19:
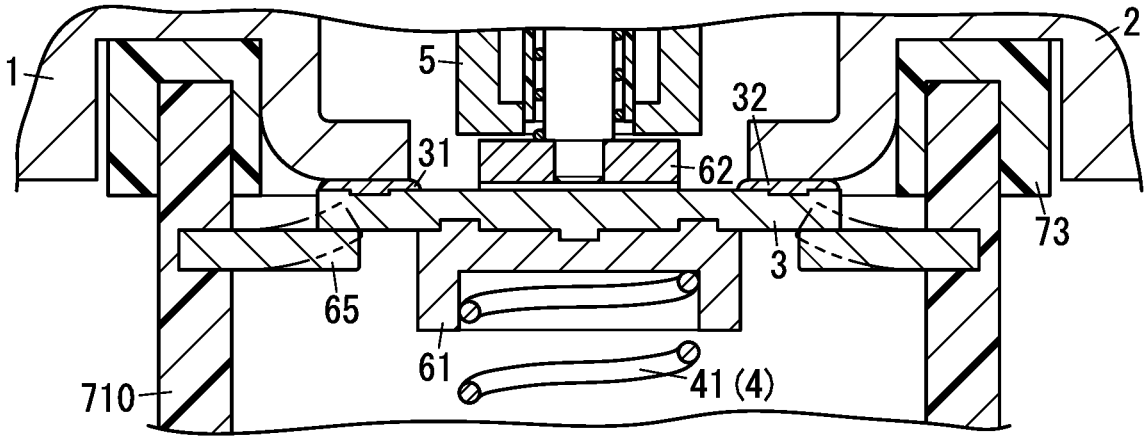
FIG. 19 is a cross-sectional view of primary part of a circuit interrupter of variation 12.

The circuit interrupter 100 of variation 12 shown in FIG. 19 includes a bimetallic strip 65 which curves due to temperature increase and presses the movable contactor 3 in a direction from the movable contact (first movable contact) 31 toward the fixed contact (first fixed contact) 11.

Specifically, the circuit interrupter 100 of variation 12 includes a pair of bimetallic strips 65 having plate shapes. The bimetallic strip 65 includes a base part fitted into the side surface of the housing body 710 and a tip end in contact with the lower surface of the movable contactor 3. In the circuit interrupter 100 of variation 12, when an overcurrent such as a short-circuit current flows through the movable contactor 3, the bimetallic strip 65 is heated by the overcurrent and presses the movable contactor 3 in a direction toward the first fixed terminal 1 and the second fixed terminal 2 (in the upward direction). Thus, it is possible to stabilize the connection state between the movable contact 31 and the fixed contact 11.

It should be noted that other configurations of variation 12 are same as those of the circuit interrupter 100 of the embodiment, and therefore illustration and detailed explanations thereof are omitted.

(2.4.5)

The magnitude of the electromagnetic repulsion force depends on the current flowing through a junction between the movable contactor 3 and the fixed terminal 1. Therefore, if there is a plurality of junctions between the movable contactor 3 and the fixed terminal 1, a current flowing through each junction can be reduced and thus the electromagnetic repulsive force can be reduced. For example, a plurality of movable contactors 3 can be arranged in parallel with each other between the first fixed terminal 1 and the second fixed terminal 2. This can reduce the magnitude of a current flowing through each movable contactor 3. It is possible to reduce the electromagnetic repulsive force acting on each junction.

Figure 20:
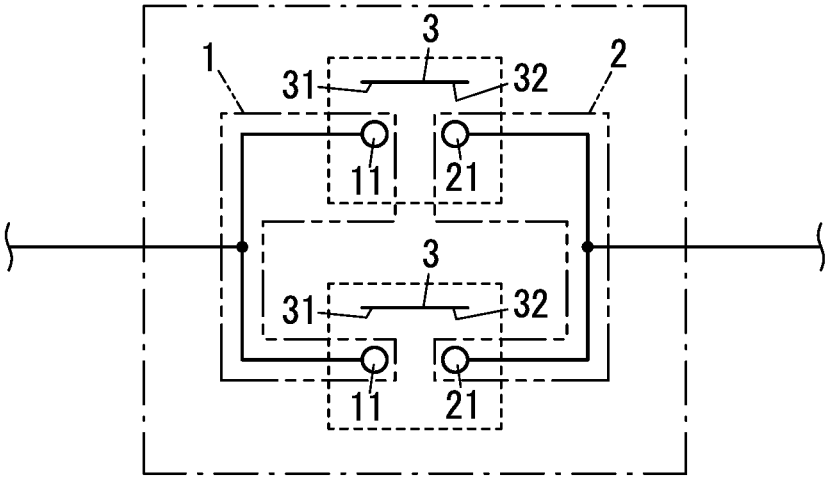
FIG. 20 is a circuit diagram of primary part of circuit interrupters of variations 13, 14.

As schematically shown in FIG. 20, each of the circuit interrupters 100 of variations 13, 14 includes a plurality of movable contactors 3 each of which includes a movable contact (first movable contact) 31. The fixed terminal (first fixed terminal) 1 includes a plurality of fixed contacts (first fixed contacts) 11. A plurality of movable contacts (first movable contacts) 31 are individually connected to the plurality of fixed contacts (first fixed contacts) 11.

Figure 21:
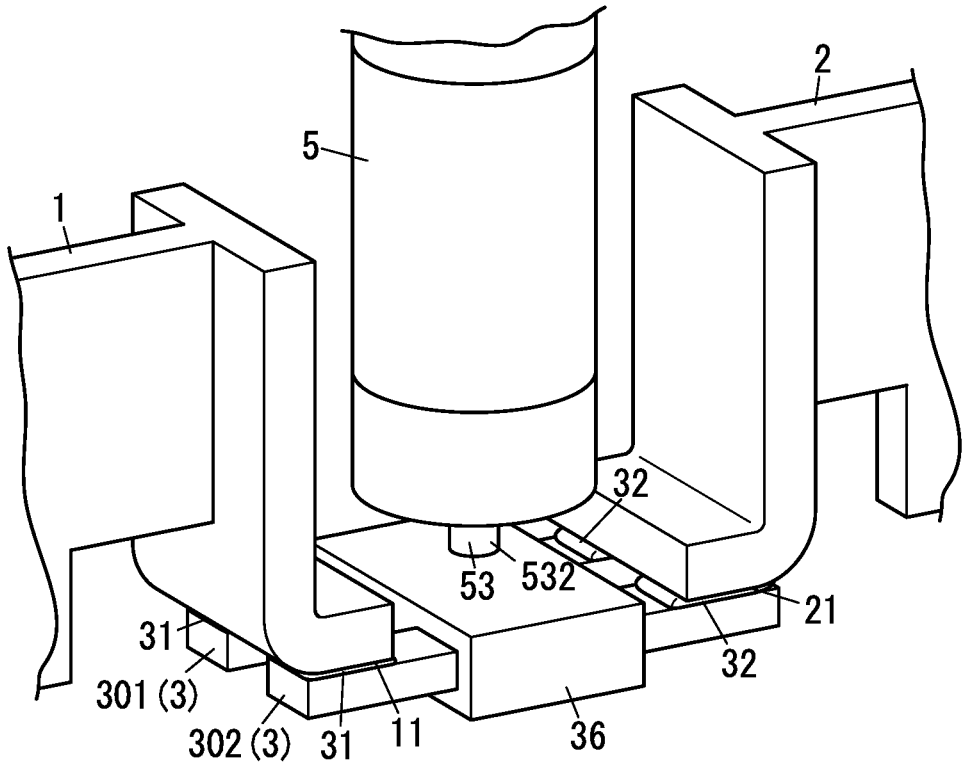
FIG. 21 is a perspective view of primary part of a circuit interrupter of variation 13.
Figure 22A:
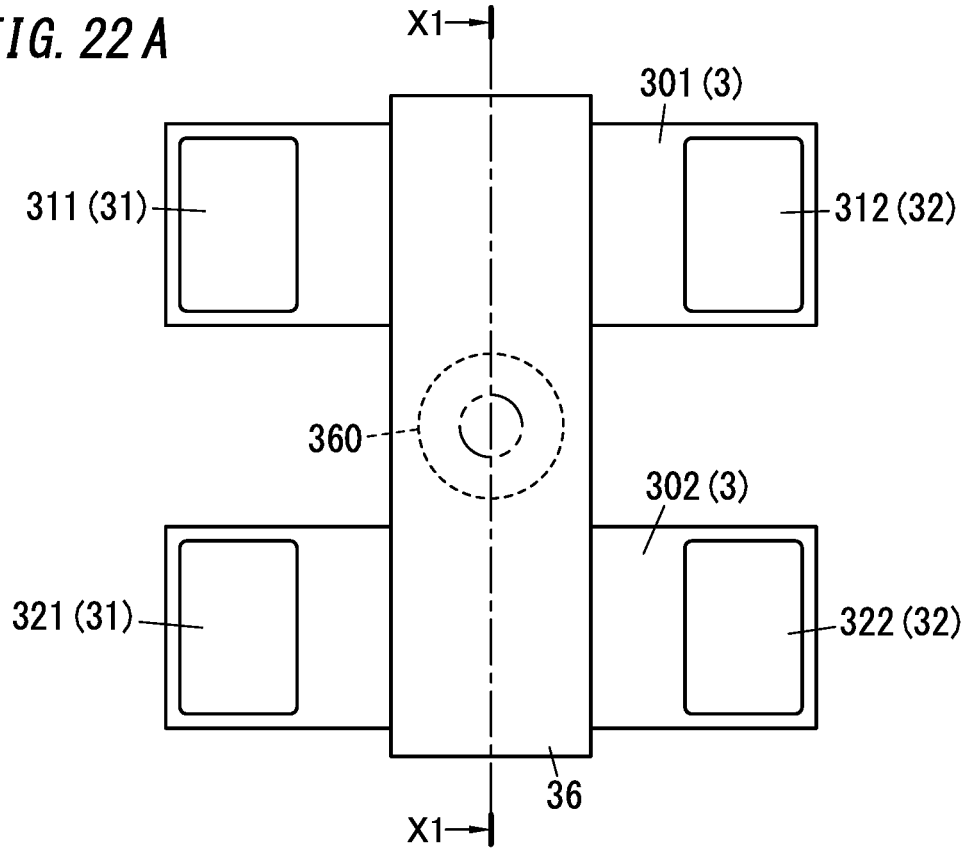
FIG. 22A is a top view of primary part of a circuit interrupter of variation 13.
Figure 22B:
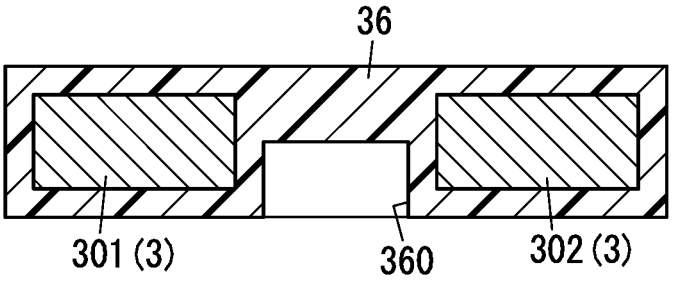
FIG. 22B is a cross-sectional view taken along line X1-X1 of FIG. 22A.

FIGS. 21, 22A, 22B show primary part of the circuit interrupter 100 of variation 13.

As shown in FIG. 21, the circuit interrupter 100 of variation 13 includes a plurality of movable contactors 3 (a first movable contactor 301 and a second movable contactor 302) and a holding member 3 having electrically insulating properties.

As shown in FIGS. 21, 22A, each of the plurality of movable contactors 3 has a plate shape with a length in the rightward/leftward direction and includes a first movable contact 31 at an upper surface of its left end and a second movable contact 32 at an upper surface of its right end. Specifically, as shown in FIG. 22A, the first movable contactor 301 includes a first movable contact 311 at an upper surface of its left end and a second movable contact 312 at an upper surface of its right end. The second movable contactor 302 includes a first movable contact 321 at an upper surface of its left end and a second movable contact 322 at an upper surface of its right end. Further, parts of a lower surface of the first fixed terminal 1 in contact with the first movable contacts 31 of the plurality of movable contactors 3 define first fixed contacts 11, individually. Parts of a lower surface of the second fixed terminal 2 in contact with the second movable contacts 32 of the plurality of movable contactors 3 define second fixed contacts 21, individually.

The holding member 36 is made of an insulating material such as a resin to have a cuboidal shape extending in the forward/backward direction. The holding member 36 holds the plurality of movable contactors 3 (the first movable contactor 301 and the second movable contactor 302). The first movable contactor 301 penetrates a center in the upward/downward direction of a back end (upper end in FIG. 22A) of the holding member 36. The second movable contactor 302 penetrates a center in the upward/downward direction of a front end (lower end in FIG. 22A) of the holding member 36. As shown in FIG. 21, an upper surface of the holding member 36 faces the second end 532 of the piston 53 of the pyroactuator 5. As shown in FIGS. 22A, 22B, the holding member 36 includes at its lower surface an engagement recess 360 for receiving the second end 412 of the contact pressure spring 41.

It should be noted that other configurations of variation 13 are same as those of the circuit interrupter 100 of the embodiment, and therefore illustration and detailed explanations thereof are omitted.

In the circuit interrupter 100 of variation 13, when the holding member 36 is pressed by the piston 53, the plurality of first movable contacts 31 are separated from the first fixed contacts 11 at the (substantially) same time and the plurality of second movable contacts 32 are separated from the second fixed contacts 21 at the (substantially) same time.

Thus, the plurality of movable contactors 3 are arranged in parallel with each other between the first fixed terminal 1 and the second fixed terminal 2. It is possible to reduce the electromagnetic repulsive force acting on each junction.

Incidentally, from the viewpoint of reducing the electromagnetic repulsion force, it is preferable that materials of the contact set of the movable contact 31 and the fixed contact 11 are same among the plurality of contact sets. That is, the plurality of first movable contacts 31 (the first movable contact 311 of the first movable contactor 301 and the first movable contact 321 of the second movable contactor 302) are preferably made of the same material. Further, the plurality of second movable contacts 32 (the second movable contact 312 of the first movable contactor 301 and the second movable contact 322 of the second movable contactor 302) are preferably made of the same material. Further, it is preferable that the plurality of first movable contacts 31 and the plurality of second movable contacts 32 are also made of the same material. When materials are same among the plurality of contact sets, it is possible to evenly distribute the current to the plurality of movable contactors 3 arranged in parallel. Thus, it is possible to further reduce the electromagnetic repulsive force acting on each junction.

However, the materials of the contact sets including the movable contact 31 and the fixed contact 11 may be different among the plurality of contact sets. That is, the plurality of movable contacts (the plurality of first movable contact) 31 (the first movable contact 311 of the first movable contactor 301 and the first movable contact 321 of the second movable contactor 302) may be made of different materials. Even in this case, the current is distributed to the plurality of movable contactors 3 arranged in parallel. Therefore, it is possible to reduce the electromagnetic repulsive force acting on each junction.

Figure 23A:
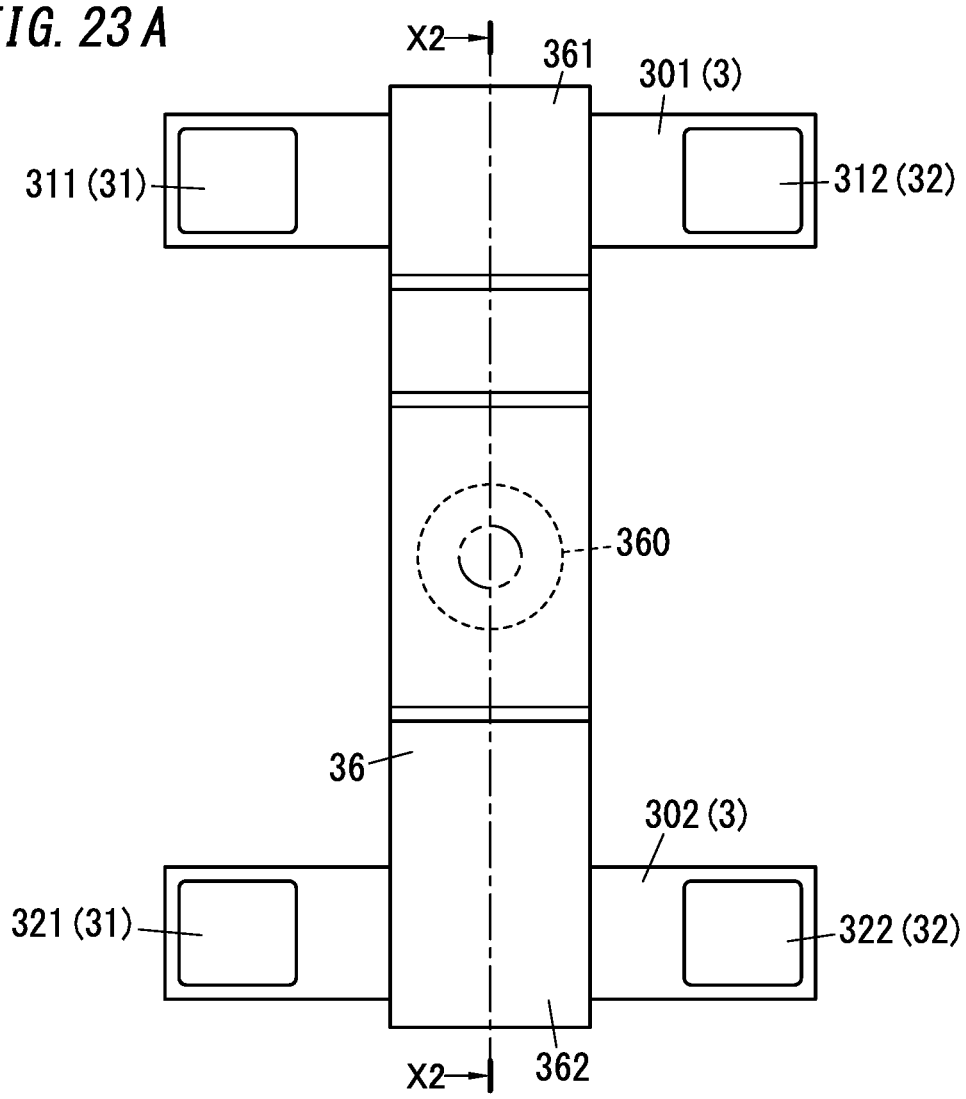
FIG. 23A is a top view of primary part of a circuit interrupter of variation 14.
Figure 23B:
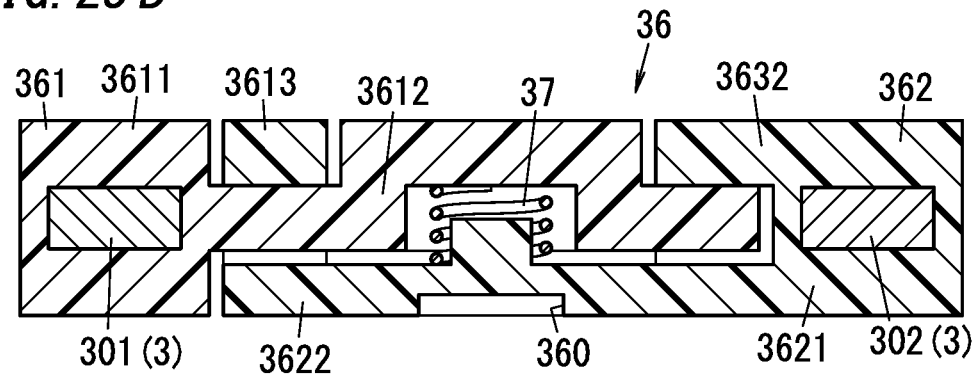
FIG. 23B is a cross-sectional view taken along line X2-X2 of FIG. 23A.

FIGS. 23A, 23B show primary part of the circuit interrupter 100 of variation 14. The circuit interrupter 100 of variation 14 is different from variation 13 in the structure of the holding member 36. Other configurations of variation 14 are same as those of the circuit interrupter 100 of variation 13, and therefore illustration and detailed explanations thereof are omitted.

The holding member 36 of variation 14 includes a first member 361 and a second member 362 each made of an insulating material such as resin.

The first member 361 is formed to have a length in the forward/backward direction (the upward/downward direction in FIG. 23A). The first member 361 includes a cuboid part 3611 which defines a back end (an upper end in FIG. 23A, a left end in FIG. 23B) where the first movable contactor 301 penetrates and a plate part 3612 protruding forward from the cuboid part 3611. The plate part 3612 includes at its center in the forward/backward direction a recess which is set back upward.

The second member 362 is formed to have a length in the forward/backward direction (the upward/downward direction in FIG. 23A). The second member 362 includes a cuboid part 3621 which defines a front end (a lower end in FIG. 23A, a right end in FIG. 23B) where the second movable contactor 302 penetrates and a plate part 3622 protruding backward from the cuboid part 3621. The plate part 3622 of the second member 362 includes at its lower surface an engagement recess 360 for receiving the second end 412 of the contact pressure spring 41. The cuboid part 3621 includes at its back surface (left surface in FIG. 23B) a recess into which a front end of the plate part 3612 of the first member 361 is inserted. The second member 362 includes at its back end (left end in FIG. 23B) a press part 3613 which faces the plate part 3612 with the plate part 3612 of the first member 361 located therebetween. The plate part 3612 includes at its center in the forward/backward direction a protrusion which faces the recess of the plate part 3612 of the first member 361 and protrudes upward. The protrusion is fitted into the coil spring 37 and biases the first member 361 upward (in a direction away from the second member 362). Thus, the holding member 36 is held by the holding unit 4 (the contact pressure spring 41) so that the upper surface of the plate part 3612 of the first member 361 is in contact with the second member 362 and the lower surface of the plate part 3612 of the first member 361 is separated from the second member 362.

An upper surface of a center of the plate part 3612 of the first member 361 (the upper surface in FIG. 23B) faces the second end 532 of the piston 53 of the pyroactuator 5.

In the circuit interrupter 100 of variation 14, when the central of the plate part 3612 of the first member 361 of the holding member 36 is pressed downward by the piston 53, first only the first member 36 moves downward while compressing the coil spring 37. Thus, the first movable contactor 301 moves downward and therefore the first movable contact 311 and the second movable contact 312 of the first movable contactor 301 are separated from the first fixed contact 11 and the second fixed contact 21. As the piston 53 moves further downward, the spring 37 is further compressed and the lower surface of the first member 361 comes into contact with the upper surface of the second member 362. Thus, pressed by the first member 361, the second member 362 also moves downward and the second movable contactor 302 also moves downward. Thus, the second movable contactor 302 moves downward and therefore the first movable contact 321 and the second movable contact 322 of the second movable contactor 302 are separated from the first fixed contact 11 and the second fixed contact 21.

That is, in the circuit interrupter 100 of variation 14, the plurality of movable contacts (the first movable contact 311 of the first movable contactor 301 and the first movable contact 321 of the second movable contactor 302) are separated from the plurality of fixed contacts 11 at different timings.

In this case, it is more preferable that the materials of the contact sets including the movable contact 31 and the fixed contact 11 may be different among the plurality of contact sets. That is, it is preferable that the plurality of first movable contacts 31 (the first movable contact 311 of the first movable contactor 301 and the first movable contact 321 of the second movable contactor 302) are made of different materials. Further, it is preferable that the plurality of second movable contacts 32 (the second movable contact 312 of the first movable contactor 301 and the second movable contact 322 of the second movable contactor 302) are made of different materials. The first movable contact 31 and the second movable contact 32 provided to the same movable contactor 3 (e.g., the first movable contact 311 and the second movable contactor 312 of the first movable contactor 301) may be made of the same material or may be made of different materials.

More particularly, the first movable contact 311 and the second movable contact 312 of the first movable contactor 301 which are separated from the first fixed contact 11 first are preferably formed of a material having a small resistance (e.g., copper). Further, the first movable contact 321 and the second movable contact 322 of the second movable contactor 302 which are separated from the first fixed contact 11 later are preferably made of a material having high arc resistance (e.g., tungsten alloy). With this configuration, no (or little) arc may occur between the fixed contact 11 and the first movable contact 311 (and between the second movable contact 312 and the second fixed contact 21) of the first movable contactor 301 which is separated from the first fixed contact 11 first. Therefore, the circuit interrupter 100 can have the improved arc resistance performance as a whole. Further, in the conduction state, it is possible to allow a current to flow through a path formed by the first movable contactor 301 with a smaller resistance. Therefore, the conduction performance can be improved.

In variations 13, 14, in the case where the first fixed contact 11 is provided as a separate part from the connection piece 110, two or more first movable contacts 31 may be connected to one first fixed contact 11. Similarly, in the case where the second fixed contact 21 is provided as a separate part from the connection piece 210, two or more second movable contacts 32 may be connected to one second fixed contact 21.

(2.4.6)

In the assumption that one of the movable contact (first movable contact) 31 and the fixed contact (first fixed contact) 11 defines a first contact and the other defines a second contact, the circuit interrupter 100 may include a plurality of second contacts. In the circuit interrupter 100, a plurality of second contacts may be connected to a single first contact.

Figure 24A:
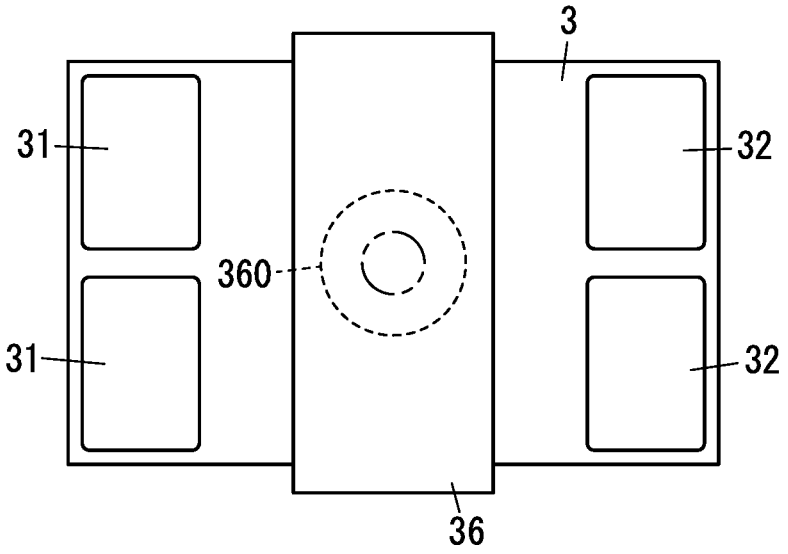
FIGS. 24A, 24B are top views of primary part of a circuit interrupter of variation 15.

FIG. 24A shows primary part of the circuit interrupter 100 of variation 15. The circuit interrupter 100 of variation 15 is different from the embodiment in the structure of the movable contactor 3. Other configurations of variation 15 are same as those of the circuit interrupter 100 of the embodiment, and therefore illustration and detailed explanations thereof are omitted.

As shown in FIG. 24A, the movable contactor 3 includes two first movable contacts 31 and two second movable contacts 32. Each of the two first movable contacts 31 is in contact with the lower surface of the connection piece 110 of the first fixed terminal 1 (the first fixed contact 11). Each of the two second movable contacts 32 is in contact with the lower surface of the connection piece 210 of the second fixed terminal 2 (the second fixed contact 21). That is, in the present variation, the two movable contacts (first movable contacts) 31 serving as two second contacts are connected to the fixed contact (first fixed contact) 11 serving as a single first contact.

Figure 24B:
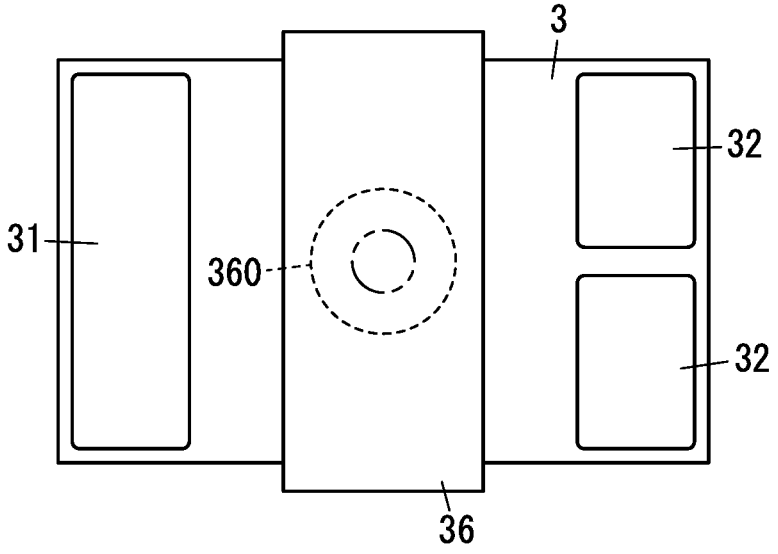

Thus, the movable contactor 3 includes a plurality of movable contacts (first movable contacts) 31 to provide a plurality of junctions between the fixed terminal (first fixed terminal) 1 and the movable contactor 3. Consequently, the electromagnetic repulsion at each junction can be reduced. Further, the movable contactor 3 includes a plurality of second movable contacts 32 to provide a plurality of junctions between the second fixed terminal 2 and the movable contactor 3. Consequently, the electromagnetic repulsion at each junction can be reduced. Incidentally, as shown in FIG. 24B, the movable contactor 3 may include a plurality of either ones of the first movable contact 31 or the second movable contact 32 (in the example of FIG. 24B, the second movable contact 32). In the present variation, the movable contactor 3 is held by the holding member 36 having electrically insulating properties but the holding member 36 can be omitted.

Figure 25A:
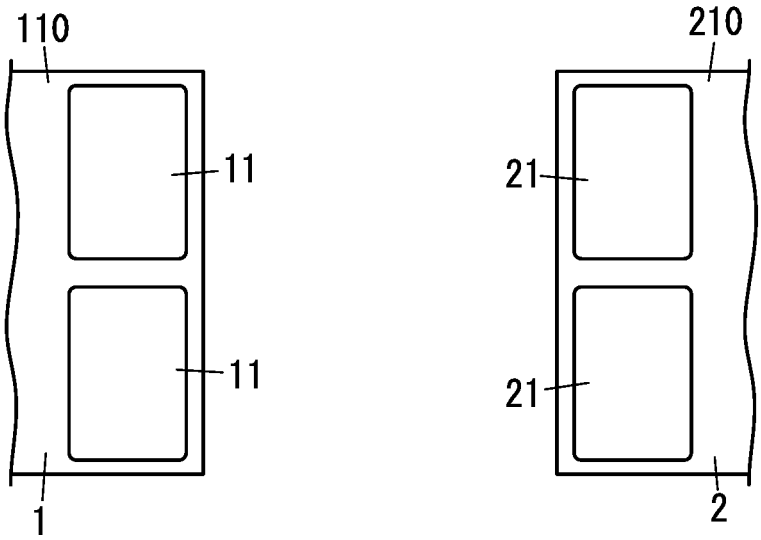
FIGS. 25A, 25B are bottom views of primary part of a circuit interrupter of variation 16.

FIG. 25A shows primary part of the circuit interrupter 100 of variation 16. The circuit interrupter 100 of variation 16 is different from the embodiment in the structures of the first fixed terminal 1 and the second fixed terminal 2. Other configurations of variation 16 are same as those of the circuit interrupter 100 of the embodiment, and therefore illustration and detailed explanations thereof are omitted.

As shown in FIG. 25A, the first fixed terminal 1 includes two first fixed contacts 11. The second fixed terminal 2 includes two second fixed contacts 21. In the present variation, for example, each fixed contact (the first fixed contact 11, the second fixed contact 21) is a separate part from the first fixed terminal 1 or the second fixed terminal 2 and is fixed to the connection piece 110 or 210. Each of the two fixed contacts (first fixed contacts) 11 is in contact with the movable contact (first movable contact) 31 of the movable contactor 3. Each of the two second fixed contacts 21 is in contact with the second movable contact 32 of the movable contactor 3. That is, in the present variation, the two fixed contacts (first fixed contacts) 11 serving as two second contacts are connected to the movable contact (first movable contact) 31 serving as a single first contact.

Figure 25B:
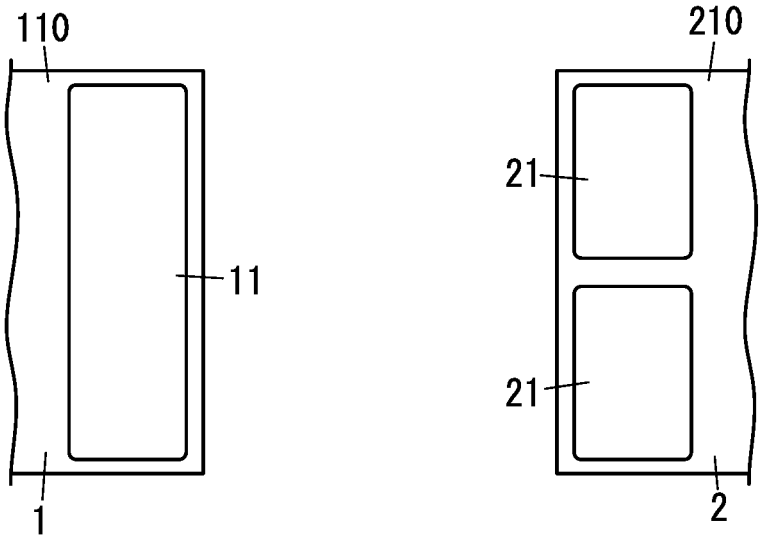

Thus, the fixed terminal (first fixed terminal) includes a plurality of fixed contacts (first fixed contacts) 11 to provide a plurality of junctions between the fixed terminal (first fixed terminal) 1 and the movable contactor 3. Consequently, the electromagnetic repulsion at each junction can be reduced. Further, the second fixed terminal 2 includes a plurality of second fixed contacts 21 to provide a plurality of junctions between the second fixed terminal 2 and the movable contactor 3. Consequently, the electromagnetic repulsion at each junction can be reduced. Incidentally, as shown in FIG. 25B, one of the first fixed terminal 1 and the second fixed terminal 2 may include a plurality of fixed terminals (first fixed terminal 1 or second fixed terminal 2).

Incidentally, the fixed terminal (first fixed terminal) 1 may be provided with a plurality of fixed contacts (first fixed contacts) 11 as shown in FIG. 24A. The movable contactor 3 may be provided with a plurality of movable contacts (first movable contacts) 31 as shown in FIG. 25A. The plurality of movable contacts may be connected to the plurality of fixed contacts. Also, in this case, providing a plurality of junctions between the fixed terminal (first fixed terminal) 1 and the movable contactor 3 can reduce the electromagnetic repulsion at each junction. The relationship between the second movable contact 32 and the second fixed contact 21 is also the same.

Also in the circuit interrupters 100 of variations 15, 16, similarly to variation 13, materials of the contact sets may be appropriately selected.

(2.4.7)

The stabilization of the connection state between the movable contact 31 and the fixed contact 11 can be achieved by increasing the contact pressure between the movable contact (first movable contact) 31 and the fixed contact (first fixed contact) 11.

Figure 26A:
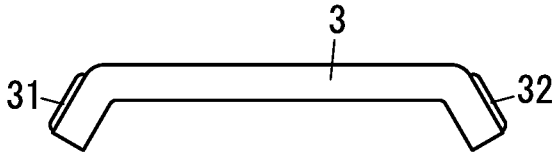
FIG. 26A is a front view of a movable contactor of a circuit interrupter of variation 17.
Figure 26B:
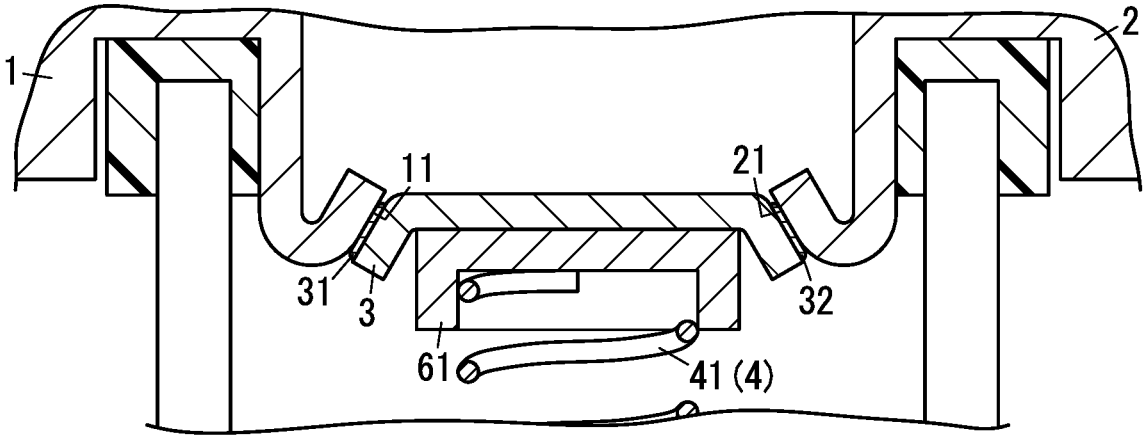
FIG. 26B is a cross-sectional view of primary part of a circuit interrupter of variation 15.

FIGS. 26A, 26B show primary part of the circuit interrupter 100 of variation 17. FIG. 26A is a front view of the movable contactor 3 of variation 17. FIG. 26B is a cross-sectional view of part of the circuit interrupter 100 of variation 17 where the movable contactor 3 is positioned between the fixed terminal 1 and the second fixed terminal 2. In FIG. 26B, illustration of the pyroactuator 5 or the like is omitted. Other configurations of variation 17 are the same as those of the circuit interrupter 100 of the embodiment, and therefore illustration and detailed explanations thereof are omitted.

As shown in FIG. 26B, in the circuit interrupter 100 of the present variation, the movable contactor 3 is sandwiched (press-fitted) between the first fixed terminal 1 and the second fixed terminal 2 so that the first movable contact 31 is in contact with the first fixed contact 11 and the second movable contact 32 is in contact with the second fixed contact 21. Thus, it is possible to stabilize the connection state between the movable contact 31 and the fixed contact 11.

Figure 27A:
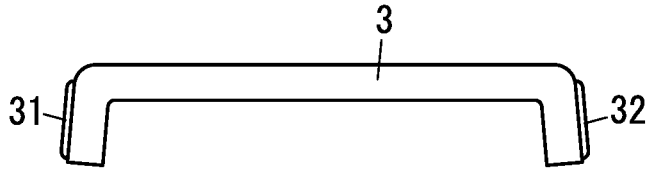
FIG. 27A is a front view of a movable contactor of a circuit interrupter of variation 18.
Figure 27B:
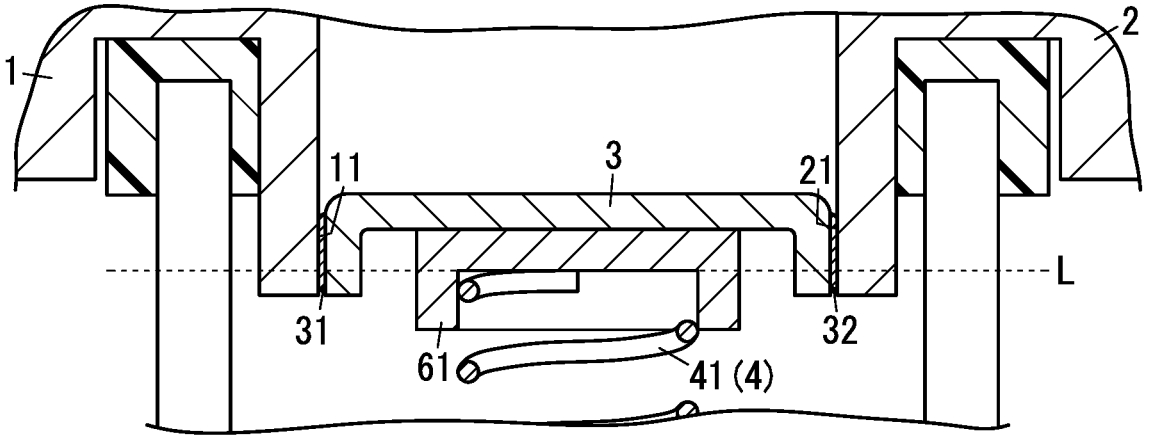
FIG. 27B is a cross-sectional view of primary part of a circuit interrupter of variation 16.

FIGS. 27A, 27B show primary part of the circuit interrupter 100 of variation 18. FIG. 27A is a front view of the movable contactor 3 of variation 18. FIG. 27B is a cross-sectional view of part of the circuit interrupter 100 of variation 18 where the movable contactor 3 is positioned between the fixed terminal 1 and the second fixed terminal 2. In FIG. 27B, illustration of the pyroactuator 5 or the like is omitted. Other configurations of variation 18 are the same as those of the circuit interrupter 100 of the embodiment, and therefore illustration and detailed explanations thereof are omitted.

As shown in FIG. 27B, in the circuit interrupter 100 of the present variation, a direction in which the first fixed contact 11 and the first movable contact 31 face each other is an opposite direction from a direction in which the second fixed contact 21 and the second movable contact 32 face each other. Thus, it is possible to further stabilize the connection between the movable contactor 31 and the fixed contact 11.

The first movable contact (movable contact) 31 may be welded to the first fixed contact (fixed contact) 11. The second movable contact 32 may be welded to the second fixed contact 21. For example, by making a current (e.g., about 2000 A) flow between the first electrode 12 and the second electrode 22 while the first movable contact 31 is in contact with the first fixed contact 11 and the second movable contact 32 is in contact with the second fixed contact 21, the movable contacts and the fixed contacts which are in contact with each other are welded. Welding increases a contact surface between the first movable contact (movable contact) 31 and the first fixed contact (fixed contact) 11 (a contact surface between the second movable contact 32 and the second fixed contact 21). Thus, the contact pressure is increased.

(2.5) Variation 19 to Variation 21

The direction of movement of the movable contactor 3 may be different from the direction of movement of the piston 53. In other words, the direction of movement of the movable contactor 3 may be a direction intersecting the direction of movement of the piston 53. For example, the direction of movement of the movable contactor 3 may be a direction substantially perpendicular to the direction of movement of the piston 53. Hereinafter, variations adopting this configuration will be described.

(2.5.1)

Figure 28A:
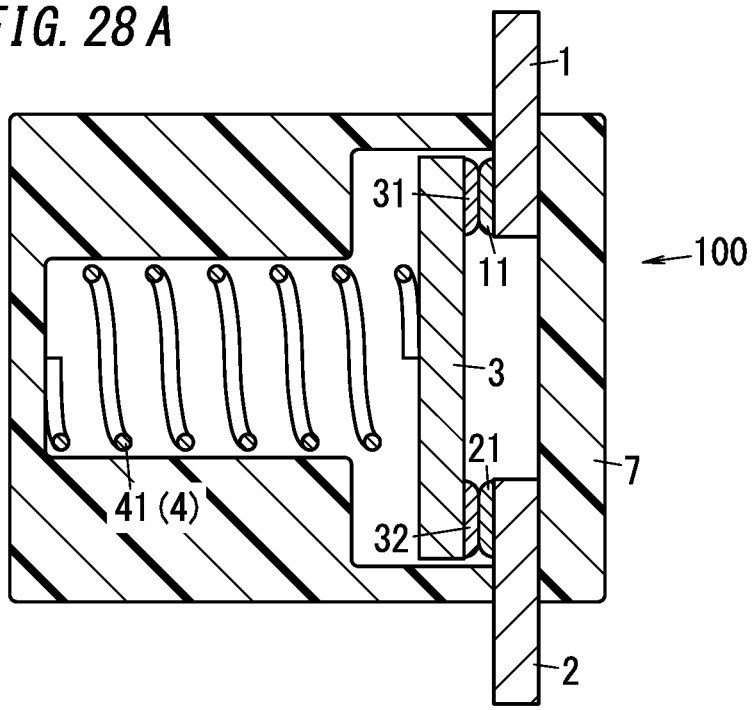
FIG. 28A is a cross-sectional view from the above, of primary part of a circuit interrupter of variation 19.
Figure 28B:
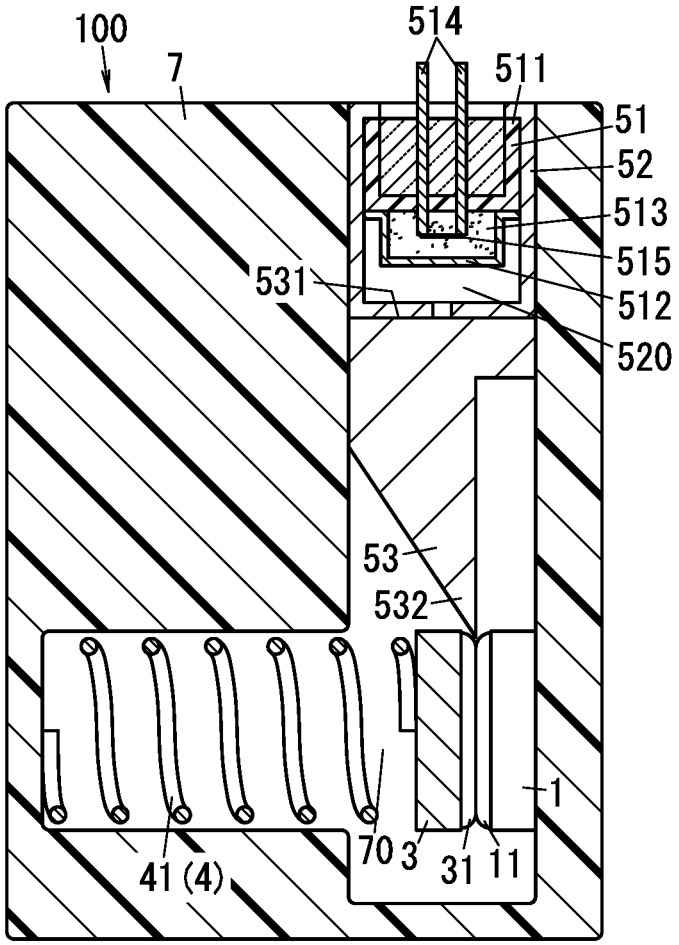
FIG. 28B is a cross-sectional view from the side, of the primary part of the circuit interrupter of variation 19.
Figure 28C:
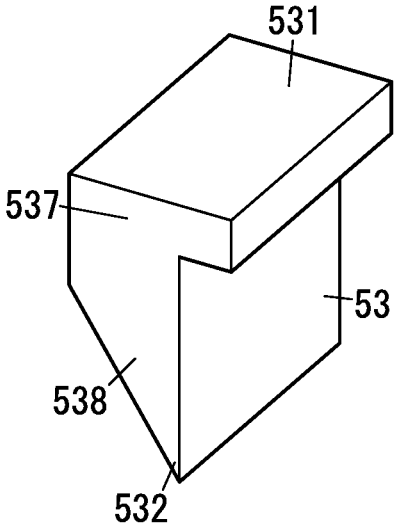
FIG. 28C is a perspective view of a piston of the circuit interrupter of variation 19.
Figure 29:
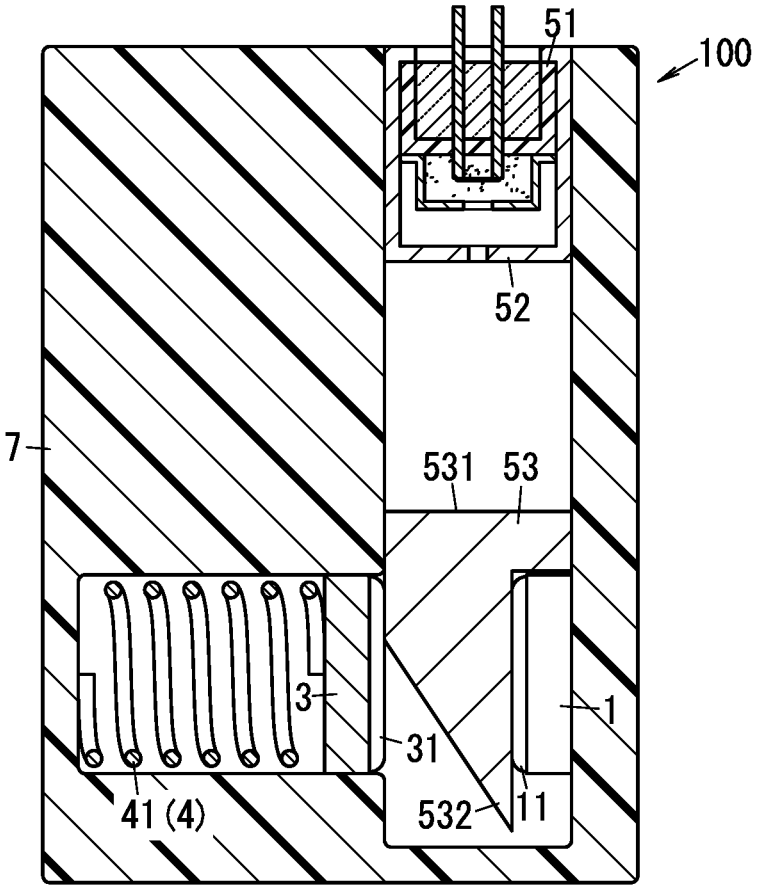
FIG. 29 is a cross-sectional view from the side, of the primary part of the above circuit interrupter after operation.

The circuit interrupter 100 of variation 19 will be described with reference to FIGS. 28A-29. FIG. 28A is a cross-sectional view from the above, of primary part of the circuit interrupter 100. FIG. 28B is a cross-sectional view from the side, of the primary part of the circuit interrupter 100. FIG. 28C is a perspective view of the piston 53 of the present variation. FIG. 29 is a cross-sectional view from the side, of the primary part of the circuit interrupter 100 after operation.

As shown in FIG. 28A, the circuit interrupter 100 of the present variation includes the housing 7, the squib 51, the case 52, the piston 53, the fixed terminal (first fixed terminal) 1, the second fixed terminal 2, the movable contactor 3, and the contact pressure spring 41 (the holding unit 4).

Each of the first fixed terminal 1 and the second fixed terminal 2 is formed in a rectangular plate shape with a length in the rightward/leftward direction (the upward/downward direction in FIG. 28A; a direction perpendicular to the sheet of FIG. 28B). The first fixed terminal 1 and the second fixed terminal 2 are arranged side by side in the rightward/leftward direction. The first fixed contact 11 is provided to a distal end of the first fixed terminal 1 (a lower end in FIG. 28A). The second fixed contact 21 is provided to a distal end of the second fixed terminal 2 (an upper end in FIG. 28B).

The movable contactor 3 is formed in a plate shape with a length in the rightward/leftward direction. The movable contactor 3 includes the movable contact (first movable contact) 31 and the second movable contact 32 respectively at its first end (upper end in FIG. 28A) and second end (lower end in FIG. 28A) in the length direction. The first fixed terminal 1, the second fixed terminal 2 and the movable contactor 3 are arranged so that the first movable contact 31 and the second movable contact 32 respectively face the first fixed contact 11 and the second fixed contact 21.

The contact pressure spring 41 biases the movable contactor 3 backward (the rightward direction in FIG. 28A) to allow the movable contactor 3 to move toward the first fixed terminal 1 and the second fixed terminal 2. That is, the contact pressure spring 41 biases the movable contactor 3 in a direction in which the first movable contact 31 is connected to the first fixed contact 11 and the second movable contact 32 is connected to the second fixed contact 21.

The squib 51 is accommodated in the case 52. The case 52 is placed above the movable contactor 3. The case 52 of the present variation is formed in a hollow circular cylindrical shape. An opening for exposing the pin electrode 514 of the squib 51 is formed in the upper surface of the case 52. A hole for discharging the gas generated in the combustion part 513 of the squib 51 is formed in the lower surface of the case 52. A space (pressurized chamber) 520 is formed below the squib 51 in the case 52.

The piston 53 is placed between the case 52 (the squib 51) and the movable contactor 3 in the upward/downward direction. The piston 53 includes a plate part 537 and a wedge part 538. The plate part 537 has a rectangular plate shape having a length in the rightward/leftward direction and is positioned at the upper end of the piston 53. The wedge part 538 has a so-called wedge shape and has a trapezoidal cross-sectional shape in which a right triangle is connected to a lower side of a rectangle. The wedge part 538 protrudes downward from a front portion (a left portion in FIG. 28B) of a lower surface of the plate part 537. The wedge part 538 includes at a lower portion of its front surface (a left side surface in FIG. 28B) an inclined surface inclined backward. In other words, the wedge part 538 is formed in a columnar shape with a thickness (a dimension in the rightward/leftward direction in FIG. 28B) decreasing toward its lower part. The piston 53 includes its lower end (a distal end of the wedge part 538) positioned between the movable contactor 3 and the first fixed terminal 1 (the second fixed terminal 2) in the forward/backward direction (the rightward/leftward direction in FIG. 28B).

The housing 7 is formed in a rectangular box shape having an inside space (the accommodation 70). The inside space of the housing 7 accommodates the distal end of the fixed terminal (first fixed terminal) 1, the distal end of the second fixed terminal 2, the movable contactor 3, the contact pressure spring 41, the case 52, and the piston 53.

The inside space of the housing 7 includes a first space to a fourth space.

The first space is a circular cylindrical space with a length in the upward/downward direction. In the first space, the case 52 is placed to close an upper opening of the first space.

The second space is positioned below the first space and is a cuboidal space with a length in the upward/downward direction. In the second space, the piston 53 is placed to allow its upper surface (the upper surface of the plate part 537) to face the hole of the case 52. In a plane perpendicular to the upward/downward direction, a cross-sectional shape of the second space is same as the shape of the plate part 537 of the piston 53. In other words, the piston 53 is placed in the second space to close the second space of the housing 7.

The third space is positioned below the second space and is a cuboidal space with a length in the rightward/leftward direction. In the third space, the movable contactor 3, the distal end of the first fixed terminal 1 (including the first fixed contact 11), and the distal end of the second fixed terminal 2 (including the second fixed contact 21) are positioned.

The fourth space is positioned in front of the third space and is a circular cylindrical space with a length in the forward/backward direction. In the fourth space, the contact pressure spring 41 is placed.

In the present variation, when gas is generated in the squib 51, the pressure in the pressurized chamber 520 is increased and the increased pressure causes downward movement of the piston 53. As the piston 53 moves downward, the wedge part 538 comes into a gap between the movable contactor 3 and the first fixed terminal 1 (and a gap between the movable contactor 3 and the second fixed terminal 2) and presses the movable contactor 3 forward (the leftward direction in FIG. 28B) (see FIG. 29). Thus, the first movable contact 31 is separated from the first fixed contact 11 and the second movable contact 32 is separated from the second fixed contact 21. After moved, the piston 53 is physically interposed between the movable contactor 3 and the fixed terminal 1. In the present variation, the direction of movement of the movable contactor 3 (the forward direction) is perpendicular to the direction of movement of the piston 53 (the downward direction).

In the present variation, the upper surface of the plate part 537 of the piston 53 defines the first end 531 that receives the pressure in the pressurized chamber 520 and the wedge part 538 of the piston 53 defines the second end 532 that presses the movable contactor 3.

Even in the present variation, the movable contactor 3 is moved relative to the fixed terminal (first fixed terminal) 1 by using the energy of the gas generated by the squib 51 to interrupt (break) the circuit. Therefore, an arc developed between the contacts is rapidly stretched and extinguished at a speed almost equal to a moving speed of the movable contactor 3. Thus, the circuit interrupter 100 can extinguish the arc in a short time and thus it is possible to improve the current interruption performance.

Incidentally, the length of the piston 53 (a dimension in a direction perpendicular to the sheet of FIG. 28B) is preferably longer than a distance between the first fixed contact 11 and the second fixed contact 21 and is preferably almost equal to the length of the movable contactor 3. In this case, when the piston 53 moves downward, a rear side of the lower surface of the plate part 537 comes into contact with the upper surfaces of the first fixed terminal 1 and the second fixed terminal 2. Thus, further downward movement of the piston 53 is suppressed (see FIG. 29). Thus, it is possible to keep the piston 53, at a position between the movable contactor 3 and the first fixed terminal 1 as well as the second fixed terminal 2.

The shape of the piston 53 is not limited to the shape shown in FIG. 28C and the piston 53 may include, for example, only the wedge part 538. Alternatively, the wedge part 538 may include at its both front and back surfaces inclined surfaces that are inclined to come close to each other toward a lower side of the wedge part 538. Or the piston 53 may be formed in a triangular prism shape. Needless to say, shapes other than these shapes may be used.

Also in the circuit interrupter 100 of the present variation, similarly to the embodiment, the first yoke 61, the second yoke 62, the detent mechanism and the like may be appropriately provided.

(2.5.2)

Figure 30A:
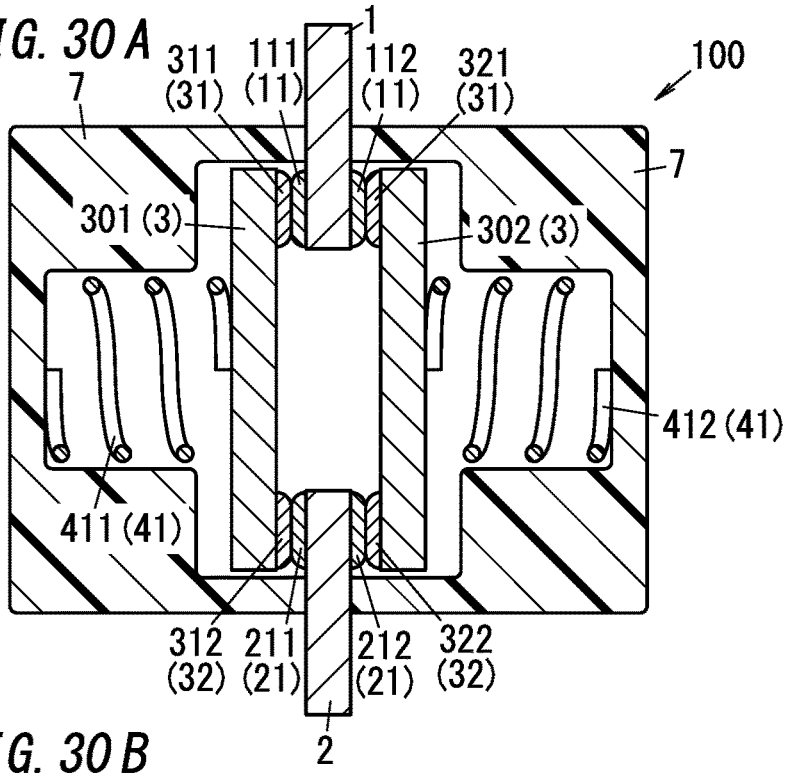
FIG. 30A is a cross-sectional view from the above, of primary part of a circuit interrupter of variation 20.
Figure 30B:
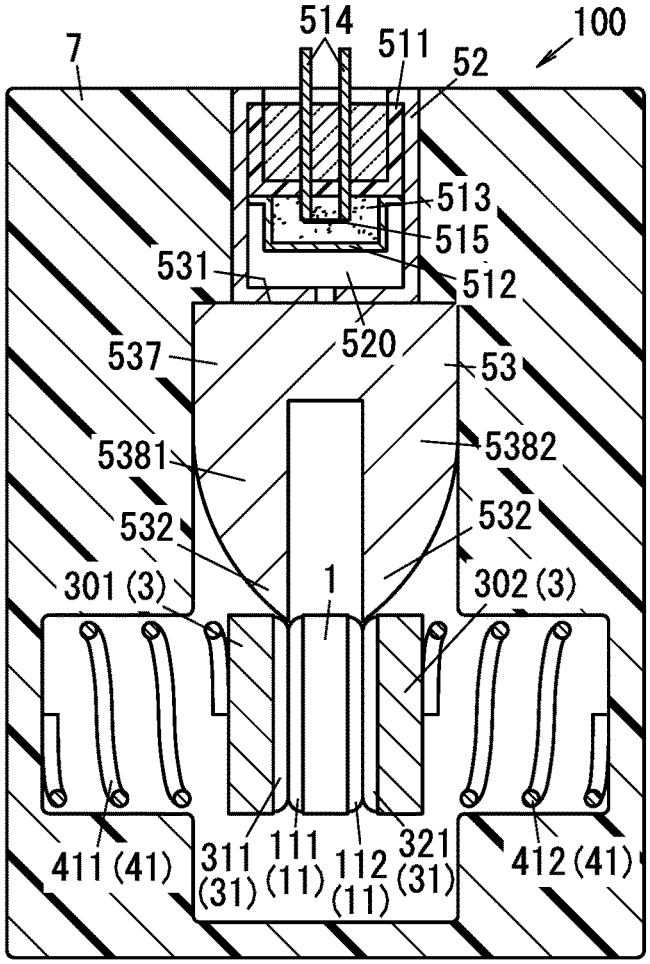
FIG. 30B is a cross-sectional view from the side, of the primary part of the circuit interrupter of variation 20.
Figure 30C:
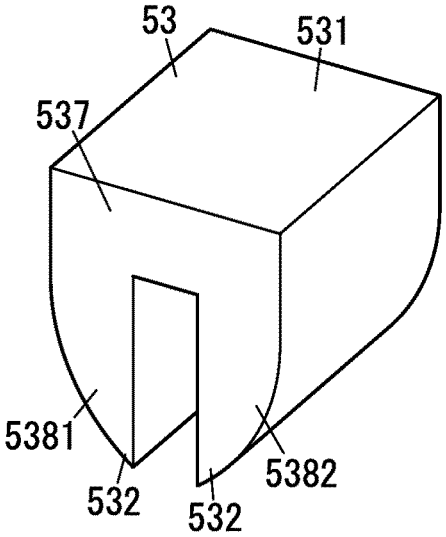
FIG. 30C is a perspective view of a piston of the circuit interrupter of variation 20.
Figure 31:
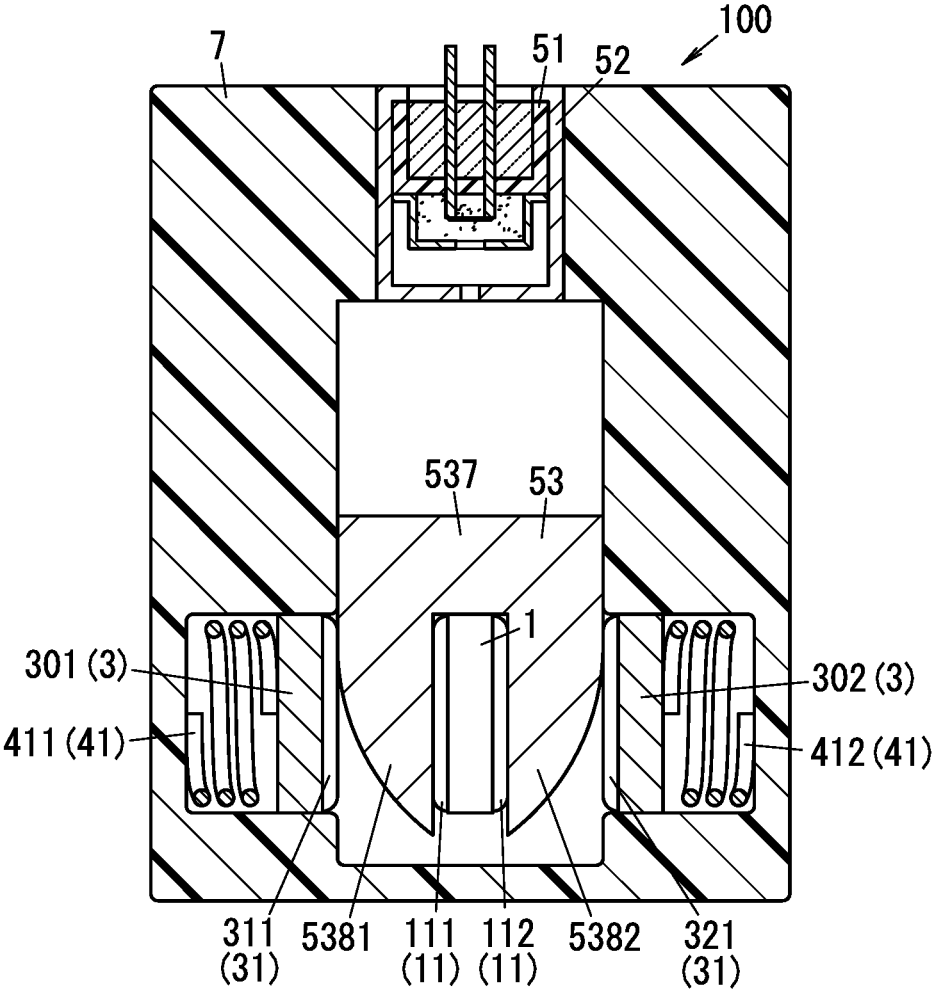
FIG. 31 is a cross-sectional view from the side, of the primary part of the above circuit interrupter after operation.

The circuit interrupter 100 of variation 20 will be described with reference to FIGS. 30A-31. FIG. 30A is a cross-sectional view from the above, of primary part of the circuit interrupter 100. FIG. 30B is a cross-sectional view from the side, of the primary part of the circuit interrupter 100. FIG. 30C is a perspective view of the piston 53 of the present variation. FIG. 31 is a cross-sectional view from the side, of the primary part of the circuit interrupter 100 after operation. Configurations common to the circuit interrupter 100 of the present variation and variation 19 are designated by the same reference signs and explanations thereof are omitted as appropriate.

The circuit interrupter 100 of the present variation includes two movable contactors 3 (the first movable contactor 301 and the second movable contactor 302) arranged in parallel with each other. The directions in which the two movable contactors 3 move are different from each other.

As shown in FIG. 30A, each of the two movable contactors 3 (the first movable contactor 301, the second movable contactor 302) has a plate shape with a length in the rightward/leftward direction (the upward/downward direction in FIG. 30A; a direction perpendicular to the sheet of FIG. 30B). Each movable contactor 3 includes the first movable contact 31 on one surface (an upper end in FIG. 30A) of its left end and the second movable contact 32 on one surface (a lower end in FIG. 30A) of a right end. Specifically, as shown in FIG. 30A, the first movable contactor 301 includes the first movable contact 311 on a rear surface of the left end (a right surface in FIG. 30A) and includes the second movable contact 312 on a rear surface of the right end. The second movable contactor 302 includes the first movable contact 321 on a front surface (a left surface in FIG. 30A) of the left end and includes the second movable contact 322 on a front surface of the right end.

Further, provided to the front surface of the distal end of the first fixed terminal 1 is the first fixed contact 111 (11) connected to the first movable contact 311 of the first movable contactor 301. Provided to the rear surface of the distal end of the first fixed terminal 1 is the first fixed contact 112 (11) connected to the first movable contact 321 of the second movable contactor 302. Further, provided to the front surface of the distal end of the second fixed terminal 2 is the second fixed contact 211 (21) connected to the second movable contact 312 of the first movable contactor 301. Provided to the rear surface of the distal end of the second fixed terminal 2 is the second fixed contact 212 (21) connected to the second movable contact 322 of the second movable contactor 302.

Provided between the first movable contactor 301 and the housing 7 is the contact pressure spring 41 (first contact pressure spring 411). The first contact pressure spring 411 biases the first movable contactor 301 backward (in the rightward direction in FIG. 30A). That is, the first movable contactor 301 is biased by the first contact pressure spring 411 in a direction in which the first movable contact 311 is connected to the first fixed contact 111 and the second movable contact 312 is connected to the second fixed contact 211.

Provided between the second movable contactor 302 and the housing 7 is the contact pressure spring 41 (second contact pressure spring 412). The second contact pressure spring 412 biases the second movable contactor 302 forward (in the leftward direction in FIG. 30A). That is, the second movable contactor 302 is biased by the second contact pressure spring 412 in a direction in which the first movable contact 321 is connected to the first fixed contact 112 and the second movable contact 322 is connected to the second fixed contact 212.

The first contact pressure spring 411 and the second contact pressure spring 412 bias the corresponding movable contactors 3 in mutually opposite directions. The first constant pressure spring 411 and the second constant pressure spring 412 bias the corresponding movable contactors 3 in directions in which the movable contactors 3 come close to each other.

The piston 53 of the present variation includes the plate part 537, a first wedge part 5381, and a second wedge part 5382. The plate part 537 has a rectangular plate shape having a length in the rightward/leftward direction and is positioned at the upper end of the piston 53. The first wedge part 5381 has a so-called wedge shape. The first wedge part 5381 protrudes downward from a front portion (a left portion in FIG. 30B) of the lower surface of the plate part 537. The first wedge part 5381 includes at a lower portion of its front surface (a left side surface in FIG. 30B) an inclined surface inclined backward. In other words, the first wedge part 5381 is formed in a columnar shape with a thickness (a dimension in the rightward/leftward direction in FIG. 30B) decreasing toward its lower part. The first wedge part 5381 includes its distal end positioned between the first movable contactor 301 and the first fixed terminal 1 (the second fixed terminal 2) in the forward/backward direction (the rightward/leftward direction in FIG. 30B). The second wedge part 5382 has a so-called wedge shape. The second wedge part 5382 protrudes downward from a back portion (a right portion in FIG. 30B) of the lower surface of the plate part 537. The second wedge part 5382 includes at a lower portion of its back surface (a right side surface in FIG. 30B) an inclined surface inclined forward. In other words, the second wedge part 5382 is formed in a columnar shape with a thickness (a dimension in the rightward/leftward direction in FIG. 30B) decreasing toward its lower part. The second wedge part 5382 includes its distal end positioned between the second movable contactor 302 and the first fixed terminal 1 (the second fixed terminal 2) in the forward/backward direction (the rightward/leftward direction in FIG. 30B).

The squib 51 and the case 52 are the same as those of the circuit interrupter 100 of variation 19.

The inside space of the housing 7 accommodates the distal end of the fixed terminal (first fixed terminal) 1, the distal end of the second fixed terminal 2, the first movable contactor 301, the second movable contactor 302, the first contact pressure spring 411, the second contact pressure spring 412, the case 52, and the piston 53.

In the present variation, when gas is generated in the squib 51, the pressure in the pressurized chamber 520 is increased and the increased pressure causes downward movement of the piston 53. As the piston 53 moves downward, the first wedge part 5381 comes into a gap between the first movable contactor 301 and the first fixed terminal 1 (and a gap between the first movable contactor 301 and the second fixed terminal 2) and presses the first movable contactor 301 forward (in the left direction in FIG. 30B). Thus, the first movable contact 311 is separated from the first fixed contact 111 and the second movable contact 312 is separated from the second fixed contact 211. Further, as the piston 53 moves downward, the second wedge part 5382 comes into a gap between the second movable contactor 302 and the first fixed terminal 1 (and a gap between the second movable contactor 302 and the second fixed terminal 2) and presses the second movable contactor 302 backward (in the rightward direction in FIG. 30B) (see FIG. 31). Thus, the first movable contact 321 is separated from the first fixed contact 112 and the second movable contact 322 is separated from the second fixed contact 212.

Also in the present variation, the direction of movement of the movable contactor 3 (the forward direction and the backward direction) is perpendicular to the direction of movement of the piston 53 (the downward direction). In the present variation, the directions in which the two movable contactors 3 (the first movable contactor 301 and the second movable contactor 302) move are different from each other. In particular, in the present variation, the two movable contactors 3 are pressed by the piston 53 to move in directions away from each other.

Also the circuit interrupter 100 of the present variation rapidly separates the movable contact 31 from the fixed contact 11 and therefore can extinguish an arc in a short time and accordingly it is possible to improve the current interruption performance.

Further, in the circuit interrupter 100 of the present variation, the two movable contactors 3 are arranged in parallel with each other. The two movable contactors 3 are arranged so that the fixed terminal 1 is sandwiched therebetween in a direction in which the movable contact 31 and the fixed contact 11 faces each other (the rightward/leftward direction in FIG. 30A). Then, currents flow through the two movable contactors 3 (the first movable contactor 301 and the second movable contactor 302) in the same direction. For example, when the first fixed terminal 1 has a higher potential than the second fixed terminal 2, currents flows through the respective movable contactors 3 in a direction from the first fixed terminal 1 to the second fixed terminal 2.

With the above configuration, a current flowing through one movable contactor 3 receives a Lorentz force in a direction toward the other movable contactor 3 due to a magnetic field generated by a current flowing through the other movable contactor 3. Therefore, the present variation can stabilize the connection state between the first movable contact 31 and the first fixed contact 11 and the connection state between the second movable contact 32 and the second fixed contact 21 against the electromagnetic repulsion force.

(2.5.3)

Figure 32A:
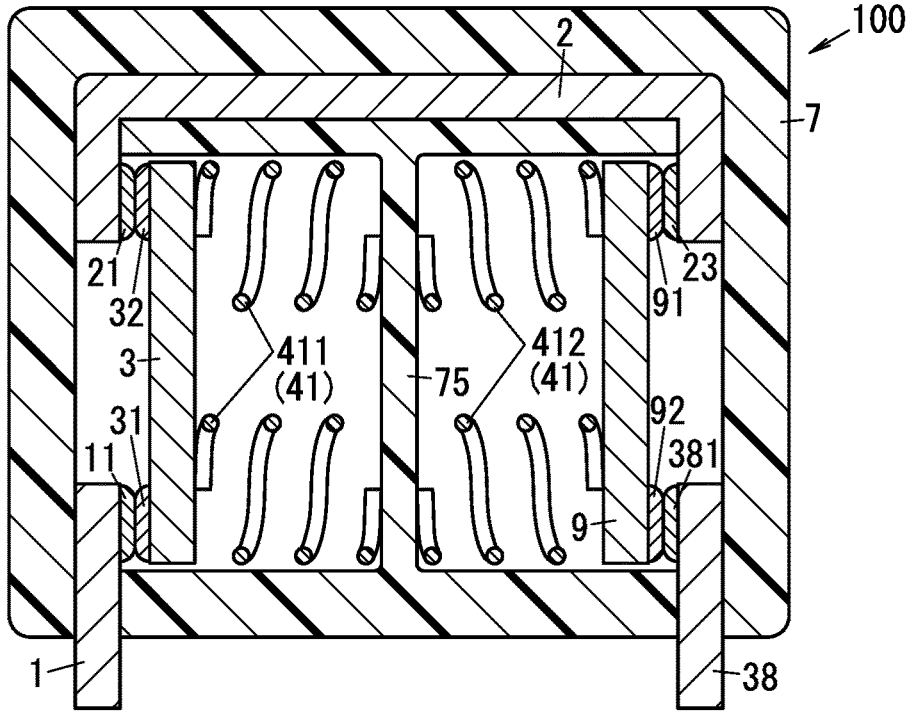
FIG. 32A is a cross-sectional view from the above, of primary part of a circuit interrupter of variation 21.
Figure 32B:
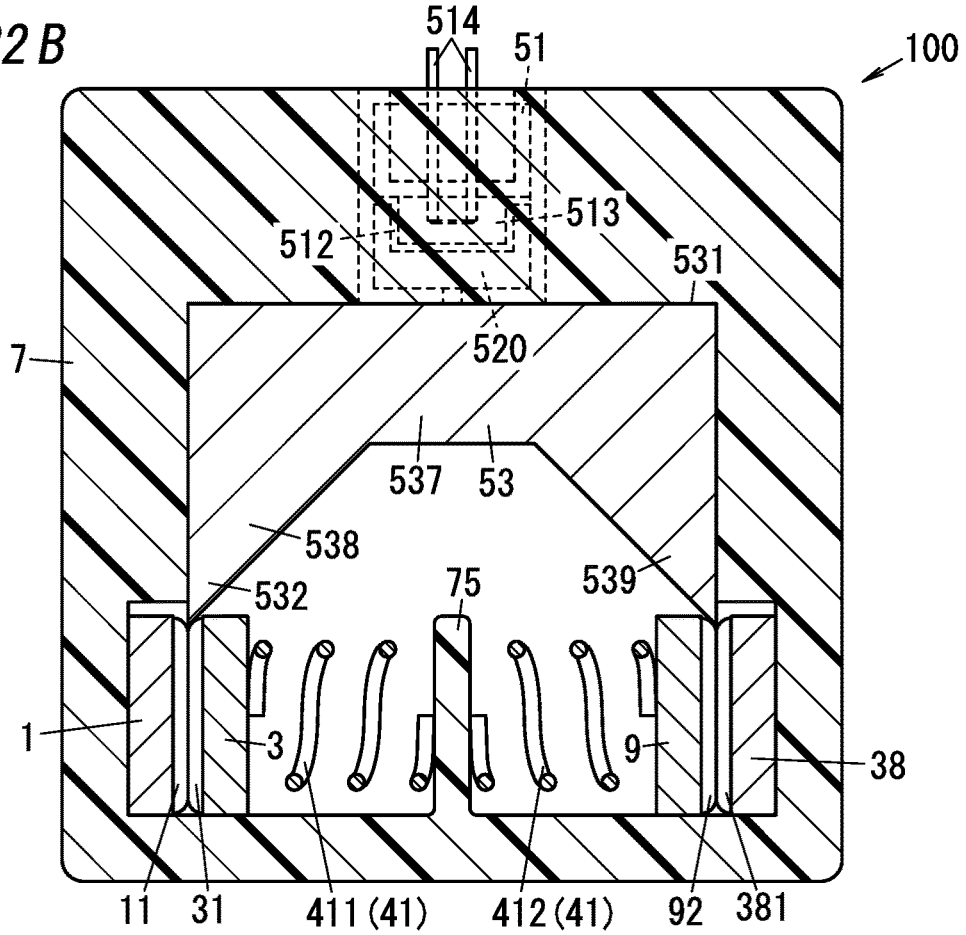
FIG. 32B is a cross-sectional view from the side, of the primary part of the circuit interrupter of variation 21.
Figure 33:
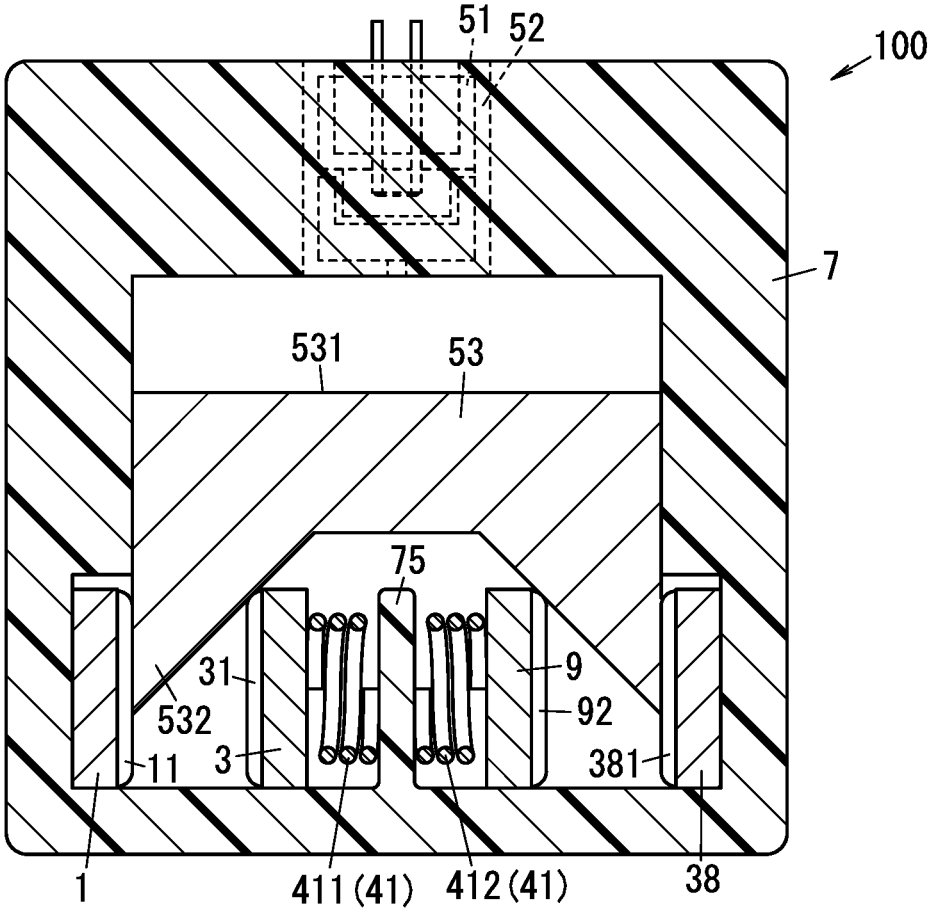
FIG. 33 is a cross-sectional view from the side, of the primary part of the above circuit interrupter after operation.

The circuit interrupter 100 of variation 21 will be described with reference to FIGS. 32A-33. FIG. 32A is a cross-sectional view from the above, of primary part of the circuit interrupter 100. FIG. 32B is a cross-sectional view from the side, of the primary part of the circuit interrupter 100. FIG. 33 is a cross-sectional view from the side, of the primary part of the circuit interrupter 100 after operation. Configurations common to the circuit interrupter 100 of the present variation and variation 19 are designated by the same reference signs and explanations thereof are omitted as appropriate.

The circuit interrupter 100 of the present variation includes an additional movable contactor 9 which is a separate part from the movable contactor 3 and is connected in series with the movable contactor 3. The movable contactor 3 and the additional movable contactor 9 are arranged in parallel with each other. The direction of movement of the movable contactor 3 and the direction of movement of the additional movable contactor 9 are different from each other. In the present variation, the direction of movement of the movable contactor 3 and the direction of movement of the additional movable contactor 9 are mutually opposite directions.

As shown in FIG. 32A, the circuit interrupter 100 of the present variation includes a first fixed terminal 1, a second fixed terminal 2, a third fixed terminal 38, the movable contactor 3, and the additional movable contactor 9.

Each of the first fixed terminal 1 and the third fixed terminal 38 is formed in a rectangular plate shape with a length in the rightward/leftward direction (the upward/downward direction in FIG. 30A; a direction perpendicular to the sheet of FIG. 30B). The second fixed terminal 2 is formed in a substantially C-shape in a top view (as viewed in a direction perpendicular to the sheet of FIG. 28A).

There is a first fixed contact (fixed contact) 11 provided to one surface (right surface) of the distal end (an upper end in FIG. 32A) of the first fixed terminal 1. There is a second fixed contact 21 is provided to one surface (right surface in FIG. 32A) of a first end (a left end in FIG. 32A) of the second fixed terminal 2. The first fixed contact 11 and the second fixed contact 21 are arranged side by side in the rightward/leftward direction (upward/downward direction in FIG. 32A).

There is a third fixed contact 23 provided to a surface (a right surface in FIG. 32A) of a second end (a right end in FIG. 32A) of the second fixed terminal 2. There is a fourth fixed contact 381 provided to a surface (left surface) of a distal end (an upper end in FIG. 32A) of the third fixed terminal 38. The third fixed contact 23 and the fourth fixed contact 381 are arranged side by side in the rightward/leftward direction (the upward/downward direction in FIG. 32A).

The movable contactor 3 is formed in a plate shape with a length in the rightward/leftward direction. The movable contactor 3 includes the first movable contact (movable contact) 31 and the second movable contact 32 respectively at its first end (lower end in FIG. 32A) and second end (upper end in FIG. 32A) in the length direction. The first fixed terminal 1, the second fixed terminal 2 and the movable contactor 3 are arranged so that the first movable contact 31 and the second movable contact 32 respectively face the first fixed contact 11 and the second fixed contact 21.

The additional movable contactor 9 is formed in a plate shape with a length in the rightward/leftward direction. The additional movable contactor 9 includes a third movable contact 91 and a fourth movable contact 92 respectively at its first end (upper end in FIG. 32A) and second end (lower end in FIG. 32A) in the length direction. The second fixed terminal 2, the third fixed terminal 38 and the additional movable contactor 9 are arranged so that the third movable contact 91 and the fourth movable contact 92 respectively face the third fixed contact 23 and the fourth fixed contact 381.

The movable contactor 3 and the additional movable contactor 9 are electrically connected in series with each other via the second fixed terminal 2.

The movable contactor 3 and the additional movable contactor 9 are arranged parallel with each other. The housing 7 includes at a center of its bottom surface a wall 75 in parallel with the movable contactor 3 and the additional movable contactor 9.

There are two contact pressure springs 41 (two first contact pressure springs 411) between the movable contactor 3 and the wall 75. The two first contact pressure springs 411 bias the movable contactor 3 forward (in the leftward direction in FIG. 32A). That is, the first movable contactor 301 is biased by the two first contact pressure springs 411 in a direction in which the first movable contact 31 is connected to the first fixed contact 11 and the second movable contact 32 is connected to the second fixed contact 21.

There are two contact pressure springs 41 (two second contact pressure springs 412) between the additional movable contactor 9 and the wall 75. The two second contact pressure springs 412 bias the additional movable contactor 9 backward (in the rightward direction in FIG. 32A). That is, the additional movable contactor 9 is biased by the two second contact pressure springs 412 in a direction in which the third movable contact 91 is connected to the third fixed contact 23 and the fourth movable contact 92 is connected to the fourth fixed contact 381.

The first contact pressure spring 411 and the second contact pressure spring 412 bias the movable contactor 3 and the additional movable contactor 9 in mutually opposite directions. The first contact pressure spring 411 and the second contact pressure spring 412 bias the movable contactor 3 and the additional movable contactor 9 in directions in which the movable contactor 3 and the additional movable contactor 9 are separated from each other.

The piston 53 of the present variation includes the plate part 537, a first wedge part 538, and a second wedge part 539. The plate part 537 has a rectangular plate shape having a length in the forward/backward direction and is positioned at the upper end of the piston 53. The first wedge part 538 has a so-called wedge shape, and a cross-sectional shape thereof is a right-angled triangle shape. The first wedge part 538 protrudes downward from the front portion (a left portion in FIG. 32B) of the lower surface of the plate part 537. The first wedge part 538 includes at its back surface (a right surface in FIG. 32B) an inclined surface inclined forward. In other words, the first wedge part 538 is formed in a columnar shape with a thickness (a dimension in the rightward/leftward direction in FIG. 32B) decreasing toward its lower part. The first wedge part 538 includes its distal end positioned between the movable contactor 3 and the first fixed terminal 1 (the second fixed terminal 2) in the forward/backward direction (the rightward/leftward direction in FIG. 32B). The second wedge part 539 has a so-called wedge shape, and a cross-sectional shape thereof is a right-angled triangle shape. The second wedge part 539 protrudes downward from the back portion (a right portion in FIG. 32B) of the lower surface of the plate part 537. The second wedge 539 includes at its front surface (a left surface in FIG. 32B) an inclined surface inclined backward. In other words, the second wedge part 539 is formed in a columnar shape with a thickness (a dimension in the rightward/leftward direction in FIG. 32B) decreasing toward its lower part. The second wedge part 539 includes its distal end positioned between the additional movable contactor 9 and the second fixed terminal 2 (the third fixed terminal 38) in the forward/backward direction (the rightward/leftward direction in FIG. 32B).

The inside space of the housing 7 accommodates the distal end of the first fixed terminal 1, the second fixed terminal 2, the distal end of the third fixed terminal 38, the movable contactor 3, the additional movable contactor 9, the first contact pressure springs 411, the second contact pressure springs 412, the case 52, and the piston 53. Incidentally, the squib 51 and the case 52 are placed inside the housing 7 to face the center of the upper surface of the piston 53. In FIGS. 32B, 33, the squib 51 and the case 52 are illustrated by imaginary lines.

In the present variation, when gas is generated in the squib 51, the pressure in the pressurized chamber 520 is increased and the increased pressure causes downward movement of the piston 53. As the piston 53 moves downward, the first wedge part 538 comes into a gap between the movable contactor 3 and the first fixed terminal 1 (and a gap between the movable contactor 3 and the second fixed terminal 2) and presses the movable contactor 3 backward (the rightward direction in FIG. 32B). Thus, the first movable contact 31 is separated from the first fixed contact 11 and the second movable contact 32 is separated from the second fixed contact 21. Further, as the piston 53 moves downward, the second wedge part 539 comes into a gap between the additional movable contactor 9 and the second fixed terminal 2 (and a gap between the additional movable contactor 9 and the third fixed terminal 38) and presses the additional movable contactor 902 forward (the leftward direction in FIG. 32B) (see FIG. 33). Thus, the third movable contact 91 is separated from the third fixed contact 23 and the fourth movable contact 92 is separated from the fourth fixed contact 381.

Also in the present variation, the direction of movement of the movable contactor 3 (the backward direction) is perpendicular to the direction of movement of the piston 53 (the downward direction). Further, in the present variation, the direction of movement of the movable contactor 3 and the direction of movement of the additional movable contactor 9 are different from each other. In particular, in the present variation, the movable contactor 3 and the additional movable contactor 9 are pressed by the piston 53 to move to come close to each other.

Also the circuit interrupter 100 of the present variation rapidly separates the movable contact 31 from the fixed contact 11 and therefore can extinguish an arc in a short time and accordingly it is possible to improve the current interruption performance.

Further, in the circuit interrupter 100 of the present variation, the movable contactor 3 and the additional movable contactor 9 are arranged in parallel with each other. The movable contactor 3 is positioned between the additional movable contactor 9 and the fixed contact 1 in a direction in which the movable contact 31 and the fixed contact 11 face each other (the rightward/leftward direction in FIG. 30A). Then, the direction of the current flowing through the additional movable contactor 9 is opposite to the direction of the current flowing through the movable contactor 3. For example, when the first fixed terminal 1 has a higher potential than the third fixed terminal 38, the movable contactor 3 sees a current flow in a direction from the first movable contact 31 toward the second movable contact 32 and the additional movable contactor 9 sees a current flow in a direction from the third movable contact 91 toward the fourth movable contact 92.

With the above configuration, a current flowing through the movable contactor 3 receives a Lorentz force in a direction away from the additional movable contactor 9 due to a magnetic field generated by a current flowing through the additional movable contactor 9. Therefore, the present variation can stabilize the connection state between the first movable contact 31 and the first fixed contact 11 and the connection state between the second movable contact 32 and the second fixed contact 21 against the electromagnetic repulsion force.

In short, the additional movable contactor 9 can serve as the circuit piece (the fourth circuit piece 1404, 2404) in the circuit interrupter 100 of variation 10.

Similarly to the movable contactor 3, a current flowing through the additional movable contactor 9 receives a Lorentz force in a direction away from the movable contactor 3 due to a magnetic field generated by a current flowing through the movable contactor 3. Therefore, the present variation can stabilize the connection state between the third movable contact 91 and the third fixed contact 23 and the connection state between the fourth movable contact 92 and the fourth fixed contact 381 against the electromagnetic repulsion force.

Further, the movable contactor 3 and two contacts including the first fixed contact 11 and the second fixed contact 21 (two contact sets of the movable contact and the fixed contact) and the additional movable contactor 9 and two contacts including the third fixed contact 23 and the fourth fixed contact 381 are electrically connected in series with each other. That is, the current path between the first fixed terminal 1 and the third fixed terminal 23 includes four contacts (contact sets) electrically connected in series with other. Therefore, arcs may be developed at individual contacts. Thus, it is possible to enhance the current interruption performance.

(2.6) Variation 22 and Variation 23

The circuit interrupter 100 may include a magnetic flux generator 8. The magnetic flux generator 8 generates a magnetic flux for stretching an arc developed between the first movable contact (movable contact) 31 and the first fixed contact (fixed contact) 11 (and between the second movable contact 32 and the second fixed contact 21) in the accommodation 70.

Figure 34:
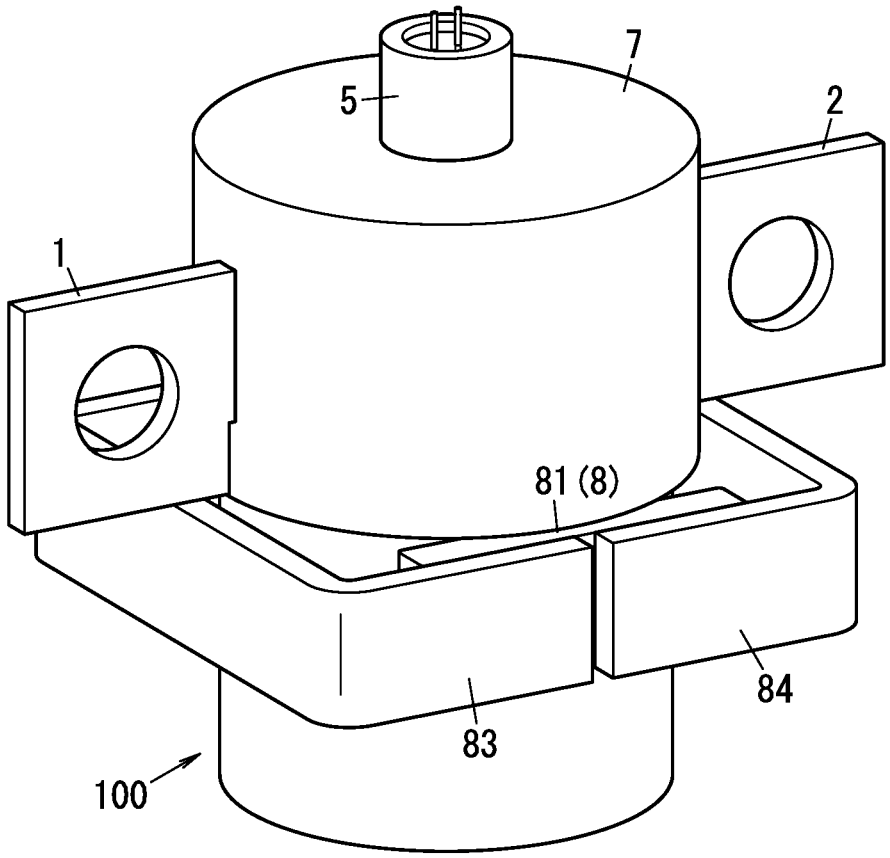
FIG. 34 is a perspective view of a circuit interrupter of variation 22.
Figure 35:
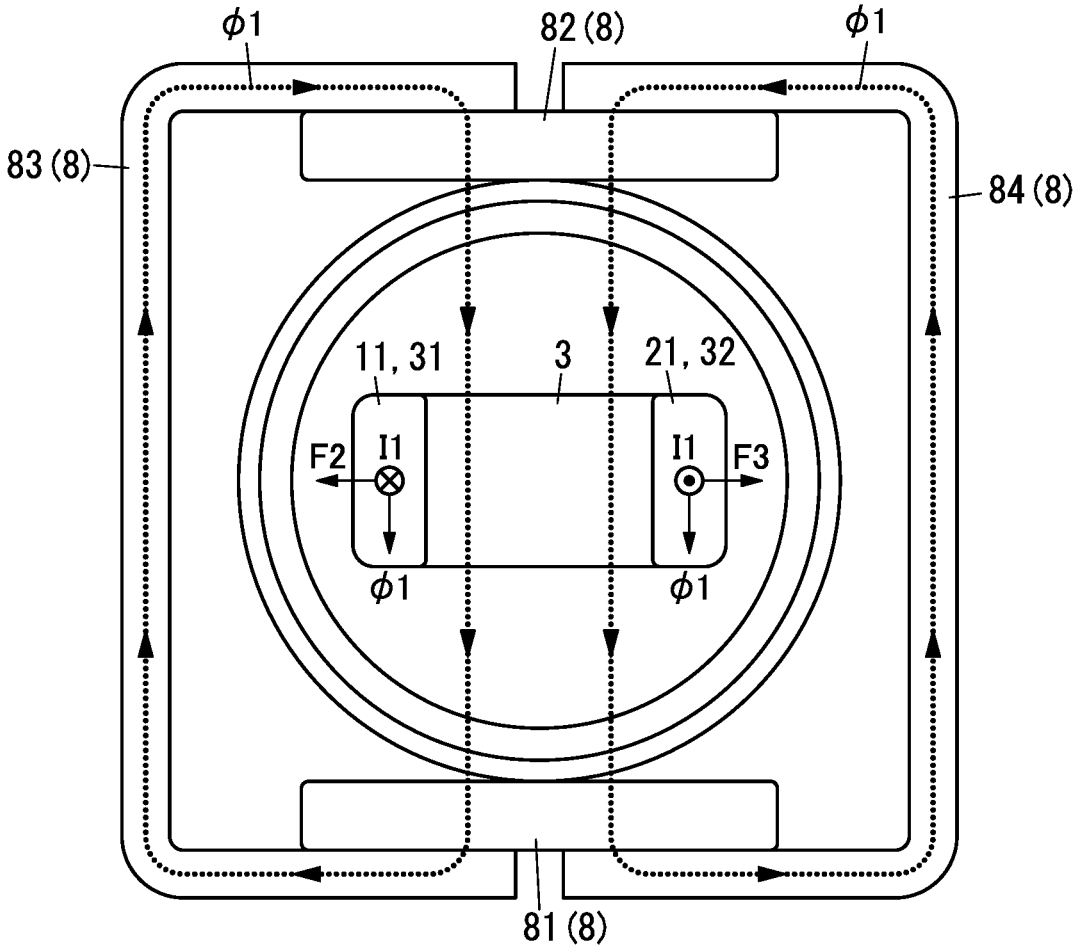
FIG. 35 is a diagram for illustration of stretch of arcs developed in the circuit interrupter of variation 22.

FIGS. 34, 35 show the circuit interrupter 100 of variation 22 including two arc extinction magnets 81, 82 as the magnetic flux generator 8. The circuit interrupter 100 of variation 22 further includes two capsule yokes 83, 84 as the magnetic flux generator 8. FIG. 34 is a perspective view of the circuit interrupter 100 of variation 22. FIG. 35 is a diagram for explaining the arc extinction magnets 81, 82 stretch arcs.

The capsule yokes 83, 84 are ferromagnetic bodies and may be made of a metallic material such as iron. The capsule yokes 83, 84 hold the arc extinction magnets 81, 82. The capsule yokes 83, 84 are placed on opposite sides in the rightward/leftward direction of the housing 7 to surround the housing 7 from opposite sides in the rightward/leftward direction.

The arc extinction magnets 81, 82 are arranged such that their poles facing each other in the forward/backward direction have mutually opposite polarities (S poles and N poles). The arc extinction magnets 81, 82 are placed on opposite sides in the forward/backward direction of the housing 7. The arc extinction magnets 81, 82 stretch arcs developed between the first movable contact 31 and the first fixed contact 11 and between the second movable contact 32 and the second fixed contact 21 when the movable contactor 3 is separated from the first fixed terminal 1 and the second fixed terminal 2. The capsule yokes 83, 84 surround the housing 7 and the arc extinction magnets 81, 82, collectively. In other words, the arc extinction magnets 81, 82 are sandwiched between side surfaces in the forward/downward direction of the housing 7 and the capsule yokes 83, 84. One (front) arc extinction magnet 81 has a first surface in the forward/backward direction (front end surface) coupled with first ends of the capsule yokes 83, 84 and has a second surface in the forward/backward direction (back end surface) in contact with the housing 7. Other (back) arc extinction magnet 82 has a first surface in the forward/backward direction (back end surface) coupled with second ends of the capsule yokes 83, 84 and has a second surface in the forward/backward direction (front end surface) in contact with the housing 7.

In the present embodiment, the arc extinction magnets 81, 82 are placed in positions overlapping the first fixed contact 11 and the second fixed contact 21 in the upward/downward direction, respectively. That is, a contact point between the first fixed contact 11 and the first movable contact 31 and a contact point between the second fixed contact 21 and the second movable contact 32 are positioned inside a magnetic field developed between the arc extinction magnets 81, 82.

According to this configuration, the capsule yoke 83 forms part of a magnetic circuit, through which a magnetic flux φ1 generated by the pair of arc extinction magnets 81, 82 passes, as shown in FIG. 35. Similarly, the capsule yoke 84 forms part of a magnetic circuit, through which a magnetic flux φ1 generated by the pair of arc extinction magnets 81, 82 passes, as shown in FIG. 35. These magnetic fluxes φ1 act on the contact point between the first fixed contact 11 and the first movable contact 31 and the contact point between the second fixed contact 21 and the second movable contact 32.

In the example of FIG. 35, it is assumed that the forward magnetic flux φ1 is generated in the inside space of the housing 7 and a current I1 flows from the first fixed terminal 1 toward the second fixed terminal 2. In this state, when the movable contactor 3 moves downward and thus is separated from the first fixed terminal 1 and the second fixed terminal 2, a downward discharge current (arc) from the first fixed contact 11 toward the first movable contact 31 is generated between the first fixed contact 11 and the first movable contact 31. Therefore, the magnetic flux φ1 applies a leftward Lorentz force F2 to the arc (see FIG. 35). That is, the arc generated between the first fixed contact 11 and the first movable contact 31 is stretched leftward and then extinguished. On the other hand, an upward discharge current (arc) from the second movable contact 32 toward the second fixed contact 21 is generated between the second fixed contact 21 and the second movable contact 32. Therefore, the magnetic flux φ1 applies a rightward Lorentz force F3 to the arc (see FIG. 35). That is, the arc generated between the second fixed contact 21 and the second movable contact 32 is stretched rightward and then extinguished.

In the present variation, the arc extinction magnets 81, 82 further stretch the arcs generated between the first movable contact 31 and the first fixed contact 11 (between the second movable contact 32 and the second fixed contact 21), thereby extinguishing them.

The circuit interrupter 100 of variation 22 includes the capsule yokes 83, 84 for forming a magnetic circuit and increasing the magnetic flux generated between the contacts. However, the capsule yokes 83, 84 are not necessarily required. The arc extinction magnets 81, 82 may be arranged such that their poles facing each other have the same polarity (S poles or N poles).

Figure 36:
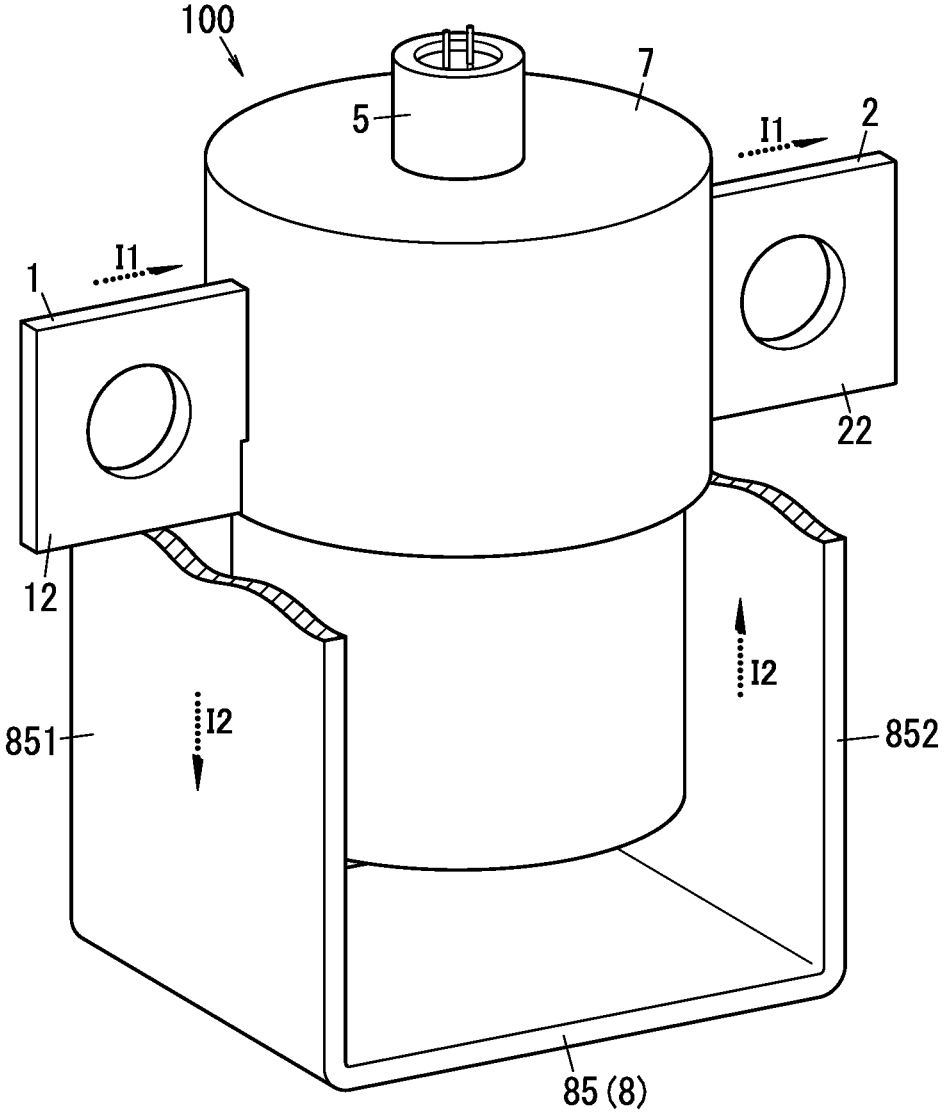
FIG. 36 is a perspective view of a circuit interrupter of variation 23.

As in variation 23 shown in FIG. 36, the magnetic flux generator 8 may include a circuit piece 85 through which a current I2 flows. The circuit piece 85 includes a circuit piece 851 which is placed along a left side surface of the housing 7 and allows the current I2 to flow therethrough downward, and a circuit piece 852 which is placed along a right side surface of the housing 7 and allows the current I2 to flow therethrough upward. That is, the direction of the current I2 flowing through the circuit piece 851 is the same as the direction of the current I1 flowing from the first fixed contact 11 toward the first movable contact 31. The direction of the current I2 flowing through the circuit piece 852 is the same as the direction of the current I1 flowing from the second movable contact 32 toward the second fixed contact 21. Thus, similarly to the example of FIG. 35, the forward magnetic flux φ1 is generated in the inside space of the housing 7. Thus, the arc generated between the first fixed contact 11 and the first movable contact 31 is stretched leftward and then extinguished. Further, the arc generated between the second fixed contact 21 and the second movable contact 32 is extinguished by being stretched to the right.

As described above, the magnetic field generated by the current I2 flowing through the circuit piece 85 further stretches the arcs generated between the first movable contact 31 and the first fixed contact 11 (between the second movable contact 32 and the second fixed contact 21), thereby extinguishing them.

The circuit piece 85 may be coupled to the first electrode 12 or the second electrode 22. In other words, the current I2 flowing through the circuit piece 85 may be the same as the current I1 flowing through the circuit interrupter 100. For example, an upper end of the circuit piece 851 may be extended around the housing 7 while kept away from the housing 7 and coupled to the second electrode 22. Alternatively, an upper end of the conduit piece 852 may be extended around the housing 7 while kept away from the housing 7 and coupled to the first electrode 12.

(2.7) Variation 24

Figure 37:
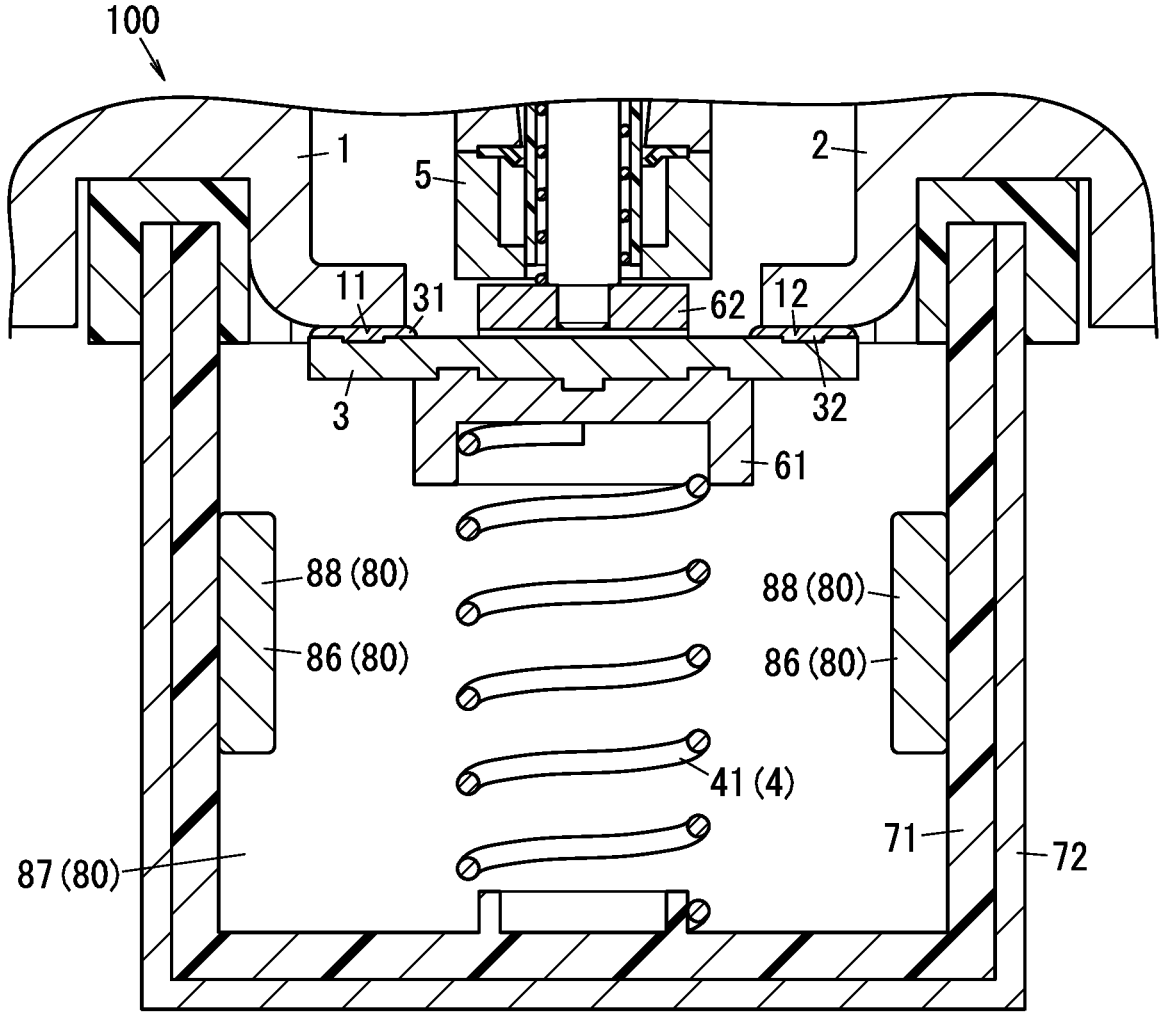
FIG. 37 is a cross-sectional view of a circuit interrupter of variation 24.

The circuit interrupter 100 of variation 24 will be described with reference to FIG. 37. The circuit interrupter 100 of variation 24 includes an arc extinction material 80. The arc extinction material 80 is placed inside a space same as the space where the first movable contact (movable contact) 31 and the first fixed contact (fixed contact) 11 (the second movable contact 32 and second fixed contact 21) are placed (the accommodation 70). The arc extinction material 80 promotes extinction of an arc developed between the first movable contact (movable contact) 31 and the first fixed contact (fixed contact) 11 (between the second movable contact 32 and the second fixed contact 21).

The arc extinction material 80 includes, for example, at least one of an arc extinction gas generating member 86, a gas 87, and an arc extinction member 88. The arc extinction gas generating member 86 discharges an arc extinction gas to the accommodation 70 when heated. The gas 87 has arc extinction properties and is sealed in the accommodation chamber 70. The gas 87 may be a liquid having arc extinction properties. The arc extinction body 88 extinguishes an arc by coming into contact with the arc.

The arc extinction gas, for example, is discharged to the accommodation 70, thereby increasing an electric field strength (a voltage per unit length) of the arc (as compared to vacuum/air). This can reduce the length of the arc that is possibly developed when a certain constant voltage is applied across the arc. Thereby, arc extinction can be promoted. The arc extinction gas is, for example, hydrogen.

The arc extinction gas generating member 86 is made of, for example, a hydrogen storage alloy storing hydrogen (a metal hydride). The arc extinction gas generating member 86 releases stored hydrogen (arc extinction gas) when heated, for example. The arc extinction gas generating member 86 made of a hydrogen storage alloy is provided to an inner surface of the left wall of the housing 7 to be located in the vicinity of the first movable contact 31 and the first fixed contact 11, as shown in FIG. 37. Further, the arc extinction gas generating member 86 made of a hydrogen storage alloy is provided to an inner surface of the right wall of the housing 7 to be located in the vicinity of the second movable contact 32 and the second fixed contact 21.

For example, when the movable contactor 3 is pressed by the piston 53 of the pyroactuator 5 and moved downward, an arc may be developed between the first fixed contact 11 and the first movable contact 31. Heat of the arc is transmitted to the arc extinction gas generating member 86 through gas inside the housing 7. Thus, the arc extinction gas generating member 86 is heated and thus arc extinction gas (hydrogen) is released from the arc extinction gas generating member 86. This arc extinction gas increases the electric field strength of the arc and cools the arc rapidly. Thereby, the arc can be extinguished quickly. Further, the arc extinction gas generating member 86 is placed in the vicinity of the first movable contact 31 and the first fixed contact 11. Therefore, the arc extinction gas discharged vigorously from the arc extinction gas generating member 86 blows the arc. This also contributes to extinction of the arc.

Note that components of the arc extinction gas are not limited to hydrogen. The arc extinction gas may be made of nitrogen or the like. The material for forming the arc extinction gas generating member 86 is not limited to a hydrogen storage alloy but may be any material capable of releasing an arc extinction gas when heated. Examples of the material for forming the arc extinction gas generating member 86 may include a resin material such as a phenol resin and a nylon resin mixed with magnesium hydroxide, a metal material such as hydrogen storage metal and titanium hydride, and an inorganic material such as boric acid.

The inner wall of the housing 7 may also serve as the arc extinction gas generating member 86. In other words, the inner hollow cylinder 71 may be made of a resin material that releases an arc extinction gas when heated.

The gas 87 serving as the arc extinction material 80 is defined as an arc extinction gas. The gas 87 is sealed in the accommodation 70. Examples of the arc extinction gas include the above hydrogen and SF6 (sulfur hexafluoride). Instead of the gas 87, a liquid having arc extinction properties may be sealed in the accommodation 70. The liquid having arc extinction properties is, for example, an oil such as a silicone oil.

The arc extinction member 88 serving as the arc extinction material 80 is, for example, a solidified material obtained by solidifying arc extinction sand having arc extinction properties such as silica sand with an adhesive or the like. The arc extinction member 88 made of the solidified material is provided to the inner surface of the left wall of the housing 7 to be located in the vicinity of the first movable contact 31 and the first fixed contact 11. Further, the arc extinction member 88 made of the solidified material is provided to the inner surface of the right wall of the housing 7 to be located in the vicinity of the second movable contact 32 and the second fixed contact 21. For example, when an arc is generated between the first movable contact 31 and the first fixed contact 11, the magnetic flux generated by the arc stretches the arc toward the arc extinction member 88. The arc extinction member 88 comes into contact with the stretched arc, thereby extinguishes the arc.

It is more preferable that the arc extinction member 88 is provided together with at least one of the arc extinction magnets 81, 82 of variation 22 and the circuit piece 85 of variation 23. An arc is stretched laterally by the arc extinction magnets 81, 82 and the circuit piece 85 and then comes into contact with the arc extinction member 88. Therefore, extinction of the arc can be further promoted.

Incidentally, the arc extinction member 88 may be an arc extinction device including a plurality of arc extinction grids made of a metal plate. For example, the arc extinction device may be the same one as a well-known circuit interrupter.

(2.8) Variations 25

The circuit interrupter 100 of variation 25 will be described with reference to FIGS. 38A, 38B. The circuit interrupter 100 of variation 25 includes a plurality of pairs of a movable contact and a fixed terminal in the circuit interconnecting the first electrode 12 and the second electrode 22.

Specifically, the circuit interrupter 100 of variation 25 includes a plurality of movable contactors 3 (the first movable contactor 301 and the second movable contactor 302) and also includes the third fixed terminal 38 in addition to the first fixed terminal 1 and the second fixed terminal 2. Further, the circuit interrupter 100 of variation 25 is different from the embodiment in the structure of the second fixed terminal 2. Other configurations of variation 25 are same as those of the circuit interrupter 100 of the embodiment, and therefore illustration and detailed explanations thereof are omitted.

Figure 38A:
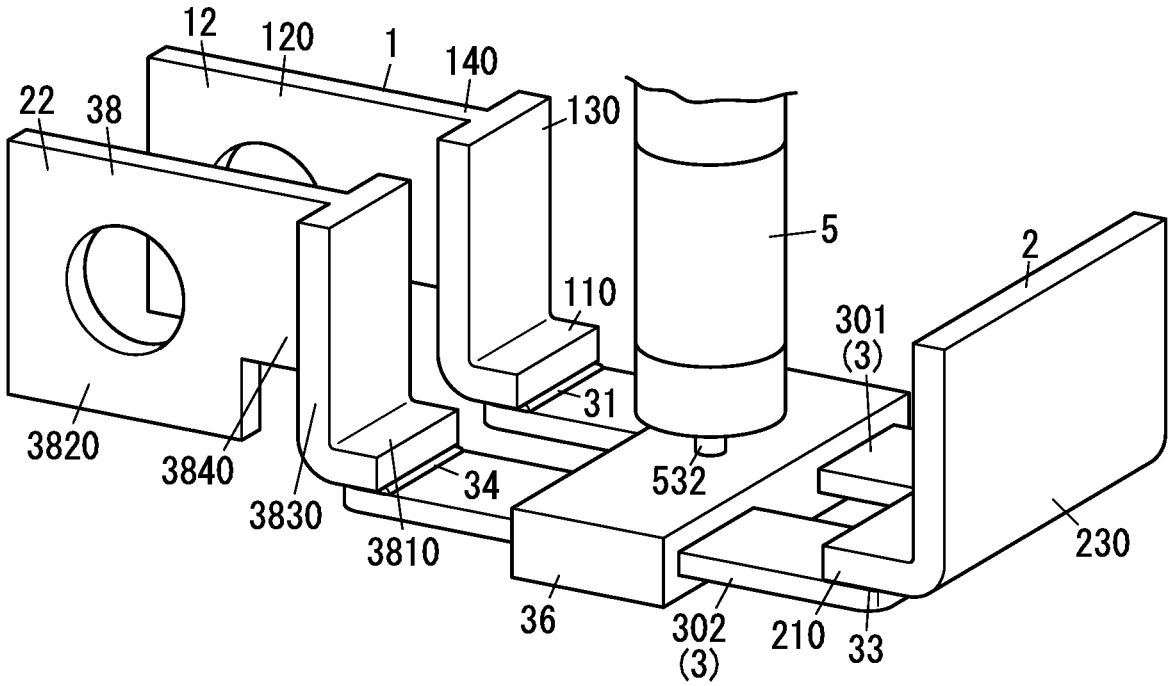
FIG. 38A is a perspective view of primary part of a circuit interrupter of variation 25.
Figure 38B:
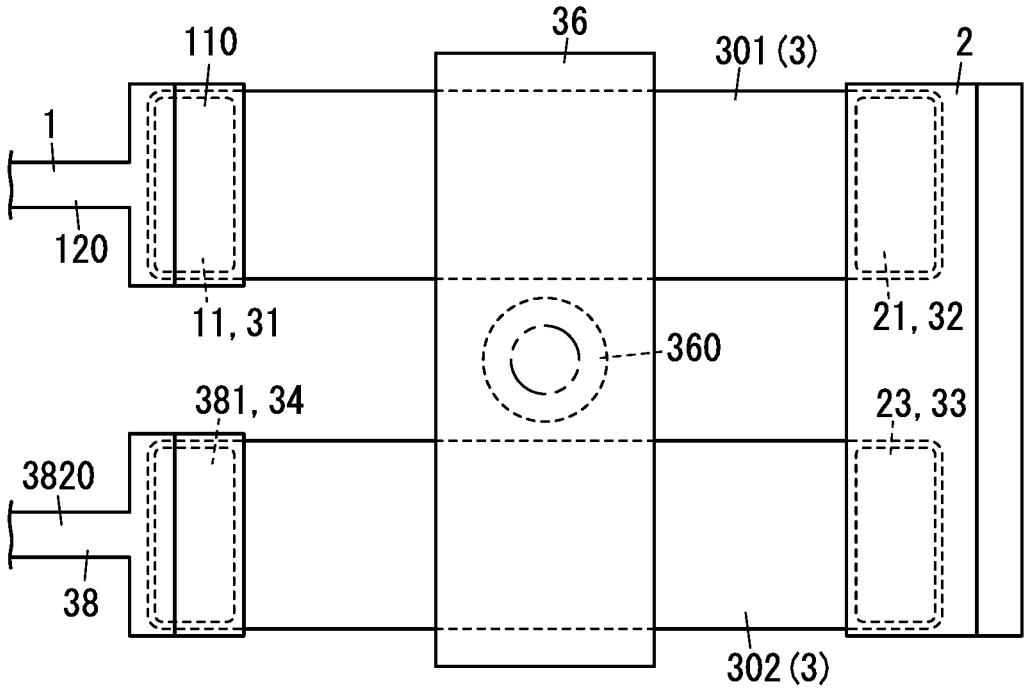
FIG. 38B is a top view of the primary part of the circuit interrupter of variation 25.

As shown in FIGS. 38A, 38B, the circuit interrupter 100 of variation 25 includes the first fixed terminal 1, the second fixed terminal 2, the first movable contactor 301, the second movable contactor 302, the holding member 36 with electrically insulating properties, and the third fixed terminal 38.

As shown in FIG. 38A, the shape of the first fixed terminal 1 in the present variation is the same as the first fixed terminal 1 of the embodiment. In other words, the first fixed terminal 1 in the present variation includes the connection piece 110, the electrode piece 120, the interconnection piece 130, and the circuit piece 140. The circuit piece 120 functions as the first electrode 12. The first fixed terminal 1 is fixed to the left wall of the housing 7 so that the circuit piece 120 is exposed outside from the housing 7 and the lower end of the interconnection piece 130 and the connection piece 110 are accommodated in the inside space (the accommodation 70) of the housing 7.

The second fixed terminal 2 in the present variation is different from the embodiment and does not include the electrode piece 220 and the circuit piece 240. A dimension in the forward/backward direction of the connection piece 210 of the second fixed terminal 2 is longer than the sum of a dimension in the forward/backward direction of the first movable contactor 301 and a dimension in the forward/backward direction of the second movable contactor 302. The second fixed terminal 2 is fixed to the right wall of the housing 7 while the lower end of the interconnection piece 230 and the connection piece 210 are accommodated in the inside space (the accommodation 70) of the housing 7.

The third fixed terminal 38 is made of an electrically conductive metal material. The third fixed terminal 38 has the same shape as the first fixed terminal 1. The third fixed terminal 38 includes a connection piece 3810, an electrode piece 3820, an interconnection piece 3830, and a circuit piece 3840 which are formed as an integral part. The third fixed terminal 38 is placed on the left wall of the housing 7 to be aligned with the first fixed terminal 1. The third fixed terminal 38 is fixed to the left wall of the housing 7 so that the electrode piece 3820 is exposed outside from the housing 7 and a lower end of the interconnection piece 3830 and the connection piece 3810 are accommodated in the inside space (the accommodation 70) of the housing 7. The electrode piece 3820 serves as the second electrode 22 to be connected to the second end of the external electric circuitry.

Each of the first movable contactor 301 and the second movable contactor 302 is a plate-like member made of a metal material having electrically conductive properties and has a length in the rightward/leftward direction. The first movable contactor 301 and the second movable contactor 302 are arranged in parallel with each other.

The first movable contactor 301 includes the first movable contact 31 and the second movable contact 32 at its respective first end (left end) and second end (right end) in its length direction. The first movable contactor 301 is placed below the first fixed terminal 1 and the second fixed terminal 2 to allow the both ends in the length direction (the rightward/leftward direction) to face the connection piece 110 and the connection piece 210 respectively. The first fixed contact 11 is defined by part of the lower surface of the first fixed terminal 1 (the connection piece 110 thereof) which is in contact with the first movable contact 31. The second fixed contact 21 is defined by part of the lower surface of the second fixed terminal 2 (the connection piece 210 thereof) which is in contact with the second movable contact 32.

The second movable contactor 302 includes the third movable contact 33 and the fourth movable contact 34 at its respective first end (right end) and second end (left end) in its length direction. The second movable contactor 302 is placed below the second fixed terminal 2 and the third fixed terminal 38 to allow the both ends in the length direction (the rightward/leftward direction) to face the connection piece 210 and the connection piece 3810 respectively. The third fixed contact 23 is defined by part of the lower surface of the second fixed terminal 2 (the connection piece 210 thereof) which is in contact with the third movable contact 33. The fourth fixed contact 381 is defined by part of the lower surface of the third fixed terminal 38 (the connection piece 3810 thereof) which is in contact with the fourth movable contact 34.

The holding member 36 is made of an insulating material such as a resin to have a cuboidal shape extending in the forward/backward direction. The holding member 36 holds the first movable contactor 301 and the second movable contactor 302. The first movable contactor 301 penetrates a center in the upward/downward direction of a back end (an upper end in FIG. 38B) of the holding member 36. The second movable contactor 302 penetrates a center in the upward/downward direction of a front end (a lower end in FIG. 38B) of the holding member 36. The holding member 36 has its upper surface facing the second end 532 of the piston 53 of the pyroactuator 5. The holding member 36 includes at its lower surface the engagement recess 360 for receiving the second end 412 of the contact pressure spring 41.

In the circuit interrupter 100 of variation 25, when the holding member 36 is pressed by the piston 53, the plurality of movable contacts (the first movable contact 31 to the fourth movable contact 34) are separated from the plurality of fixed contacts (the first fixed contact to the fourth fixed contact) at the (almost) same time. Specifically, in the circuit interrupter 100 of variation 25, pressure of the gas generated by the squib 51 causes movements of the first movable contactor 301 and the second movable contactor 302 relative to the first fixed terminal 1, the second fixed terminal 2, and the third fixed terminal 38 within the accommodation 70. Thus, the first movable contact 31 is separated from the first fixed contact 11, the second movable contact 32 is separated from the second fixed contact 21, the third movable contact 33 is separated from the third fixed contact 23, and the fourth movable contact 34 is separated from the fourth fixed contact 381.

As described above, the circuit interrupter 100 of the present variation includes a plurality of (four) contact sets (sets of a movable contact and a fixed contact) connected in series and the plurality of contact sets are opened at the (almost) same time. In this case, an arc is developed between a movable contact and a fixed contact constituting each contact set. Therefore, an arc voltage at each arc is reduced (in the present variation, it becomes half of that in the case where the number of contact sets is two). Accordingly, extinction of arcs can be promoted.

(2.9) Variation 26 to Variation 29

The circuit interrupters 100 of variations 26-29 will be described with reference to FIGS. 39-42. Each of the circuit interrupters 100 of variations 26-29 is provided with a lock mechanism 19 provided in the accommodation 70. The lock mechanism 19 holds the movable contactor 3 at a position where the movable contact (first movable contact) 31 is separated from the fixed contact (first fixed contact) 11. Each of the circuit interrupters 100 of variations 26-29 can prevent a return (rebound) of the movable contactor 3 toward the first fixed terminal 1 and the second fixed terminal 2 due to the lock mechanism 9. Other configurations of variations 26-29 are the same as those of the circuit interrupter 100 of the embodiment, and therefore illustration and detailed explanations thereof are omitted.

Figure 39:
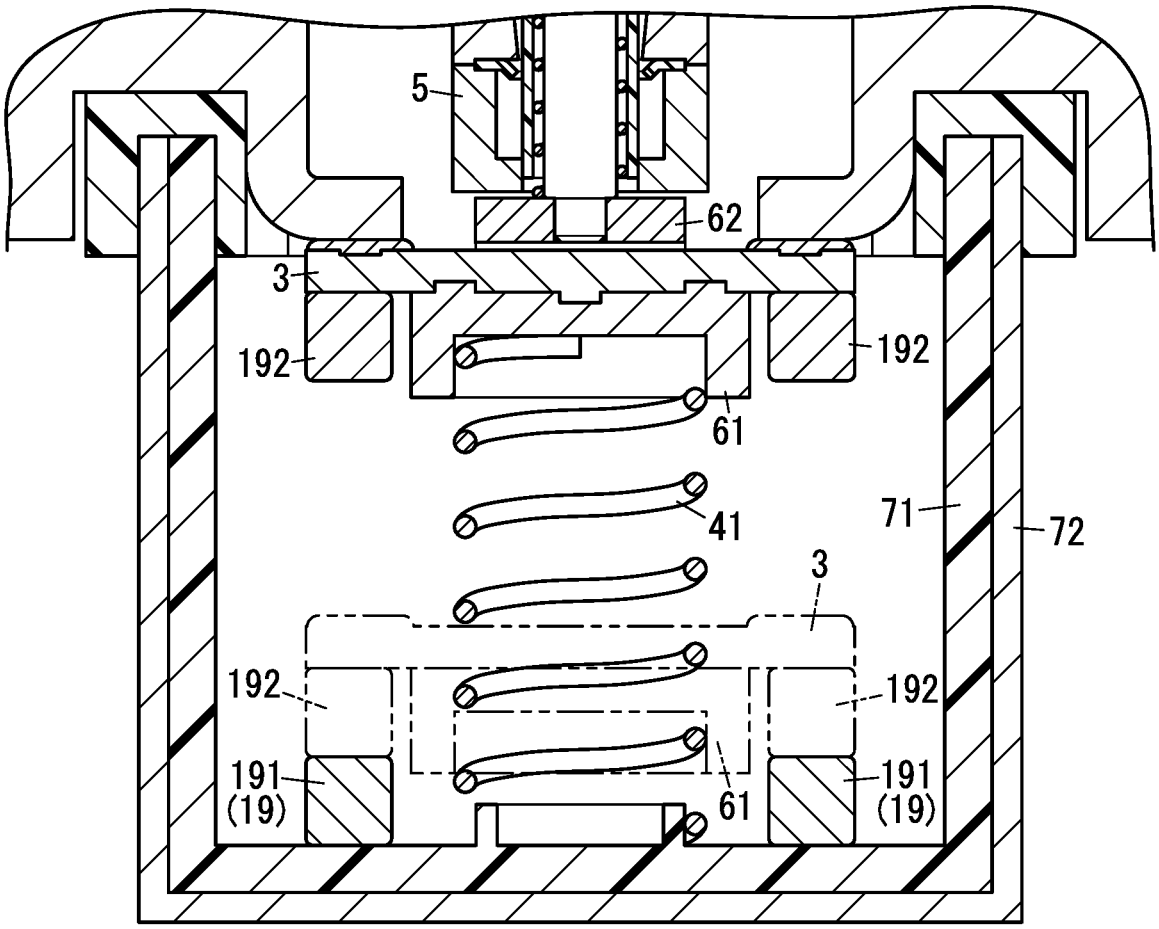
FIG. 39 is a cross-sectional view of a circuit interrupter of variation 26.

As shown in FIG. 39, the circuit interrupter 100 of variation 26 includes permanent magnets 191 as the lock mechanism 19. Specifically, in the circuit interrupter 100 of variation 26, a pair of magnets 191 are fixed on the bottom surface (inner surface) of the inner hollow cylinder 71 and to be positioned to face the opposite ends in the rightward/leftward direction of the movable contactor 3 in the upward/downward direction, respectively. A pair of magnetic members each of which has a plate shape and is made of a magnetic material (in detail, iron pieces 192) is fixed to the lower surface of the movable contactor 3 (a surface facing the bottom surface of the inner hollow cylinder 71) and positioned to face the pair of permanent magnets 191 in the upward/downward direction.

As shown by the dotted line in FIG. 39, the movable contactor 3 is pressed downward by the pyroactuator 5 and thereafter the iron pieces 192 are coupled to the permanent magnets 191 by magnetic force. Thereby the movable contactor 3 is secured. Thus, the rebound of the movable contactor 3 is prevented.

In the circuit interrupter 100 of variation 26, the number of permanent magnets 191 may be one or three or more.

Figure 40:
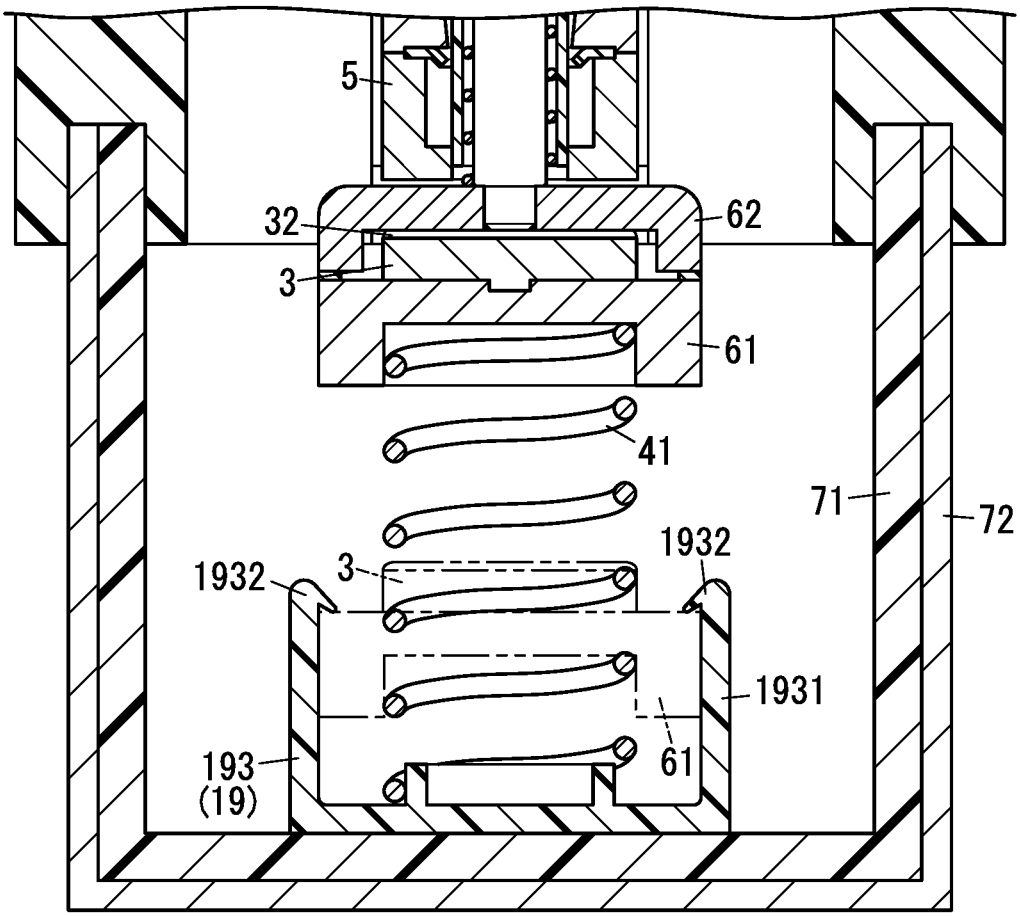
FIG. 40 is a cross-sectional view of primary part of a circuit interrupter of variation 27.

As shown in FIG. 40, the circuit interrupter 100 of variation 27 includes as the lock mechanism 19, a restriction part 193 which is mechanically coupled to the movable contactor 3 to prevent movement of the movable contactor 3 toward the fixed terminal (first fixed terminal) 1.

The restriction part 193 is made of, for example, a resin material, and includes an accommodation member 1931 and a pair of claws 1932. The accommodation member 1931 has a cuboidal shape with a length in the rightward/leftward direction (the length direction of the movable contactor 3; the normal direction of the sheet of FIG. 40) and includes at its upper surface a groove extending in the rightward/leftward direction. The groove has a width which is almost equal to the dimension in the forward/backward direction (the rightward/leftward direction in FIG. 40) of the first yoke 61. The pair of claws 1932 protrudes inward (an inward direction along the rightward/leftward direction in FIG. 40) from an upper end of the groove of the accommodation member 1931.

As shown by the two-dot chain line in FIG. 40, the movable contactor 3 and the first yoke 61 are pressed downward by the pyroactuator 5 and thereafter then the pair of claws 1932 are hooked onto the upper surface of the first yoke 61. Thus, the movable contactor 3 and the first yoke 61 are held in this position by the restriction part 193. Thus, the rebound of the movable contactor 3 is prevented.

Incidentally, in the circuit interrupter 100 of variation 27, the pair of claws 1932 may have a shape that is hooked onto the movable contactor 3 instead of the first yoke 61. For example, the pair of claws 1932 may be provided at both ends in the rightward/leftward direction of the accommodation member 1931 to be hooked onto both ends in the length direction (the rightward/leftward direction) of the movable contactor 3. Alternatively, the pair of claws 1932 may be provided on the inner side surface of the inner hollow cylinder 71. For example, the inner hollow cylinder 71 may be provided with a pair of claws which protrude inward from left and right side surfaces of the inner hollow cylinder 71 and are spaced by a distance smaller than the dimension in the rightward/leftward direction of the movable contactor 3.

Figure 41:
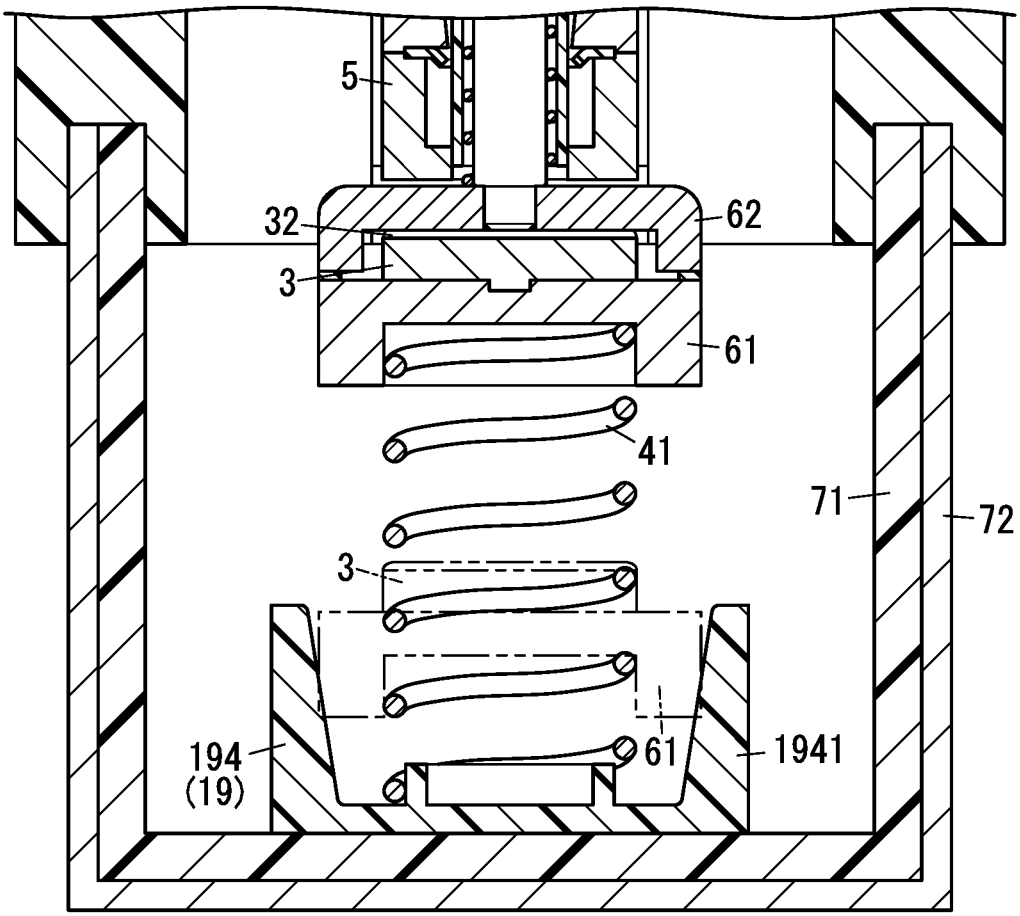
FIG. 41 is a cross-sectional view of primary part of a circuit interrupter of variation 28.

As shown in FIG. 41, the circuit interrupter 100 of variation 28 includes as the lock mechanism 19, a resin member 194 which is deformed by collision with the movable contactor 3. The resin member 194 of variation 9 serves as a deformed part 1941 which is to be plastically deformed by collision with the movable contactor 3 to be integrated with the first yoke 61.

The deformed part 1941 has a cuboidal shape with a length in the rightward/leftward direction (the length direction of the movable contactor 3; the normal direction of the sheet of FIG. 41) and includes at its upper surface a groove extending in the rightward/leftward direction. The groove has a tapered shape which is narrower toward its lower side in the forward/backward direction (the rightward/leftward direction in FIG. 41). In the forward/backward direction (the rightward/leftward direction in FIG. 41), a width of an upper end of the groove is larger than a width of the first yoke 61 and a width of a lower end of the groove is smaller than the width of the first yoke 61.

As shown by the two-dot chain line in FIG. 41, when the movable contactor 3 and the first yoke 61 are pressed downward by the pyroactuator 5, they move downward while deforming the inner side surface of the groove of the deformed part 1941. Thus, the deformed part 1941 is integrated with the first yoke 61 and therefore upward return of the first yoke 61 and the movable contactor 3 is prevented.

Figure 42:
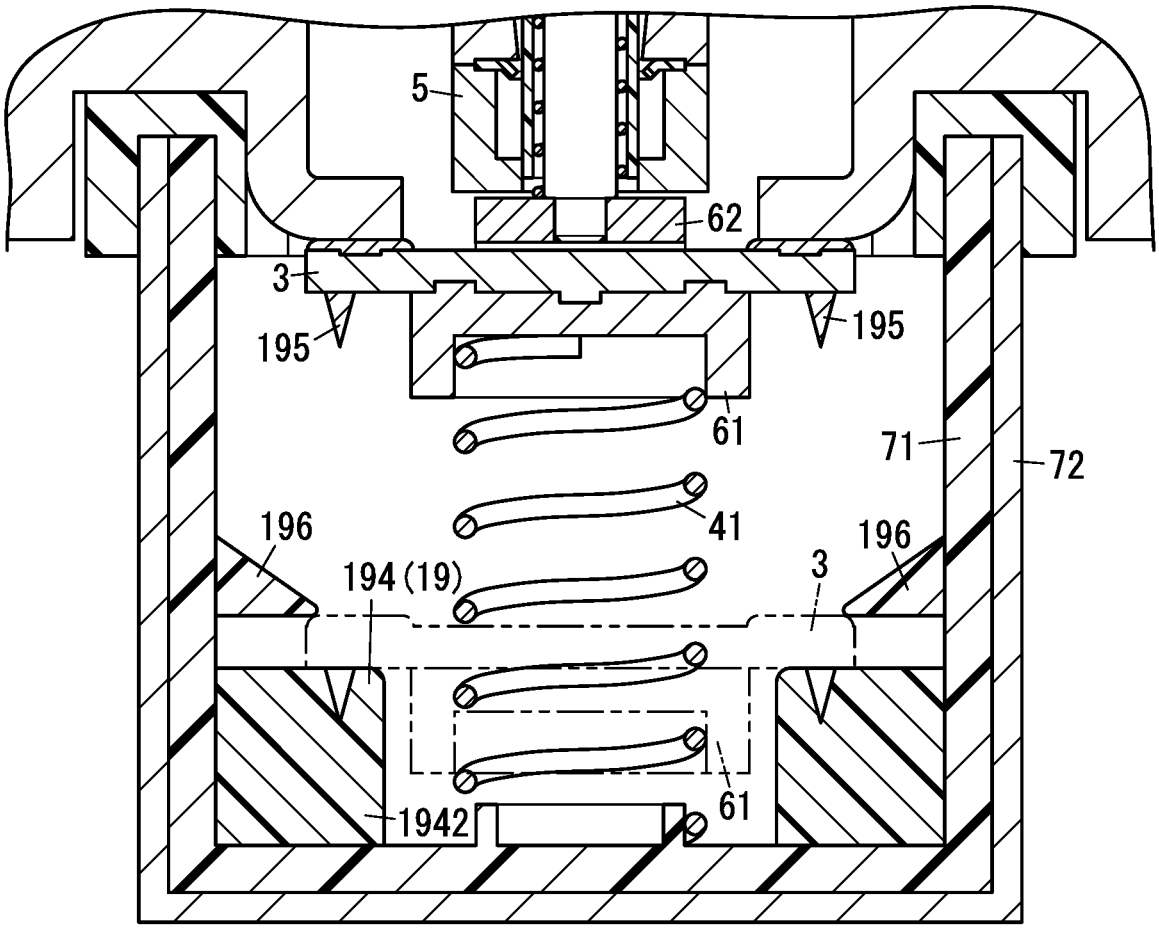
FIG. 42 is a cross-sectional view of primary part of a circuit interrupter of variation 29.

As shown in FIG. 42, the circuit interrupter 100 of variation 29 includes as the lock mechanism 19, resin members 194 to be deformed by collision of the movable contactor 3. Further, in the circuit interrupter 100 of variation 29, the movable contactor 3 includes protrusions 195 protruding toward the resin members 94. Further, the circuit interrupter 100 of variation 29 includes a pair of claws 196 which are provided on the left and right side surfaces of the inner hollow cylinder 71 to be in contact with the upper surface of the movable contactor 3 moved.

The resin members 194 are fixed to the bottom surface (inner surface) of the inner hollow cylinder 71 to be positioned to face the both ends in the rightward/leftward direction of the movable contactor 3 in the upward/downward direction (in FIG. 42, only the left one is shown). Further, the pair of protrusions 195 made of a resin material are provided to the lower surface of the movable contactor 3 (the surface facing the bottom surface of the inner hollow cylinder 71) to be positioned to face the pair of resin members 194 in the upward/downward direction.

When the movable contactor 3 and the first yoke 61 are pressed downward by the pyroactuator 5, the both ends in the rightward/leftward direction of the movable contactor 3 collides with the pair of resin members 194 respectively, thereby deforming the resin members 194. Thus, kinetic energies of the movable contactor 3 and the first yoke 61 are absorbed by the resin members 194. Therefore, the speeds of the movable contactor 3 and the first yoke 61 are reduced. For example, when the movable contactor 3 and the first yoke 61 reach the bottom surface of the inner hollow cylinder 71 at high speeds, there is a possibility that they rebound from the bottom surface of the inner hollow cylinder 71. In contrast, in the present variation, the kinetic energies of the movable contactor 3 and the first yoke 61 are absorbed by the resin members 194. Therefore, the rebounds of the movable contactor 3 and the first yoke 61 can be prevented. The two-dot chain line in FIG. 42 shows the movable contactor 3 and the first yoke 61 at positions where the resin members 194 are deformed and thereafter returned to their original shapes.

That is, the resin members 194 of variation 29 serve as shock absorbers (cushions) 1942 for absorbing the energy (kinetic energy) of the collision with the movable contactor 3.

Incidentally, the lock mechanism 19 may include another lock mechanism other than the permanent magnet 191, the restriction part 193, and the resin member 194. The lock mechanism 19 may include two or more of the permanent magnet 191, the restriction part 193, the resin member 194, and any other lock mechanism together (e.g., the permanent magnet 191 and the restriction part 193 together). Further, the circuit interrupter 100 may not include the lock mechanism 19 as long as the detent mechanism of the pyroactuator 5 and the pressure of the gas filled in the case 52 can prevent the rebound of the movable contactor 3.

(2.10) Other Variations

The application of the circuit interrupter 100 is not limited to a fuse for the vehicle 300. The circuit interrupter 100 may be used for interrupting any electric circuitry through which a large current, such as, for example, a short circuit current may flow.

The pyroactuator 5 is not limited to being configured to move the movable contactor 3 by use of the piston 53. For example, the circuit interrupter 100 may be configured to allow the movable contactor 3 to receive the pressure of the gas generated by the squib 51 directly (the movable contactor 3 forms part of the outer wall of the pressure chamber 520) and to allow the movable contactor 3 to be moved directly by the pressure of the gas.

Before the movement of the piston 53, the pressurized chamber 520 may be connected to the accommodation 70 but is preferably separated from the accommodation 70.

The piston 53 may be in contact with the movable contactor 3. For example, the pin 535 of the piston 53 may protrude more downward than the second yoke 62 to be in direct contact with the upper surface of the movable contactor 3 or may be in indirect contact with the upper surface of the movable contactor 3 with a spacer in-between.

A guide for defining the moving direction of the movable contactor 3 may be formed in the accommodation 70 of the housing 7. The guide may be formed on the inner wall of the accommodation 70 to be long in the upward/downward direction to be in contact with the side surface of the movable contactor 3 along the moving direction of the movable contactor 3. Thus, when the movable contactor 3 is moved by the pyroactuator 5, the movable contactor 3 is less likely to tilt. The guide may be a rod extending upward from the bottom surface of the accommodation 70 and penetrating the movable contactor 3.

The circuit interrupter 100 may include a stopper between the piston 53 and the movable contactor 3 to prevent movement of the piston 53. The stopper is broken by a force applied by the piston 53 in movement after the piston 53 moves due to the pressure of the gas generated in the squib 51. Until broken, the stopper prevents the piston 53 from applying a force onto the movable contactor 3 (pressing the movable contactor 3). In this case, the piston 53 presses the movable contactor 3 after the pressure in the pressurized chamber 520 becomes larger relative to the case where no stopper is provided. Therefore, the piston 53 is pressed by a larger force and thus the movable contactor 3 moves more vigorously. Consequently, an arc developed between the movable contactor 31 and the fixed contact 11 is rapidly stretched. Thus, the arc extinction performance of the circuit interrupter 100 is improved.

(3) Aspects

As obvious from the above-described embodiment and variations, a circuit interrupter (100) according to a first aspect includes a fixed terminal (1), a movable contactor (3), a holding unit (4), and a squib (51). The fixed terminal (1) includes a fixed contact (11). The movable contactor (3) includes a movable contact (31). The movable contactor (3) is formed as a separate part from the fixed terminal (1). The holding unit (4) is configured to hold the movable contactor (3) so that the movable contact (31) is connected to the fixed contact (11). The squib (51) is configured to generate gas by combustion. Pressure of the gas generated by the squib (51) causes movement of the movable contactor (3) in a direction away from the fixed terminal (1) so that the movable contact (31) is separated from the fixed contact (11).

According to the first aspect, the movable contactor (3) is moved relative to the fixed terminal (1) (i.e., separated from the fixed terminal 1) at a high speed by using the energy of the gas generated by the squib (51) to interrupt the circuit. Therefore, an arc developed between the movable contact (31) and the fixed contact (11) is rapidly stretched and extinguished by a distance as long as the movable contactor (3) moves. Thus, it is possible to extinguish the arc in a short time and thus improve the current interruption performance.

In a circuit interrupter (100) according to a second aspect referring to the first aspect, the holding unit (4) includes an elastic part (the contact pressure spring 41) for biasing the movable contactor (3) in a direction in which the movable contact (31) is connected to the fixed contact (11).

According to the second aspect, the holding unit (4) can hold the movable contactor (3) so that the movable contact (31) is connected to the fixed contact (11).

In a circuit interrupter (100) according to a third aspect referring to the first or second aspect, the holding unit (4) includes a permanent magnet (421; 422).

According to the third aspect, the holding unit (4) can hold the movable contactor (3) so that the movable contact (31) is connected to the fixed contact (11).

In a circuit interrupter (100) according to a fourth aspect referring to any one of the first to third aspects, the holding unit (4) includes a latch mechanism (43) for mechanically holding the movable contactor (3).

According to the fourth aspect, the holding unit (4) can hold the movable contactor (3) so that the movable contact (31) is connected to the fixed contact (11).

In a circuit interrupter (100) according to a fifth aspect referring to any one of the first to fourth aspects, the movable contact (31) is in contact with the fixed contact (11).

According to the fifth aspect, it is possible to reduce a force necessary for separating the movable contact (31) from the fixed contact (11).

In a circuit interrupter (100) according to a fifth aspect referring to any one of the first to fourth aspects, the movable contact (31) is welded to the fixed contact (11).

According to the sixth aspect, it is possible to increase a contact surface between the movable contact (31) and the fixed contact (11) and improve a contact pressure between the movable contact (31) and the fixed contact (11).

A circuit interrupter (100) according to a seventh aspect referring to any one of the first to sixth aspects includes a pressurized chamber (520) and a piston (53). The pressurized chamber (520) is for receiving pressure of the gas. The piston (53) includes a first end (531) for receiving pressure inside the pressurized chamber (520) which causes movement of the piston (53) and a second end (532) for providing a force in a direction separating the movable contactor (3) from the fixed terminal (1) to the movable contactor (3) which causes movement of the movable contactor (3).

According to the seventh aspect, the movable contactor (3) is moved by the piston (53). It is possible to transfer the pressure of the gas to the movable contactor (3) more efficiently than in the case where the movable contactor (3) receives the pressure of the gas directly.

In a circuit interrupter (100) according to an eighth aspect referring to the seventh aspect, the piston (53) is configured to press the movable contactor (3) with the second end (532).

According to the eighth aspect, it is possible to transfer the pressure of the gas to the movable contactor (3) by the piston (53).

In a circuit interrupter (100) according to a ninth aspect referring to the seventh or eighth aspect, a direction of movement of the movable contactor (3) intersects a direction of movement of the piston (53).

According to the ninth aspect, it is possible to increase the degree of freedom of design of the circuit interrupter (100).

In a circuit interrupter (100) according to a tenth aspect referring to the seventh aspect, the second end (532) of the piston (53) is coupled to the movable contactor (3). The piston (53) is configured to pull the movable contactor (3) with the second end (532).

According to the tenth aspect, it is possible to transfer the pressure of the gas to the movable contactor (3) by the piston (53).

A circuit interrupter (100) according to an eleventh aspect referring to any one of the seventh to tenth aspects includes a detent mechanism (the third cylindrical portion). The detent mechanism is configured to mechanically hold the piston (53) after movement of the movable contactor (3) to prevent the piston (53) from returning to an original position.

According to the eleventh aspect, it is possible to prevent the piston (53) from returning to the original position and also prevent the movable contactor (3) moved by the piston (53) from returning to an original position.

A circuit interrupter (100) according to a twelfth aspect referring to any one of the first to eleventh aspects includes a first electrode (12) and a second electrode (22) which are connected to a first end and a second end of external electric circuitry, respectively. The circuit interrupter (100) includes only one set of the movable contact (31) and the fixed contact (11) in a circuit interconnecting the first electrode (12) and the second electrode (22).

According to a twelfth aspect, there is one place where the connection may become unstable due to the electromagnetic repulsive force. Thus, it is possible to stabilize the connection state between the movable contact (31) and the fixed contact (11), that is, the conduction state between the first electrode (12) and the second electrode (22).

In a circuit interrupter (100) according to a thirteenth aspect referring to any one of the first to twelfth aspects, the movable contactor (3) has a plate shape. The circuit interrupter (100) includes a yoke (first yoke 61) secured to an opposite surface of the movable contactor from a surface where the movable contact (31) is positioned.

According to the thirteenth aspect, when a current flows through the movable contactor (3), the first yoke (61) allows a magnetic field caused by the current to pass therethrough. Therefore, the center of the magnetic field acting on the current flowing through the movable contactor (3) is attracted toward the surface of the movable contactor (3) where the movable contact (31) is placed. As a result, a force in a direction maintaining the connection between the movable contact (31) and the fixed contact (11) is generated. Therefore, it is possible to stabilize the connection between the movable contact (31) and the first fixed contact (11).

A circuit interrupter (100) according to a fourteenth aspect referring to the thirteenth aspect further includes a second yoke (62). The second yoke (62) is secured to a position facing the first yoke (61) with the movable contactor (3) in-between to be separated from the movable contactor (3).

According to the fourteenth aspect, a current flowing through the movable contactor (3) causes an attraction force between the first yoke (61) and the second yoke (62) and the movable contactor (3) sees a force in a direction maintaining the connection between the movable contact (31) and the fixed contact (11). Therefore, it is possible to stabilize the connection state between the movable contact (31) and the fixed contact (11).

A circuit interrupter (100) according to a fifteenth aspect referring to any one of the first to fourteenth aspects includes a circuit piece (the fourth circuit piece 1404, 2404) which is electrically connected to the fixed contact (11) and extends along a direction of a current flowing through the movable contactor (3). The movable contactor (3) is positioned between the circuit piece (the fourth circuit piece 1404, 2404) and the fixed contact (11) in a direction in which the movable contact (31) and the fixed contact (11) face together. A direction of the current flowing through the circuit piece is an opposite direction from the direction of the current flowing through the movable contactor (3).

According to the fifteenth aspect, a repulsive force is developed between the movable contactor (3) and the circuit piece (the fourth circuit piece 1404, 2404). Therefore, the movable contactor (3) receives a force in a direction away from the circuit piece (the fourth circuit piece 1404, 2404). Thus, it is possible to stabilize the connection state between the movable contact (31) and the fixed contact (11).

A circuit interrupter (100) according to a sixteenth aspect referring to any one of the first to fifteenth aspects includes a bimetallic strap (65) which curves due to increase in temperature to press the movable contactor (3) in a direction from the movable contact (31) toward the fixed contact (11).

According to the sixteenth aspect, it is possible to stabilize the connection state between the movable contact (31) and the fixed contact (11).

A circuit interrupter (100) according to a seventeenth aspect referring to any one of the first to sixteenth aspects includes a plurality of the movable contactors (3) individually including a plurality of the movable contacts (31).

According to the seventeenth aspect, it is possible to reduce the magnitude of a current flowing through each movable contactor (3), thereby reducing the electromagnetic repulsive force acting on each junction. Therefore, the connection state between the movable contact (31) and the fixed contact (11) can be stabilized.

In a circuit interrupter (100) according to an eighteenth aspect referring to the seventeenth aspect, pressure of the gas generated by the squib (51) causes the plurality of movable contacts (31) to be separated from a plurality of the fixed contacts (11) at different timings.

According to the eighteenth aspect, it is possible to separate the plurality of movable contactors (3) from the fixed terminals (1) at different timings. Therefore, an arc may be developed between only the pair of the fixed terminal (1) and the movable contactor (3) in which the movable contact (31) is separated from the fixed contact (11) at the last time.

In a circuit interrupter (100) according to a nineteenth aspect referring to the seventeenth or eighteenth aspect, the plurality of movable contacts (31) are made of different materials.

According to the nineteenth aspect, individual materials of the movable contacts (31) of the movable contactors (3) can be selected from high arc resistance materials, high conduction materials, and the like, depending their applications.

In a circuit interrupter (100) according to a twentieth aspect referring to the seventeenth or eighteenth aspect, the plurality of movable contacts (31) are made of a same material.

According to the twentieth aspect, the plurality of movable contacts (31) of the movable contactors (3) are made of the same material. This can reduce a production cost. When the plurality of movable contacts (31) of the movable contactors (3) are separated from the plurality of fixed contacts (11) at the same time, a current is distributed to flow through the movable contactors (3) and a currents flowing through individual movable contactors (3) are reduced, resulting in a reduction in an electromagnetic repulsive force. Thus, it is possible to stabilize the connection state between the movable contact (31) and the fixed contact (11).

In a circuit interrupter (100) according to a twenty-first aspect referring to any one of the seventeenth to twentieth aspects, the plurality of movable contactors (3) include two movable contactors 3 (the first movable contact 301, the second movable contact 302) arranged in parallel with each other. Directions of movement of the two movable contactors 3 (the first movable contact 301, the second movable contact 302) are different from each other.

According to the twenty-first aspect, a current flowing through one movable contactor (3) receives a Lorentz force due to a magnetic field caused by a current flowing through the other movable contactor (3). This Lorentz force can reduce an electromagnetic repulsive force. Thus, it is possible to stabilize the connection state between the movable contact (31) and the fixed contact (11).

In a circuit interrupter (100) according to a twenty-second aspect referring to any one of the first to twenty-first aspects, the movable contactor (3) includes a second movable contact (32) in addition to a first movable contact (31) serving as the movable contact (31). The circuit interrupter (100) includes a second fixed terminal (2) including a second fixed contact (21) in addition to a first fixed terminal (1) serving as the fixed terminal (1) including a first fixed contact (11) serving as the fixed contact (11). The movable contactor (3) is held between the first fixed terminal (1) and the second fixed terminal (2) so that the first movable contact (31) is in contact with the first fixed contact (11) and the second movable contact (32) is in contact with the second fixed contact (21).

According to the twenty-second aspect, it is possible to stabilize the connection state between the movable contact (31) and the fixed contact (11).

In a circuit interrupter (100) according to a twenty-third aspect referring to the twenty-second aspect, a direction in which the first fixed contact (11) and the first movable contact (31) face each other is an opposite direction from a direction in which the second fixed contact (21) and the second movable contact (32) face each other.

According to the twenty-third aspect, it is possible to stabilize the connection state between the movable contact (31) and the fixed contact (11).

In a circuit interrupter (100) according to a twenty-fourth aspect referring to any one of the first to twenty-third aspects, one of the fixed contact (11) and the movable contact (31) is defined as a first contact and the other is defined as a second contact. The circuit interrupter (100) includes a plurality of the second contacts. The plurality of the second contacts are connected to one first contact.

According to the twenty-fourth aspect, there is a plurality of junctions between the movable contactor (3) and the fixed terminal (1) and therefore the electromagnetic repulsive force at each junction can be reduced.

A circuit interrupter (100) according to a twenty-fifth aspect referring to any one of the first to twenty-fourth aspects includes an additional movable contactor (9) which is a separate part from the movable contactor (3) and is connected in series with the movable contactor (3). The movable contactor (3) and the additional movable contactor (9) are arranged in parallel with each other. A direction of movement of the movable contactor (3) and a direction of movement of the additional movable contactor (9) are different from each other.

According to the twenty-fifth aspect, a current flowing through the movable contactor (3) receives a Lorentz force due to a magnetic field caused by a current flowing through the additional movable contactor (9). This Lorentz force can reduce an electromagnetic repulsive force. Thus, it is possible to stabilize the connection state between the movable contact (31) and the fixed contact (11).

Configurations according to the second to twenty-fifth aspects are not necessary for the circuit interrupter (100) and therefore can be omitted appropriately.

A circuit interrupter (100) according to a twenty-sixth aspect includes a fixed terminal (1), a movable contactor (3), a squib (51), and accommodation (70). The fixed terminal (1) includes a fixed contact (11). The movable contactor (3) is formed as a separate part from the fixed terminal (1). The movable contactor (3) includes a movable contact (31) connected to the fixed contact (11). The squib (51) is configured to generate gas by combustion. The accommodation (70) is for accommodating the fixed contact (11) and the movable contactor (3). Pressure of the gas generated by the squib (51) causes movement of the movable contactor (3) in a direction away from the fixed terminal (1) in the accommodation (70) so that the movable contact (31) is separated from the fixed contact (11).

According to the twenty-sixth aspect, the movable contactor (3) is moved relative to the fixed terminal (1) (i.e., separated from the fixed terminal 1) at a high speed in the accommodation (70) by using the energy of the gas generated by the squib (51) to interrupt the circuit. Therefore, an arc developed between the movable contact (31) and the fixed contact (11) is rapidly stretched and extinguished by a distance as long as the movable contactor (3) moves in the accommodation (70). Thus, it is possible to extinguish the arc in a short time and thus improve the current interruption performance.

A circuit interrupter (100) according to a twenty-seventh aspect referring to the twenty-sixth aspect includes a pressurized chamber (520) and a piston (53). The pressurized chamber (520) is for receiving pressure of the gas. The piston (53) includes a first end (531) for receiving pressure inside the pressurized chamber (520) which causes movement of the piston (53) and a second end (532) for providing a force in a direction separating the movable contactor (3) from the fixed terminal (1) to the movable contactor (3) which causes movement of the movable contactor (3).

According to the twenty-seventh aspect, the movable contactor (3) is moved by the piston (53). It is possible to transfer the pressure of the gas to the movable contactor (3) more efficiently than in the case where the movable contactor (3) receives the pressure of the gas directly.

In a circuit interrupter (100) according to a twenty-eighth aspect referring to the twenty-seventh aspect, the piston (53) is configured to press the movable contactor (3) with the second end (532).

According to the twenty-eighth aspect, it is possible to transfer the pressure of the gas to the movable contactor (3) by the piston (53).

In a circuit interrupter (100) according to a twenty-ninth aspect referring to the twenty-seventh aspect, the second end (532) of the piston (53) is coupled to the movable contactor (3). The piston (53) is configured to pull the movable contactor (3) with the second end (532).

According to the twenty-ninth aspect, it is possible to transfer the pressure of the gas to the movable contactor (3) by the piston (53).

A circuit interrupter (100) according to a thirtieth aspect referring to any one of the twenty-seventh to twenty-ninth aspects includes a detent mechanism (the third cylindrical portion). The detent mechanism is configured to mechanically hold the piston (53) after movement of the movable contactor (3) to prevent the piston (53) from returning to an original position.

According to the thirtieth aspect, it is possible to prevent the piston (53) from returning to the original position and also prevent the movable contactor (3) moved by the piston (53) from returning to an original position.

A circuit interrupter (100) according to a thirty-first aspect referring to any one of the twenty-sixth to thirtieth aspects includes a magnetic flux generator (8). The magnetic flux generator (8) is configured to generate a magnetic flux for stretching an arc developed between the movable contact (31) and the fixed contact (11) inside the accommodation (70).

According to the thirty-first aspect, it is possible to promote extinction of the arc developed between the movable contact (31) and the fixed contact (11).

A circuit interrupter (100) according to a thirty-second aspect referring to any one of the twenty-sixth to thirty-first aspects includes an arc extinction material (80). The arc extinction material (80) is placed in the accommodation (70). The arc extinction material (80) is for promoting extinction of an arc developed between the movable contact (31) and the fixed contact (11).

According to the thirty-second aspect, it is possible to promote extinction of the arc developed between the movable contact (31) and the fixed contact (11).

In a circuit interrupter (100) according to a thirty-third aspect referring to the thirty-second aspect, the arc extinction material (80) includes an arc extinction gas generating member (86). The arc extinction gas generating member (86) releases an arc extinction gas to the accommodation (70) when heated.

According to the thirty-third aspect, it is possible to promote extinction of the arc developed between the movable contact (31) and the fixed contact (11).

In a circuit interrupter (100) according to a thirty-fourth aspect referring to the thirty-second or thirty-third aspect, the arc extinction material (80) includes a gas (87) or liquid. The gas (87) or the liquid is sealed in the accommodation (70) and has arc extinction properties.

According to the thirty-fourth aspect, it is possible to promote extinction of the arc developed between the movable contact (31) and the fixed contact (11).

In a circuit interrupter (100) according to a thirty-fifth aspect referring to any one of the thirty-second to thirty-fourth aspects, the arc extinction material (80) includes an arc extinction member (88). The arc extinction member (88) is placed inside the accommodation (70) and extinguishes the arc when touching the arc.

According to the thirty-fifth aspect, it is possible to promote extinction of the arc developed between the movable contact (31) and the fixed contact (11).

A circuit interrupter (100) according to a thirty-sixth aspect referring to any one of the twenty-sixth to thirty-fifth aspects includes a first electrode (12) and a second electrode (22) which are to be connected to a first end and a second end of external electric circuitry, respectively. The circuit interrupter (100) includes a plurality of sets of the movable contactor and the fixed terminal (the first movable contactor 301 and the first fixed terminal 1, the second movable contactor 302 and the second fixed terminal 2) in a circuit interconnecting the first electrode (12) and the second electrode (22).

According to the thirty-sixth aspect, an arc is developed between a movable contact and a fixed contact constituting each contact set. Therefore, an arc voltage at each arc is reduced. Accordingly, extinction of arcs can be promoted.

A circuit interrupter (100) according to a thirty-seventh aspect referring to any one of the twenty-sixth to thirty-sixth aspects includes a lock mechanism (19). The lock mechanism (19) is configured to keep the movable contactor (3) in a separate position where the movable contact (31) is separated from the fixed contact (11).

According to the thirty-seventh aspect, the lock mechanism (19) can prevent a return (rebound) of the movable contactor (3) toward the fixed terminal (1).

In a circuit interrupter (100) according to a thirty-eighth aspect referring to the thirty-seventh aspect, the lock mechanism (19) includes a permanent magnet (191).

According to the thirty-eighth aspect, it is possible to prevent the movable contactor (3) from returning toward the fixed terminal (1).

In a circuit interrupter (100) according to a thirty-ninth aspect referring to the thirty-seventh or thirty-eighth aspect, the lock mechanism (19) includes a restriction part (193). The restriction part (193) is configured to make mechanical connection with the movable contactor (3) to restrict movement of the movable contactor (3) in a direction toward the fixed terminal (1).

According to the thirty-ninth aspect, it is possible to prevent the movable contactor (3) from returning toward the fixed terminal (1).

In a circuit interrupter (100) according to a fortieth aspect referring to any one of the thirty-seventh to thirty-ninth aspects, the lock mechanism (19) includes a resin member (194) which deforms when struck by the movable contactor (3).

According to the fortieth aspect, it is possible to prevent the movable contactor (3) from returning toward the fixed terminal (1).

In a circuit interrupter (100) according to a forty-first aspect referring to the fortieth aspect, the movable contactor (3) includes a protrusion (195) protruding in a direction toward the resin member (194).

According to the forty-first aspect, the protrusion (195) sticks into the resin member (194) and therefore it is possible to prevent the movable contactor (3) from returning toward the fixed terminal (1).

REFERENCE SIGNS LIST

100 Circuit Interrupter
1 First Fixed Terminal (Fixed Terminal)
11 First Fixed Contact (Fixed Contact)
12 First Electrode
1404 Fourth Circuit Piece (Circuit Piece)
2 Second Fixed Terminal
21 Second Fixed Contact
22 Second Electrode
2404 Fourth Circuit Piece (Circuit Piece)
3 Movable Contactor
31 First Movable Contact (Movable Contact)
32 Second Movable Contact
4 Holding Unit
41 Contact Pressure Spring (Elastic Part)
421, 422 Permanent Magnet

43 Latch Mechanism
51 Squib
520 Pressurized Chamber
53 Piston
531 First End
532 Second End
61 First Yoke
62 Second Yoke
65 Bimetallic Strap
9 Additional Movable Contactor
70 Accommodation
8 Magnetic Flux Generator
80 Arc Extinction Material
86 Arc Extinction Gas Generating Member
87 Gas
88 Arc Extinction Member
19 Lock Mechanism
191 Permanent Magnet
193 Restriction Part
194 Resin Member
195 Protrusion

The invention claimed is:

1. A circuit interrupter, comprising:
a fixed terminal including a fixed contact;
a movable contactor that is formed as a separate part from the fixed terminal and includes a movable contact;
a sleeve including a first cylindrical portion and a second cylindrical portion, an inner diameter of which is smaller than an inner diameter of the first cylindrical portion;
a piston located in the sleeve, and including a base and a cylinder, an outer diameter of which is smaller than an outer diameter of the base; and
a squib configured to generate gas by combustion,
wherein the inner diameter of the second cylindrical portion is smaller than an outer diameter of the base of the piston,
when the squib generates the gas, the piston moves down so that the cylinder moves in the sleeve in order of the first cylindrical portion of the sleeve and the second cylindrical portion of the sleeve,
movement of the cylinder causes movement of the movable contactor in a direction away from the fixed terminal so that the movable contact is separated from the fixed contact, and
the movement of the cylinder is stopped by the base being held on a sidewall of the second cylindrical portion, and
wherein the second cylindrical portion is formed in a tapered shape with a smaller inner diameter toward the down side.

2. The circuit interrupter according to claim 1,
wherein the first cylindrical portion is located between the squib and the second cylindrical portion.

3. The circuit interrupter according to claim 1,
wherein the first cylindrical portion is formed in a tapered shape with a smaller inner diameter toward the down side so that the base of the piston passes through the first cylindrical portion.

4. The circuit interrupter according to claim 1,
wherein the movable contact is welded to the fixed contact.

5. The circuit interrupter according to claim 1,
wherein the piston includes a first end for receiving pressure and a second end for providing a force in a direction separating the movable contactor from the fixed terminal to the movable contactor, which causes movement of the movable contactor.

6. The circuit interrupter according to claim 1,
wherein the sleeve further includes a third cylindrical portion located between the first cylindrical portion and the second cylindrical portion, and
an inner diameter of the third cylindrical portion is smaller than the inner diameter of the first cylindrical portion and is larger than the inner diameter of the second cylindrical portion.

7. The circuit interrupter according to claim 1, further comprising:
a holding spring,
wherein the base of the piston has a holding groove, and
the holding spring contacts with the holding groove.

8. The circuit interrupter according to claim 1,
wherein the movable contactor has a plate shape; and
the circuit interrupter further comprises a yoke secured to an opposite surface of the movable contactor from a surface where the movable contact is positioned.

9. The circuit interrupter according to claim 8, further comprising:
a first yoke serving as the yoke, and
a second yoke secured to a position facing the first yoke with the movable contactor in-between to be separated from the movable contactor.

10. A circuit interrupter, comprising:
a fixed terminal including a fixed contact;
a movable contactor that is provided below the fixed contact and includes a movable contact;
a squib configured to generate gas by combustion;
a piston that pushes the movable contactor in a direction away from the fixed terminal when the squib generates the gas;
a sleeve that arranges the piston inside; and
a holding spring that holds the piston pushing the movable contactor in the direction away from the fixed terminal,
wherein the holding spring includes a holding portion having a hollow frustoconical shape, and
the holding portion contacts with the piston.

11. The circuit interrupter according to claim 10,
wherein the movable contactor has a plate shape, and
the circuit interrupter comprises a yoke secured to an opposite surface of the movable contactor from a surface where the movable contact is positioned.

12. The circuit interrupter according to claim 11, the circuit interrupter further comprising:
a first yoke serving as the yoke, and
a second yoke secured to a position facing the first yoke with the movable contactor in-between to be separated from the movable contactor.

13. The circuit interrupter according to claim 10,
wherein an inner diameter of the holding portion is smaller than an inner diameter of the sleeve.

14. The circuit interrupter according to claim 10,
wherein the holding spring further includes a clamping portion having a hollow disk shape contacting with the sleeve.

15. A circuit interrupter, comprising:
a fixed terminal including a fixed contact;
a movable contactor that is provided below the fixed contact and includes a movable contact;
a squib configured to generate gas by combustion;
a piston that pushes the movable contactor in a direction away from the fixed terminal when the squib generates the gas;

a sleeve that arranges the piston inside; and a holding spring that holds the piston pushing the movable contactor in the direction away from the fixed terminal, wherein the piston has a holding groove, and the holding spring contacts with the holding groove.

* * * * *